US007674172B2

(12) United States Patent
Miltenberger et al.

(10) Patent No.: US 7,674,172 B2
(45) Date of Patent: Mar. 9, 2010

(54) GAMING DEVICE HAVING A WHEEL-BASED GAME

(75) Inventors: Paul D. Miltenberger, Las Vegas, NV (US); Mark C. Nicely, Daly City, CA (US)

(73) Assignee: IGT, Reno, NV (US)

( * ) Notice: Subject to any disclaimer, the term of this patent is extended or adjusted under 35 U.S.C. 154(b) by 602 days.

(21) Appl. No.: 11/558,777

(22) Filed: Nov. 10, 2006

(65) Prior Publication Data

US 2007/0120320 A1 May 31, 2007

Related U.S. Application Data

(63) Continuation-in-part of application No. 11/064,314, filed on Feb. 23, 2005, now Pat. No. 7,533,885.

(60) Provisional application No. 60/547,643, filed on Feb. 23, 2004.

(51) Int. Cl.
*A63F 5/02* (2006.01)

(52) U.S. Cl. ..... 463/17; 273/274; 273/142 E

(58) Field of Classification Search ..... 273/274, 273/142 A, 142 B, 142 C, 142 D, 142 E, 273/142 F, 142 G, 142 H, 142 HA, 142 J, 273/142 JA, 142 JB, 142 JC, 142 JD; 463/17
See application file for complete search history.

(56) References Cited

U.S. PATENT DOCUMENTS

| | | | |
|---|---|---|---|
| 1,578,412 | A | 3/1926 | Ewig |
| 3,628,259 | A | 12/1971 | Kahn |
| 3,819,186 | A | 6/1974 | Hinterstocker |
| 4,077,631 | A | 3/1978 | Tela, Sr. |
| 4,156,976 | A | 6/1979 | Mikun |
| 4,198,052 | A | 4/1980 | Gauselmann |
| 4,222,561 | A | 9/1980 | Whitten |
| 4,260,159 | A | 4/1981 | Hoffman |
| 4,337,945 | A | 7/1982 | Levy |
| 4,448,419 | A | 5/1984 | Telnaes |
| 4,621,814 | A | 11/1986 | Stepan et al. |
| 4,624,459 | A | 11/1986 | Kaufman |
| 4,669,731 | A | 6/1987 | Clarke |
| 4,695,053 | A | 9/1987 | Vazquez, Jr. et al. |

(Continued)

FOREIGN PATENT DOCUMENTS

| | | |
|---|---|---|
| AU | B-13331/88 | 9/1988 |

(Continued)

OTHER PUBLICATIONS

International Search Report in Corresponding European Application EP 07120368, Mailed Jun. 11, 2008.

(Continued)

*Primary Examiner*—Benjamin H Layno
(74) *Attorney, Agent, or Firm*—K&L Gates LLP

(57) ABSTRACT

A gaming device including at least one wagering station and a rotor. The rotor supports a series of symbols arranged about a center. The rotor also supports a series of landings arranged adjacent to the series of symbols. In operation, at least one ball travels along the rotor and eventually reaches a landing. One or more of the elements of the gaming device has a designated shape, construction or function to enable designated operations of a primary game, a secondary outcome determiner or a combination thereof.

43 Claims, 37 Drawing Sheets

U.S. PATENT DOCUMENTS

| | | | |
|---|---|---|---|
| 4,732,386 | A | 3/1988 | Rayfiel |
| 4,805,907 | A | 2/1989 | Hagiwara |
| 4,836,546 | A | 6/1989 | DiRe et al. |
| 4,838,552 | A | 6/1989 | Hagiwara |
| 4,840,375 | A | 6/1989 | Lawlor et al. |
| 4,869,505 | A | 9/1989 | Manabe |
| 4,880,237 | A | 11/1989 | Kishishita |
| 4,906,005 | A | 3/1990 | Manabe |
| 4,941,665 | A | 7/1990 | Klamer |
| 4,989,873 | A | 2/1991 | Manabe |
| 4,989,878 | A | 2/1991 | Davies |
| 4,991,848 | A | 2/1991 | Greenwood et al. |
| 5,011,159 | A | 4/1991 | Fortunato et al. |
| 5,019,973 | A | 5/1991 | Wilcox et al. |
| 5,085,436 | A | 2/1992 | Bennett |
| 5,088,737 | A | 2/1992 | Frank et al. |
| 5,102,134 | A | 4/1992 | Smyth |
| 5,102,135 | A | 4/1992 | Addiechi |
| 5,116,055 | A | 5/1992 | Tracy |
| 5,123,649 | A | 6/1992 | Tiberio |
| 5,131,655 | A | 7/1992 | Ugawa |
| 5,167,413 | A | 12/1992 | Fulton |
| 5,184,821 | A | 2/1993 | Korenek |
| 5,197,736 | A | 3/1993 | Backus et al. |
| 5,224,706 | A | 7/1993 | Bridgeman et al. |
| 5,259,616 | A | 11/1993 | Bergmann |
| 5,294,120 | A | 3/1994 | Schultz |
| 5,294,128 | A | 3/1994 | Marquez |
| 5,308,065 | A | 5/1994 | Bridgeman et al. |
| 5,332,228 | A | 7/1994 | Schultz |
| 5,342,047 | A | 8/1994 | Heidel et al. |
| 5,344,144 | A | 9/1994 | Canon |
| 5,356,140 | A | 10/1994 | Dabrowski et al. |
| 5,375,830 | A | 12/1994 | Takemoto et al. |
| 5,377,973 | A | 1/1995 | Jones et al. |
| 5,393,057 | A | 2/1995 | Marnell, II |
| 5,393,061 | A | 2/1995 | Manship et al. |
| 5,397,125 | A | 3/1995 | Adams |
| 5,401,023 | A | 3/1995 | Wood |
| 5,405,143 | A | 4/1995 | Takemoto et al. |
| 5,407,200 | A | 4/1995 | Zalabak |
| 5,415,404 | A | 5/1995 | Joshi et al. |
| 5,423,539 | A | 6/1995 | Nagao |
| 5,431,408 | A | 7/1995 | Adams |
| 5,437,452 | A | 8/1995 | Graf et al. |
| 5,449,173 | A | 9/1995 | Thomas et al. |
| 5,489,101 | A | 2/1996 | Moody |
| 5,509,655 | A | 4/1996 | Ugawa |
| 5,511,781 | A | 4/1996 | Wood et al. |
| 5,531,448 | A | 7/1996 | Moody |
| 5,540,442 | A | 7/1996 | Orselli et al. |
| 5,542,669 | A | 8/1996 | Charron et al. |
| 5,553,851 | A | 9/1996 | Malavazos et al. |
| 5,560,603 | A | 10/1996 | Seelig et al. |
| 5,569,084 | A | 10/1996 | Nicastro et al. |
| 5,570,885 | A | 11/1996 | Ornstein |
| 5,580,055 | A | 12/1996 | Hagiwara |
| 5,584,486 | A | 12/1996 | Franklin |
| 5,584,763 | A | 12/1996 | Kelly et al. |
| 5,584,764 | A | 12/1996 | Inoue |
| 5,588,650 | A | 12/1996 | Eman et al. |
| 5,593,161 | A | 1/1997 | Boylan et al. |
| 5,611,535 | A | 3/1997 | Tiberio |
| 5,630,585 | A | 5/1997 | Takemoto et al. |
| 5,636,837 | A | 6/1997 | Takemoto et al. |
| 5,636,838 | A | 6/1997 | Caro |
| 5,639,089 | A | 6/1997 | Matsumoto et al. |
| 5,645,485 | A | 7/1997 | Clapper, Jr. |
| 5,647,798 | A | 7/1997 | Falciglia |
| 5,678,001 | A | 10/1997 | Nagel et al. |
| 5,707,285 | A | 1/1998 | Place et al. |
| 5,711,715 | A | 1/1998 | Ringo et al. |
| 5,718,431 | A | 2/1998 | Ornstein |
| 5,720,662 | A | 2/1998 | Holmes, Jr. et al. |
| 5,722,891 | A | 3/1998 | Inoue |
| 5,725,428 | A | 3/1998 | Achmüller |
| 5,732,950 | A | 3/1998 | Moody |
| 5,743,798 | A | 4/1998 | Adams et al. |
| 5,755,440 | A | 5/1998 | Sher |
| 5,766,074 | A | 6/1998 | Cannon et al. |
| 5,769,716 | A | 6/1998 | Saffari et al. |
| 5,770,533 | A | 6/1998 | Franchi |
| 5,772,506 | A | 6/1998 | Marks et al. |
| 5,772,509 | A | 6/1998 | Weiss |
| 5,775,692 | A | 7/1998 | Watts et al. |
| 5,788,573 | A | 8/1998 | Baerlocher et al. |
| 5,791,987 | A | 8/1998 | Chen et al. |
| 5,807,172 | A | 9/1998 | Piechowiak |
| 5,810,361 | A | 9/1998 | Kadlic |
| 5,816,916 | A | 10/1998 | Moody |
| 5,816,918 | A | 10/1998 | Kelly et al. |
| 5,817,172 | A | 10/1998 | Yamada et al. |
| 5,823,873 | A | 10/1998 | Moody |
| 5,823,874 | A | 10/1998 | Adams |
| 5,833,537 | A | 11/1998 | Barrie |
| 5,836,583 | A | 11/1998 | Towers |
| 5,848,932 | A | 12/1998 | Adams |
| 5,855,514 | A | 1/1999 | Kamille |
| 5,857,909 | A | 1/1999 | Rubin |
| 5,868,619 | A | 2/1999 | Wood et al. |
| 5,882,105 | A | 3/1999 | Barlow |
| 5,882,258 | A | 3/1999 | Kelly et al. |
| 5,882,261 | A | 3/1999 | Adams |
| 5,890,962 | A | 4/1999 | Takemoto |
| 5,902,184 | A | 5/1999 | Bennett |
| 5,910,048 | A | 6/1999 | Feinberg |
| 5,911,418 | A | 6/1999 | Adams |
| 5,918,880 | A | 7/1999 | Voigt, IV et al. |
| 5,934,672 | A | 8/1999 | Sines et al. |
| 5,934,999 | A | 8/1999 | Valdez |
| 5,935,002 | A | 8/1999 | Falciglia |
| 5,947,820 | A | 9/1999 | Morro et al. |
| 5,951,397 | A | 9/1999 | Dickinson |
| 5,954,335 | A | 9/1999 | Moody |
| 5,964,463 | A | 10/1999 | Moore, Jr. |
| 5,967,893 | A | 10/1999 | Lawrence et al. |
| 5,971,849 | A | 10/1999 | Falciglia |
| 5,976,016 | A | 11/1999 | Moody et al. |
| 5,980,384 | A | 11/1999 | Barrie |
| 5,984,310 | A | 11/1999 | English |
| 5,984,781 | A | 11/1999 | Sunaga |
| 5,988,638 | A | 11/1999 | Rodesch et al. |
| 5,993,316 | A | 11/1999 | Coyle et al. |
| 5,997,401 | A | 12/1999 | Crawford |
| 6,003,867 | A | 12/1999 | Rodesch et al. |
| 6,004,207 | A | 12/1999 | Wilson, Jr. et al. |
| 6,007,066 | A | 12/1999 | Moody |
| 6,007,424 | A | 12/1999 | Evers et al. |
| 6,012,720 | A | 1/2000 | Webb |
| 6,012,981 | A | 1/2000 | Fujioka et al. |
| 6,012,982 | A | 1/2000 | Piechowiak et al. |
| 6,012,983 | A | 1/2000 | Walker et al. |
| 6,032,955 | A | 3/2000 | Luciano et al. |
| 6,033,307 | A | 3/2000 | Vancura |
| 6,047,963 | A | 4/2000 | Pierce et al. |
| 6,053,823 | A | 4/2000 | Mathews |
| 6,056,642 | A | 5/2000 | Bennett |
| 6,059,289 | A | 5/2000 | Vancura |
| 6,059,658 | A | 5/2000 | Mangano et al. |
| 6,059,659 | A | 5/2000 | Busch et al. |
| 6,062,980 | A | 5/2000 | Luciano |
| 6,062,981 | A | 5/2000 | Luciano, Jr. |
| 6,071,192 | A | 6/2000 | Weiss |
| 6,083,105 | A | 7/2000 | Ronin et al. |

6,089,977 A 7/2000 Bennett
6,089,978 A 7/2000 Adams
6,089,980 A 7/2000 Gauselmann
6,093,101 A 7/2000 Mourad
6,093,102 A 7/2000 Bennett
6,098,985 A 8/2000 Moody
6,102,400 A 8/2000 Scott et al.
6,102,402 A 8/2000 Scott et al.
6,105,962 A 8/2000 Malavazos et al.
6,110,041 A 8/2000 Walker et al.
6,113,098 A 9/2000 Adams
6,120,031 A 9/2000 Adams
6,120,378 A 9/2000 Moody et al.
6,126,165 A 10/2000 Sakamoto
6,126,541 A 10/2000 Fuchs
6,126,542 A 10/2000 Fier
6,129,632 A 10/2000 Luciano
6,132,311 A 10/2000 Williams
6,135,884 A 10/2000 Hedrick et al.
6,142,872 A 11/2000 Walker et al.
6,142,873 A 11/2000 Weiss et al.
6,142,874 A 11/2000 Kodachi et al.
6,142,875 A 11/2000 Kodachi et al.
6,149,521 A 11/2000 Sanduski
6,155,925 A 12/2000 Giobbi et al.
6,158,741 A 12/2000 Koelling
6,159,095 A 12/2000 Frohm et al.
6,159,096 A 12/2000 Yoseloff
6,159,097 A 12/2000 Gura
6,159,098 A 12/2000 Slomiany et al.
6,162,121 A 12/2000 Morro et al.
6,168,520 B1 1/2001 Baerlocher et al.
6,168,522 B1 1/2001 Walker et al.
6,168,523 B1 1/2001 Piechowiak et al.
6,173,955 B1 1/2001 Perrie et al.
6,174,233 B1 1/2001 Sunaga et al.
6,174,235 B1 1/2001 Walker et al.
6,179,711 B1 1/2001 Yoseloff
6,186,894 B1 2/2001 Mayeroff
6,190,254 B1 2/2001 Bennett
6,190,255 B1 2/2001 Thomas et al.
6,193,606 B1 2/2001 Walker et al.
6,196,547 B1 3/2001 Pascal et al.
6,203,009 B1 3/2001 Sines et al.
6,203,429 B1 3/2001 Demar et al.
6,209,869 B1 4/2001 Mathews
6,210,277 B1 4/2001 Stefan
6,217,022 B1 4/2001 Astaneha
6,217,448 B1 4/2001 Olsen
6,220,959 B1 4/2001 Holmes, Jr. et al.
6,224,482 B1 5/2001 Bennett
6,224,483 B1 5/2001 Mayeroff
6,224,484 B1 5/2001 Okuda et al.
6,227,542 B1 * 5/2001 Cosmi ..... 273/142 E
6,227,969 B1 5/2001 Yoseloff
6,227,971 B1 5/2001 Weiss
6,231,442 B1 5/2001 Mayeroff
6,231,445 B1 5/2001 Acres
6,234,897 B1 5/2001 Frohm et al.
6,238,287 B1 5/2001 Komori et al.
6,244,957 B1 6/2001 Walker et al.
6,251,013 B1 6/2001 Bennett
6,254,482 B1 7/2001 Walker et al.
6,264,200 B1 7/2001 Smith
6,270,409 B1 8/2001 Shuster
6,270,411 B1 8/2001 Gura et al.
6,290,600 B1 9/2001 Glasson
6,299,165 B1 10/2001 Nagano
6,299,170 B1 10/2001 Yoseloff
6,302,398 B1 10/2001 Vecchio
6,302,790 B1 10/2001 Brossard
6,302,791 B1 10/2001 Frohm et al.
6,305,686 B1 10/2001 Perrie et al.
6,309,299 B1 10/2001 Weiss
6,311,976 B1 11/2001 Yoseloff et al.
6,312,331 B1 11/2001 Tamaki
6,312,334 B1 11/2001 Yoseloff
6,315,660 B1 11/2001 DeMar et al.
6,315,662 B1 11/2001 Jorasch et al.
6,315,663 B1 11/2001 Sakamoto
6,319,124 B1 11/2001 Baerlocher et al.
6,322,078 B1 11/2001 Adams
6,336,860 B1 1/2002 Webb
6,336,862 B1 1/2002 Byrne
6,336,863 B1 1/2002 Baerlocher et al.
6,340,158 B2 1/2002 Pierce et al.
6,352,260 B1 3/2002 Santiago
6,358,144 B1 3/2002 Kaddlic et al.
6,358,147 B1 3/2002 Jaffe et al.
6,364,314 B1 4/2002 Canterbury
6,364,768 B1 4/2002 Acres et al.
6,368,214 B1 4/2002 Luciano
6,371,853 B1 4/2002 Borta
6,375,569 B1 4/2002 Acres
6,375,570 B1 4/2002 Poole
6,390,470 B1 5/2002 Huang
6,394,902 B1 5/2002 Glavich et al.
6,398,218 B1 6/2002 Vancura
6,398,220 B1 6/2002 Inoue
6,398,644 B1 6/2002 Perrie et al.
6,409,602 B1 6/2002 Wiltshire et al.
6,413,162 B1 7/2002 Baerlocher et al.
6,413,163 B1 7/2002 Yamauchi et al.
6,419,579 B1 7/2002 Bennett
6,428,412 B1 8/2002 Anderson et al.
6,435,968 B1 8/2002 Torango
6,439,943 B1 8/2002 Aoki et al.
6,439,993 B1 8/2002 O'Halloran
6,439,995 B1 8/2002 Hughs-Baird et al.
6,443,452 B1 9/2002 Brune
6,443,456 B1 9/2002 Gajor
6,446,965 B1 9/2002 Boulton
6,450,884 B1 9/2002 Seelig et al.
6,454,266 B1 9/2002 Breeding et al.
6,461,241 B1 10/2002 Webb et al.
6,467,770 B1 10/2002 Matosevic
6,471,208 B2 10/2002 Yoseloff et al.
6,481,713 B2 11/2002 Perrie et al.
6,491,584 B2 12/2002 Graham et al.
6,494,454 B2 12/2002 Adams
6,497,409 B2 12/2002 Mathews
6,520,503 B1 2/2003 Porto
6,520,854 B1 2/2003 McNally
6,537,150 B1 3/2003 Luciano et al.
6,537,152 B2 3/2003 Seelig et al.
6,561,512 B2 5/2003 Luciano et al.
6,561,904 B2 5/2003 Locke et al.
6,565,436 B1 5/2003 Baerlocher
6,569,013 B1 5/2003 Taylor
6,575,834 B1 6/2003 Lindo
6,599,193 B2 7/2003 Baerlocher et al.
6,602,137 B2 8/2003 Kaminkow et al.
6,604,740 B1 8/2003 Singer et al.
6,609,969 B1 8/2003 Luciano et al.
6,609,970 B1 8/2003 Juciano, Jr.
6,612,927 B1 9/2003 Slomiany et al.
6,616,142 B2 9/2003 Adams
6,632,139 B1 10/2003 Baerlocher
6,632,140 B2 10/2003 Berman et al.
6,634,942 B2 10/2003 Walker et al.
6,634,945 B2 10/2003 Glavich et al.
6,652,378 B2 11/2003 Cannon et al.
6,656,043 B2 12/2003 Seelig et al.
6,659,462 B1 12/2003 Scott
6,663,106 B1 12/2003 Cosmi
6,666,766 B2 12/2003 Baerlocher et al.

6,682,073 B2 1/2004 Bryant et al.
6,695,696 B1 2/2004 Kaminkow
6,712,693 B1 3/2004 Hettinger
6,712,694 B1 3/2004 Nordman
6,712,695 B2 3/2004 Mothwurf et al.
6,726,563 B1 4/2004 Baerlocher et al.
6,733,389 B2 5/2004 Webb et al.
6,739,970 B2 5/2004 Luciano
6,758,749 B2 7/2004 Krintzman
6,764,396 B2 7/2004 Seelig et al.
6,786,824 B2 9/2004 Cannon
6,802,778 B1 10/2004 Lemay et al.
6,805,349 B2 10/2004 Baerlocher et al.
6,857,957 B2 2/2005 Marks et al.
6,869,359 B1 3/2005 Mathews
6,869,360 B2 3/2005 Marks et al.
6,878,061 B2 4/2005 Baerlocher
6,884,167 B2 4/2005 Walker et al.
6,890,255 B2 5/2005 Jarvis et al.
6,905,406 B2 6/2005 Kaminkow et al.
6,913,532 B2 7/2005 Baerlocher et al.
6,921,072 B2 7/2005 Hughes-Watts
6,921,335 B2 7/2005 Rodgers et al.
6,923,720 B2 8/2005 Loose
6,926,607 B2 8/2005 Slomiany et al.
6,929,952 B2 8/2005 Baerlocher
6,960,133 B1 11/2005 Marks et al.
6,988,731 B2 1/2006 Inoue
6,991,544 B2 1/2006 Soltys et al.
7,001,274 B2 2/2006 Baerlocher et al.
7,008,324 B1 3/2006 Johnson et al.
7,014,560 B2 3/2006 Glavich et al.
7,029,395 B1 4/2006 Baerlocher
7,052,395 B2 5/2006 Glavich et al.
7,066,814 B2 6/2006 Glavich et al.
7,094,150 B2 8/2006 Ungaro et al.
7,121,943 B2 10/2006 Webb et al.
7,169,044 B2 1/2007 Baerlocher et al.
7,204,488 B2 4/2007 Ilievski
RE39,659 E 5/2007 Luciano et al.
7,216,867 B1 5/2007 Luciano et al.
7,258,609 B2 8/2007 Nordman et al.
2001/0003709 A1 6/2001 Adams
2001/0005690 A1 6/2001 Boulton
2001/0009865 A1 7/2001 Demar et al.
2001/0015525 A1 8/2001 Mathews
2001/0018361 A1 8/2001 Acres
2001/0022429 A1 9/2001 Luciano et al.
2001/0023199 A1 9/2001 Walker et al.
2001/0038178 A1 11/2001 Vancura
2002/0010014 A1 1/2002 Parra et al.
2002/0010017 A1 1/2002 Bennett
2002/0052233 A1 5/2002 Gauselmann
2002/0086725 A1 7/2002 Fasbender et al.
2002/0137559 A1 9/2002 Baerlocher
2002/0165023 A1 11/2002 Brosnan et al.
2002/0167126 A1 11/2002 De Raedt et al.
2002/0169017 A1 11/2002 Visoenik
2002/0187827 A1 12/2002 Blankstein
2002/0193160 A1 12/2002 Tarantino
2003/0027623 A1 2/2003 Rose
2003/0050110 A1 3/2003 Wichinsky
2003/0054873 A1 3/2003 Peterson
2003/0060266 A1 3/2003 Baerlocher
2003/0060269 A1 3/2003 Paulsen et al.
2003/0060272 A1 3/2003 Glavich et al.
2003/0060281 A1 3/2003 Vancura
2003/0069062 A1 4/2003 Shimizu
2003/0069063 A1 4/2003 Bilyeu et al.
2003/0073483 A1 4/2003 Glavich et al.
2003/0092480 A1 5/2003 White et al.
2003/0092490 A1 5/2003 Gauselmann
2003/0094752 A1 5/2003 Mathews
2003/0098543 A1 5/2003 Porto
2003/0153383 A1 8/2003 Baerlocher et al.
2003/0155708 A1 8/2003 Perrie et al.
2003/0162585 A1 8/2003 Bigelow et al.
2003/0195031 A1 10/2003 O'Donovan et al.
2003/0203753 A1 10/2003 Muir et al.
2003/0207713 A1 11/2003 Taylor
2003/0216165 A1 11/2003 Singer et al.
2003/0232651 A1 12/2003 Huard et al.
2004/0002372 A1 1/2004 Rodgers et al.
2004/0017043 A1 1/2004 Moody
2004/0038731 A1 2/2004 Englman
2004/0048650 A1 3/2004 Mierau et al.
2004/0048652 A1 3/2004 Ching et al.
2004/0053666 A1 3/2004 Vancura
2004/0053669 A1 3/2004 Gerrard et al.
2004/0053672 A1 3/2004 Baerlocher
2004/0061285 A1 4/2004 Hughes-Watts
2004/0063493 A1 4/2004 Baerlocher
2004/0072609 A1 4/2004 Ungaro et al.
2004/0072612 A1 4/2004 Rodgers et al.
2004/0077398 A1 4/2004 Jarvis et al.
2004/0102244 A1 5/2004 Kryuchkov et al.
2004/0116177 A1 6/2004 Frost et al.
2004/0137982 A1 7/2004 Cuddy et al.
2004/0147306 A1 7/2004 Randall et al.
2004/0152500 A1 8/2004 Baerlocher
2004/0159590 A1 8/2004 Mothwurf
2004/0162129 A1 8/2004 Nelson
2004/0162130 A1 8/2004 Walker et al.
2004/0176156 A1 9/2004 Walker et al.
2004/0212150 A1 10/2004 Huard et al.
2004/0219969 A1 11/2004 Casey et al.
2004/0242302 A1 12/2004 Baerlocher
2004/0242315 A1 12/2004 Paulsen et al.
2004/0251624 A1 12/2004 Hodapp et al.
2004/0254011 A1 12/2004 Muskin
2004/0256804 A1 12/2004 Huard et al.
2004/0266510 A1 12/2004 Kojima
2004/0266512 A1 12/2004 Kaminkow
2004/0266516 A1 12/2004 Thomas
2004/0266517 A1 12/2004 Bleich et al.
2005/0014550 A1 1/2005 Rhoten
2005/0020346 A1 1/2005 Baerlocher
2005/0029745 A1 2/2005 Walker et al.
2005/0037838 A1 2/2005 Dunaevsky et al.
2005/0049035 A1 3/2005 Baerlocher et al.
2005/0054429 A1 3/2005 Baerlocher et al.
2005/0059481 A1 3/2005 Joshi et al.
2005/0060050 A1 3/2005 Baerlocher
2005/0070354 A1 3/2005 Baerlocher et al.
2005/0075163 A1 4/2005 Cuddy et al.
2005/0079911 A1 4/2005 Nakatsu
2005/0090306 A1 4/2005 Seelig et al.
2005/0130737 A1 6/2005 Englman et al.
2005/0176494 A1 8/2005 Thomas
2005/0192076 A1 9/2005 Lowery
2005/0192079 A1 9/2005 Lowery
2005/0215307 A1 9/2005 Jarvis et al.
2005/0215311 A1 9/2005 Hornik et al.
2005/0218590 A1 10/2005 O'Halloran et al.
2005/0233796 A1 10/2005 Baerlocher et al.
2005/0233801 A1 10/2005 Baerlocher et al.
2005/0233803 A1 10/2005 Yang
2005/0255904 A1 11/2005 Duhamel
2005/0282615 A1 12/2005 Englman et al.
2005/0282629 A1 12/2005 Gagner
2005/0285336 A1 12/2005 Ilievski
2005/0285337 A1 12/2005 Durham et al.
2006/0003834 A1 1/2006 Okada
2006/0009283 A1 1/2006 Englman et al.
2006/0009286 A1 1/2006 Durham et al.
2006/0014580 A1 1/2006 Hawthorn

| | | | |
|---|---|---|---|
| 2006/0019744 | A1 | 1/2006 | Roemer |
| 2006/0025193 | A1 | 2/2006 | Gail et al. |
| 2006/0025211 | A1 | 2/2006 | Wilday et al. |
| 2006/0046833 | A1 | 3/2006 | Hatakeyama et al. |
| 2006/0066044 | A1 | 3/2006 | Dabosh |
| 2006/0069619 | A1 | 3/2006 | Walker et al. |
| 2006/0073873 | A1 | 4/2006 | Rodgers et al. |
| 2006/0073897 | A1 | 4/2006 | Englman et al. |
| 2006/0094495 | A1 | 5/2006 | Gelber et al. |
| 2006/0157927 | A1 | 7/2006 | O'Halloran et al. |
| 2006/0157928 | A1 | 7/2006 | O'Halloran et al. |
| 2006/0170154 | A1 | 8/2006 | Matsuno et al. |
| 2006/0170155 | A1 | 8/2006 | Silverman |
| 2006/0178191 | A1 | 8/2006 | Ellis |
| 2006/0205480 | A1 | 9/2006 | Glavich et al. |
| 2006/0217174 | A1 | 9/2006 | Walker et al. |
| 2006/0237905 | A1 | 10/2006 | Nicely et al. |
| 2006/0246989 | A1 | 11/2006 | Glavich et al. |
| 2006/0249899 | A1 | 11/2006 | Lease |
| 2006/0287034 | A1 | 12/2006 | Englman et al. |
| 2006/0287053 | A1 | 12/2006 | Yokota |
| 2007/0021182 | A1 | 1/2007 | Gauselmann |
| 2007/0057452 | A1 | 3/2007 | Dargue |
| 2007/0060262 | A1 | 3/2007 | Kosaka et al. |
| 2007/0060292 | A1 | 3/2007 | Peterson |
| 2007/0069459 | A1 | 3/2007 | Vidondo |
| 2007/0075488 | A1 | 4/2007 | Pececnik |
| 2007/0135203 | A1 | 6/2007 | Nicely |

FOREIGN PATENT DOCUMENTS

| | | |
|---|---|---|
| AU | PO7780 | 7/1997 |
| AU | 199717601 B2 | 9/1997 |
| AU | 199917318 | 9/1999 |
| AU | 200245837 | 12/2002 |
| DE | 3105266 | 9/1982 |
| DE | 3716849 | 12/1988 |
| DE | 19600787 | 5/1997 |
| DE | 19613455 | 8/1997 |
| DE | 19936196 | 1/2001 |
| EP | 60 019 | 9/1982 |
| EP | 0 558 307 | 2/1993 |
| EP | 0 753 331 | 1/1997 |
| EP | 0 874 337 | 10/1998 |
| EP | 0 926 645 | 6/1999 |
| EP | 0 945 837 | 9/1999 |
| EP | 0 981 119 | 2/2000 |
| EP | 0 984 407 | 3/2000 |
| EP | 0 984 408 | 3/2000 |
| EP | 0 989 531 | 3/2000 |
| EP | 1 076 321 | 2/2001 |
| EP | 1 195 730 | 4/2002 |
| EP | 1 226 851 | 7/2002 |
| EP | 1 536 388 | 1/2005 |
| EP | 1 513 114 | 3/2005 |
| EP | 1 513 116 | 3/2005 |
| EP | 1 513 117 | 3/2005 |
| EP | 1 580 701 | 3/2005 |
| EP | 1 589 501 | 10/2005 |
| EP | 1 671 684 | 6/2006 |
| EP | 1 710 000 | 10/2006 |
| EP | 1 721 642 | 11/2006 |
| EP | 1 736 215 | 12/2006 |
| EP | 1 769 828 | 4/2007 |
| GB | 970806 | 9/1964 |
| GB | 2 101 380 | 1/1983 |
| GB | 2 137 392 | 10/1984 |
| GB | 2 262 642 | 6/1993 |
| GB | 2 292 245 | 2/1996 |
| GB | 2 322 217 | 8/1998 |
| GB | 2 354 179 | 3/2001 |
| GB | 2358591 | 8/2001 |
| GB | 2 371 494 | 7/2002 |
| GB | 2 382 911 | 6/2003 |
| GB | 2 387 950 | 10/2003 |
| GB | 2395139 | 5/2004 |
| GB | 2 431 362 | 4/2007 |
| WO | WO 85/00910 | 2/1985 |
| WO | WO 97/32285 | 9/1997 |
| WO | 199738766 | 10/1997 |
| WO | WO 98/00207 | 1/1998 |
| WO | WO 99/03078 | 1/1999 |
| WO | WO 00/32286 | 6/2000 |
| WO | WO 00/33269 | 6/2000 |
| WO | WO 00/66235 | 11/2000 |
| WO | WO 00/76606 | 12/2000 |
| WO | WO 01/26019 | 4/2001 |
| WO | WO 02/056984 | 7/2002 |
| WO | WO 02/078804 | 10/2002 |
| WO | WO 03/026757 | 4/2003 |
| WO | WO 04/023400 | 3/2004 |
| WO | WO 04/025584 | 3/2004 |
| WO | WO 05/077480 | 8/2005 |
| WO | WO 05/083599 | 9/2005 |
| WO | WO 06/015442 | 2/2006 |
| WO | WO 06/017431 | 2/2006 |
| WO | WO 06/061616 | 6/2006 |
| WO | WO 06/078219 | 7/2006 |
| WO | WO 06/094398 | 9/2006 |
| WO | WO 06/097007 | 9/2006 |
| WO | WO 07/024202 | 3/2007 |
| WO | WO 07/033430 | 3/2007 |
| WO | WO 07/077449 | 7/2007 |
| WO | WO 07/080421 | 7/2007 |

OTHER PUBLICATIONS

"A Salute to Game Shows," The Price is Right—Pricing Games, printed from schuminweb.com/game-shows/shows/price-is-right/pricing-games.htm on Mar. 16, 2001.

3RV—Jackpot Party Advertisement written by WMS Gaming, Inc., published Aug. 8, 2002.

Alfastreet D8 description, Alfa street Gaming Instruments, available on or before Nov. 13, 2006.

Alfastreet M8 description, Alfa street Gaming Instruments, available on or before Nov. 13, 2006.

Big Times Red, White & Blue Advertisement written by IGT published in 2005.

Black Swan Paytable Display written by IGT, published prior to 2001.

Bonus Games Advertisement written by IGT, published in 1999.

Boot Scootin Article written by Strictly Slots/Aristocrat Leisure Industries, PTY Ltd., published prior to Jul. 2002.

Break the Spell Advertisement written by Atronic Casino Technology, Ltd., published in 1999.

Break the Spell Article written by Strictly Slots/Atronic Casino Technology, Ltd., published in Sep. 2000.

Break the Spell Atronic Web Page, published in Jan. 2001.

Bunco History and Rules, printed from http://world-bunco.com/history.html on May 22, 2000.

Cash Chameleon Article written by Strictly Slots/Aristocrat Leisure Industries, PTY Ltd., published in Apr. 2001.

Catch A Wave Advertisement written by IGT, published in Dec. 2000.

Cossack Dancer Advertisement written by Olympic Video Gaming, published prior to 2002.

Creepy and Kooky written by Frank Legato, published by Strictly Slots in Jul. 2000, pp. 52-54.

Description of Symbol Feature in Australian UFO Gaming Machine written by Barcrest Ltd., published in 1995.

Dolphin Treasure Advertisement written by Aristocrat Leisure Industries Pty., Ltd., published in 1996.

Double Diamond Line Advertisement written by Bally Gaming Systems, published in 2000.

Elvis Brochure written by IGT, published in 1999.

Enchanted Forest™ Gaming Description from Aristocrat, available in 1994.

Enchanted Unicorn Advertisement written by IGT, published in 2001.
European Search Report from EP Patent Application EP 03 813 403.7, published May 4, 2007.
Family Feud Bullseye advertisement, printed from www.igtonline.com/megajackpots/new_games/family_feud_bullseye_slots.html on Mar. 2, 2005 and available in 2003.
Field Testing New Slots Article, written by Strictly Slots, published in Jul. 2000.
Fishin' Buddies Article published in Strictly Slots/Anchor Games, published in Apr. 2001.
Frog Prince article written by International Game Technology, published in 2001.
Happy Camper Advertisement written by IGT, published in 2001.
Introducing the "Smiling Ape" Machine Advertisement (including Joker's Wild Poker description) written by IGT, published prior to 2001.
Jackpot Party Advertisement on website page http://www.wmsgaming.com/products/slot/jpp/index.html, printed on Mar. 21, 2001.
Jackpot Party Brochures and Articles written by Wmsms Gaming, Inc., published in Mar. 1998.
Jackpot Party Video 9-Line Advertisement written by WMS Gaming, Inc., available prior to Feb. 23, 2004.
Jeopardy Advertisement written by IGT, published in 2000.
Jeopardy Video Slots advertisement written by IGT, published in 2000.
Jeopardy, MegaJackpots Advertisement written by IGT, published in 1998.
Joker's Wild Advertisement written by IGT, published prior to 2001.
Little Devils Brochure, written by IGT, published in 1998.
Little Green Men, Jr. Advertisement written by A.C. Coin and Slot Services Company, published prior to 2002.
Loco Loot Article written by Strictly Slots/Aristocrat Leisure Industries, PTY Ltd., published in May 2002.
Megastar Family description, Aristocrat Technologies, Inc., available on or before Feb. 23, 2004.
Monopoly Blackjack Edition Game described in Mikohn brochure, published in 2000.
Mountain Money Article written by Strictly Slots/Aristocrat Leisure Industries, PTY Ltd., published in Jun. 2002.
Multi-Action Blackjack brochure, http://conjelco.com/faq/bj.html from Apr. 25, 2001, printed on Jul. 30, 2001.
Multi-Play Poker by Bally Gaming, described in Strictly Slots, published in Dec. 2000.
On the House Advertisement written by Olympic Video Gaming, published prior to 2002.
Penguin Pays Advertisement written by Aristocrat Incorporated, published in 1998.
Pick a Prize Brochure written by Acres Gaming Incorporated, published prior 2001.
Play It Again Poker Brochure, written by IGT, published in 1999.
Power Slotto Brochure published by AC Coin & Slot in or before Dec. 2002.
Reel Magic™ Gaming Machine Description written by IGT, available in 1986.
Slotopoly Brochure, written by IGT, published in 1998.
Slots 2003 Article written by Melissa Raimondi, published in Jan. 2003.
Spin Til You Win Game Description written by IGT, published in 1996.
Super Bonus Poker by Bally Gaming, described in Strictly Slots, published in Apr. 2000.
Super Times Pay Poker Advertisement, written by IGT, published in 2003.
Sure to Beat the Bank, article located on the web at http://query.nytimes.com/mem/archive-free/pdf?r=1 &res=9501E3DB1E3EEF33A25755C2A9679C94679FD7CF &oref=slogin, The New York Times, published Jan. 1886.
The Basics of Winning Video Poker (Chapter VI Deuces Wild & Chapter VII Jokers Wild) written by J. Edward Allen, published in 1990.
The Latest Buzz Article written by Bally Gaming Systems, published in Fall 2000.
Top Dollar Brochure, written by IGT, published in 1998.
Totem Pole Advertisement, written by IGT, published in 1997, in or before December thereof.
Tropical Fever Glass, written by IGT, published prior to Apr. 2001.
Turboreel by Barcrest (with English Translation), available in 2005.
We Make Gaming Fun! Advertisement written by WMS Gaming Inc., available prior to Feb. 23, 2004.
Wheel of Fortune Special Edition Classic Spin Video Slots, written by IGT, published before Sep. 30, 2004.
Wheel of Madness Game, described in AC Coin & Slot brochure, published in 2000.
Wheel Spins Bonus (Video Wheel of Fortune) article written by IGT, published before Sep. 30, 2004.
Wild Bear Salmon Run Advertisement written by IGT, published in 2003.
Wild Streak Advertisement written by WMS Gaming, Inc., published in Strictly Slots Mar. 2001.
Winning Streak Brochure, written by Aristocrat, published in 1994.
Your Real Key to Gaming Success Advertisement (including Roll Over Beethoven and Wild Fortune) written by Olympic Video Gaming, published prior to Feb. 23, 2004.
"Letter from Mr. McClarnon regarding disclosure of U.S. Patent No. 6,409,602; dated May 10, 2008".
Double Roulette Wheel Excerpt, Loose Change Magazine, Oct. 1993, p. 26.
American Bandstand Brochure written by Anchor Games, published in 2001, in or before Dec. thereof.
Animator, [online] [printed on Nov. 8, 2006]. Retrieved from the Internet at <URL:http://www.tcsjohnhuxley.com.au/products/displays/animator.htm>.
Blurring the Green-Felt Line, written by International Gaming & Wagering Business, published in Jan. 2003.
Bonus Roulette Brochure written by R. Franco, available prior to Nov. 10, 2006.
Buck's Roulette Brochure written by R. Franco, available prior to Nov. 10, 2006.
Classic Pot of Gold Brochure written by Ace Coin Equipment Ltd., available prior to Nov. 10, 2006.
Cyberdyne Gaming Brochure written by Cyberdyne Gaming, available prior to Nov. 10, 2006.
e-FX Roulette Display, [online] [printed on Nov. 8, 2006]. Retrieved from the Internet at <URL:file://C:\DOCUME~1\rys\LOCALS~1\Temp\S4M2B8E0.htm>.
Elvis Hits Advertisement written by IGT, published in 1999, in or before December thereof.
Fully Automated Wheel, [oneline] [printed on Nov. 1, 2006]. Retrieved from the Internet at <URL:http://www.nrcgamingsystems.com/our_products.asp>.
Live Random Dice Machines, written by General Automatic Amusement, available prior to Nov. 10, 2006.
Lucky Dolls, written by Strictly Slots, published in May 2002.
LuminAR (Illuminated Roulette), [online] [printed on Oct. 31, 2006]. Retrieved from the Internet at <URL:http://www.tcsjohnhuxley.com.au/products/roulette/luminar.htm>.
Mark VII Wheel, [online] [printed on Oct. 31, 2006]. Retrieved from the Internet at <URL:http://www.tcsjohnhuxley.com.au/products/roulette/roulettewheels/markvii.htm>.
Mauritian Roulette from Ultimate Success Gaming, [online] [printed on Oct. 31, 2006]. Retrieved from the Internet at <URL:http://www.gamingfloor.com/features/usg/MagicR.htm>.
Mistress of the Dark™ Advertisement written by IGT, published in 2002, in or before December thereof.
Monte Carlo advertisement, written by Bally Gaming, Inc., published in 2002, in or before December thereof.
Odds on Gaming™, Inc. brochure, published by Odds on Gaming, available prior to Nov. 10, 2006.
Pick a Prize Brochure written by Acres Gaming Incorporated, published prior to 2001, in or before December thereof.
R&B™ Brochure published by AC Coin & Slot, available prior to Nov. 10, 2006.
Rapid Roulette™ written by John Huxley Ltd., published in 2002, in or before December thereof.

Rapid Roulette written by ShuffleMaster™ Incorporated in 2005, in or before December thereof.
Roulette Grand Jeu brochure, written by Amatic Industries, available prior to Nov. 10, 2006.
Roulette written by Atronic Casino Technology, published in 1999, in or before December thereof.
Roulette Wheel Analysis, [online] [printed on Oct. 31, 2006]. Retrieved from the Internet at <URL:http://www.tcsjohnhuxley.com.au/products/roulette/roulettewheelanalysis.htm>.
Roulette Wheels catalog, published by Gaming Partners International SAS, available prior to Nov. 10, 2006.
Royal Roulette advertisement written by Barcrest Games, available prior to Nov. 10, 2006.
Royal Roulette Brochure written by Impulse Gaming Ltd., available prior to Nov. 10, 2006.
Saturn Data Logger, [online] [printed on Oct. 31, 2006]. Retrieved from the Internet at <URL:http://www.tcsjohnhuxley.com.au/products/roulette/santurndatalogger.htm>.
Saturn Wheel, [online] [printed on Oct. 31, 2006]. Retrieved from the Internet at <URL:http://www.tcsjohnhuxley.com.au/products/roulettewheels/saturn.htm>.
Silver City Roundup Brochure published by AC Coin & Slot, available prior to Nov. 10, 2006.
Slot Machine Buyer's Handbook, A Consumer's Guide to Slot Machines written by David L. Saul and Daniel R. Mead, published in 1998, in or before December thereof.
Slot Machines and Coin-Op Games written by Bill Kurtz, published in 1997, in or before December thereof.
Slot Machines on Parade, 1st edition written by Robert N. Geddes and illustrated by Daniel R. Mead, published in 1980, in or before December thereof.
Slot Machines written by Marshall Fey, published in 1983, 1989, 1991, 1994, 1997, in or before December thereof.
Starburst Wheel, [online] [printed on Oct. 31, 2006]. Retrieved from the Internet at <URL:http://www.tcsjohnhuxley.com.au/products/roulette/roulettewheels/starburst.htm>.
Take Your Pick Article written by Strictly Slots, published in Mar. 2001.
Technique of Victory, written by Odrex, available prior to Nov. 10, 2006.

* cited by examiner

| EXAMPLE FORMULA |
|---|
| S = 360/(T + (X% OF N)) |
| ARC LENGTH OF EACH GAME LANDING = S |
| ARC LENGTH OF EACH BONUS LANDING = S + (X% OF S) |
| T: TOTAL NUMBER OF LANDINGS FIXED FOR GAME |
| X: DESIRED MULTIPLIER TO INCREASE OR DECREASE SIZE OFBONUS LANDINGS RELATIVE TO SIZE OF GAME LANDINGS |
| N: DESIRED QUANTITY OF BONUS LANDINGS |

FIG. 11

| EXAMPLE LANDING CONFIGURATION | |
|---|---|
| LANDING | ARC LENGTH |
| EIGHTEEN RED LANDINGS | 9 PER LANDING = 162 |
| EIGHTEEN BLACK LANDINGS | 9 PER LANDING = 162 |
| ONE GREEN ZERO LANDING | 9 PER LANDING = 9 |
| ONE GREEN DOUBLE ZERO LANDING | 9 PER LANDING = 9 |
| BONUS LANDING B | 9 PER LANDING = 9 |
| BONUS LANDING B | 9 PER LANDING = 9 |
| | TOTAL: 360 |

FIG. 12

GAMING DEVICE HAVING A WHEEL-BASED GAME

PRIORITY CLAIM

This application is a continuation-in-part application of U.S. patent application Ser. No. 11/064,314, filed on Feb. 23, 2005, which claims priority to U.S. Patent Application Ser. No. 60/547,643 filed on Feb. 23, 2004, each of which is hereby incorporated by reference in its entirety.

CROSS REFERENCE TO RELATED APPLICATIONS

This application is related to the following commonly-owned co-pending patent applications: U.S. patent application, Ser. No. 11/119,997 filed on May 2, 2005; U.S. patent application, Ser. No. 11/609,149 filed on Dec. 11, 2006; U.S. patent application, Ser. No. 11/609,173 filed on Dec. 11, 2006.

BACKGROUND

There are a variety of games to play in casinos and other gaming environments. Roulette is one commonly known game which includes a moving wheel and a ball which travels along the moving wheel. Depending upon where the ball stops, the player may win or lose a bet. There is a need to increase the level of interest, excitement and volatility associated with playing roulette-related games. There is also a need to enhance the operational functionality of roulette-related games or otherwise provide improvements to, and interesting variations of, roulette-related games.

SUMMARY

The gaming device, in one embodiment, involves a spinning wheel and a wagering station operable for play of a primary wheel game. Several players can simultaneously place bets using the wagering station. The betting options of the wager station enable the players to bet on where a ball will land on the wheel. Once the bets are placed, a dealer, human or computer, spins the rotor of the wheel in one direction. Then the dealer launches a ball onto the rotor, typically in the opposite direction. The rotor has a ring of pockets or landings. The bet outcomes for the primary wheel game are based on which landing is the stopping place or receiver for the ball.

In one embodiment, the wheel includes one or more bonus or secondary landings. Depending upon the embodiment, these secondary landings can have a plurality of different shapes, sizes and configurations. In one embodiment, a bonus sequence begins when a ball lands on a secondary landing. It should be appreciated that other events in the primary wheel game can trigger a bonus sequence.

In one embodiment, the bonus sequence is implemented by a bonus device which has an secondary outcome determiner. Depending upon the embodiment, the bonus device may be incorporated into the wheel or coupled to the wheel from a distance. In one embodiment, the gaming device includes a drop indicator operable to indicate information pertaining to any balls which have dropped through openings in the landings.

Among the other embodiments described below, in one embodiment, a randomizing device selects the ball which is to be used in the game. In another embodiment, a randomizing device selects and identifies which landing is to be associated with a bonus trigger. In one embodiment, a device on the bowl of the wheel, such as a pointer or flipper, indicates or triggers a secondary outcome when the ball stops at a landing within a certain proximity of such device.

Additional features and advantages are described herein, and will be apparent from, the following Detailed Description and the figures.

BRIEF DESCRIPTION OF THE FIGURES

FIG. 11 is a table of an example formula for determining the arc lengths of bonus landings in one embodiment of the gaming device.

FIG. 12 is a table of an example landing configuration for one embodiment of the gaming device.

DETAILED DESCRIPTION

1. Gaming Device in General

Figure 1:
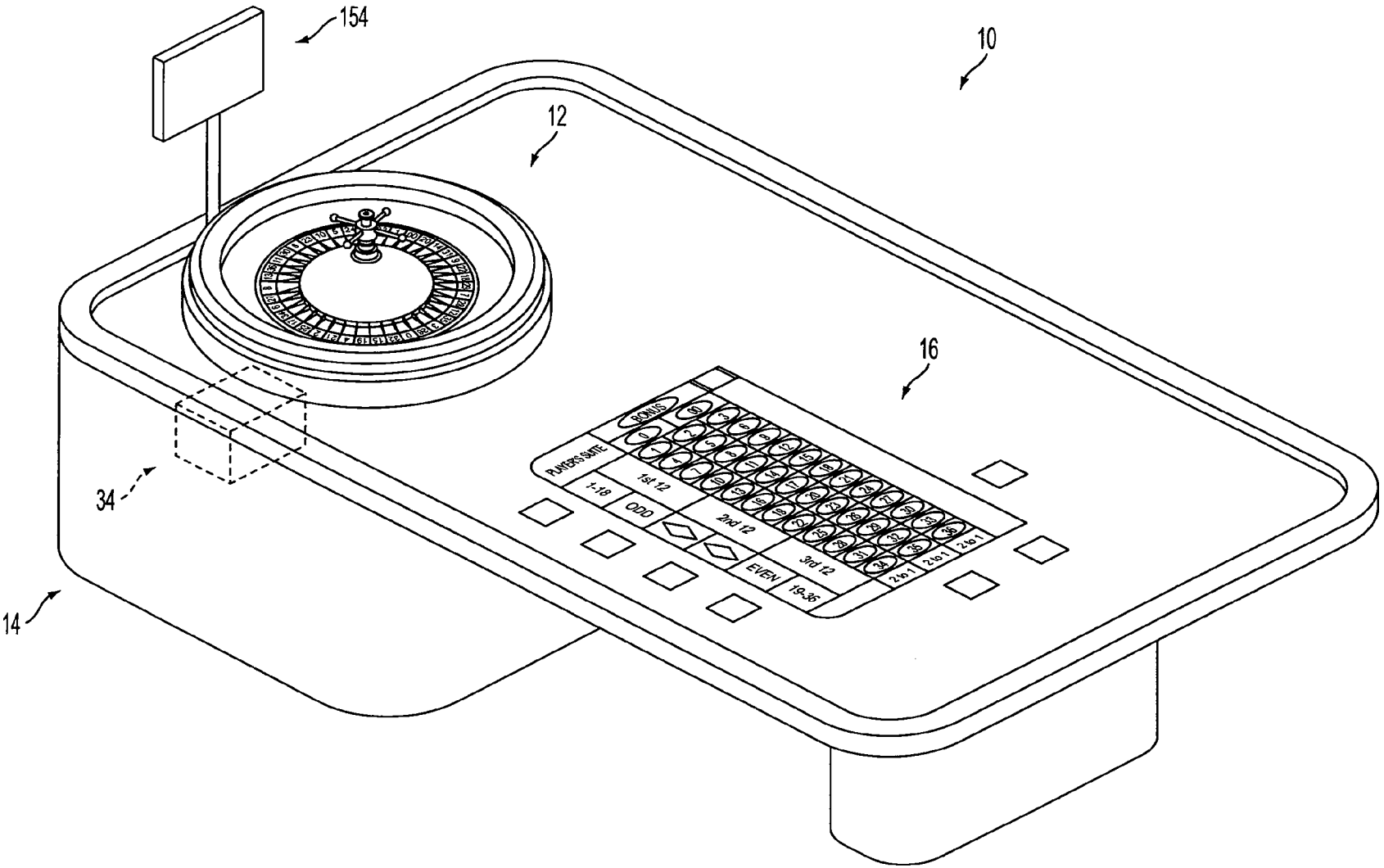
FIG. 1 is a perspective view of one embodiment of the gaming device.
Figure 2:
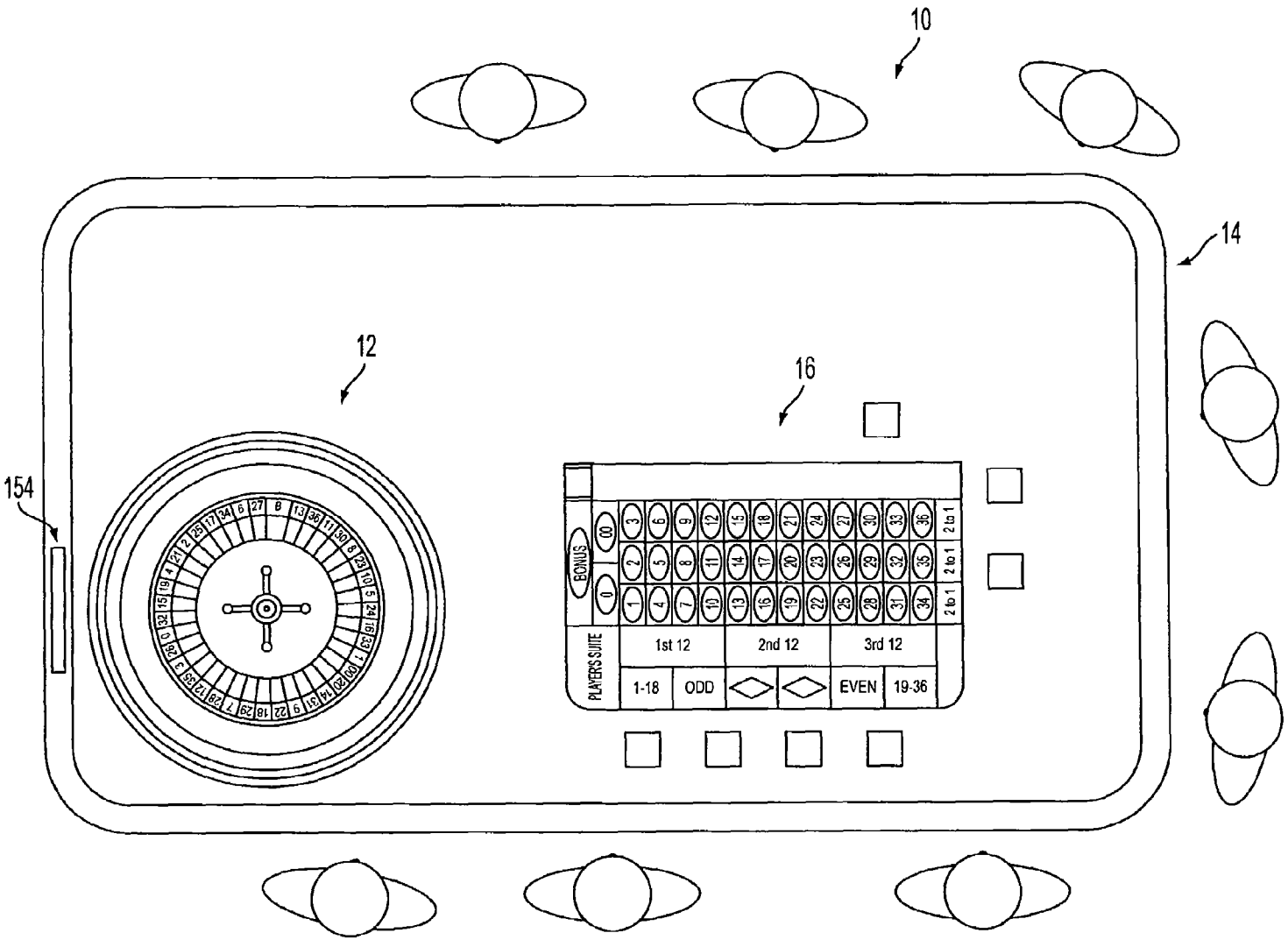
FIG. 2 is top view of the gaming device of FIG. 1.

Referring now to FIGS. 1 through 7, gaming device 10, in one embodiment, includes a wheel assembly 12 supported by a support structure 14, such as a table or console. The gaming device 10 is operable for the play of a primary game involving a roulette wheel. Multiple players can play the roulette wheel-based primary game at the same time. The wheel assembly 12 determines a primary game outcome for the bets placed by all of the players. The wheel assembly 12 can be configured for the play of various types of roulette, including, but not limited to, American style roulette, European style roulette or any suitable variation of such styles.

In one embodiment described further below, the gaming device 10 includes a trigger for a bonus sequence or secondary sequence. The secondary sequence results in a secondary outcome. Depending upon the embodiment, the secondary sequence can be implemented in the roulette wheel or in an ancillary bonus device coupled to the roulette wheel. Irrespective of the location of the secondary sequence, in one embodiment of the gaming device, every wager can benefit from the secondary sequence. In one example, if a ball lands on a bonus landing, the gaming device automatically starts a secondary sequence. The secondary outcome produced by the secondary sequence is applicable to all of the bets placed by all of the players, whether those bets correspond to the bonus landing or other landings.

In another embodiment, only certain wagers can benefit from the secondary sequence. In one example of this embodiment, the gaming device automatically starts the secondary sequence if a ball lands on a bonus landing. In this example, only those players who bet on that bonus landing are eligible to receive the secondary outcome generated by the secondary sequence. In such example, the application of the secondary outcome is player-specific.

In one embodiment, a player must place a designated type or amount of wager to qualify for the initiation of a secondary sequence. This is sometimes referred to as a buy-a-pay or a buy-a-bonus proposition.

In one embodiment illustrated in FIGS. 1 through 4, the gaming device 10 includes a betting station or wagering station 16, sometimes referred to as the betting layout. In this embodiment, the wagering station 16 includes a template which specifies a grid of numbers and betting options. The numbers in the grid correspond to the numbers in the wheel assembly 12. The players place their betting markers or chips on desired locations on the wagering station 16 in a conventional manner, where each said location correspond to one or more specific numbers and, whose corresponding payout is based upon the count of numbers covered by said location.

Figure 5:
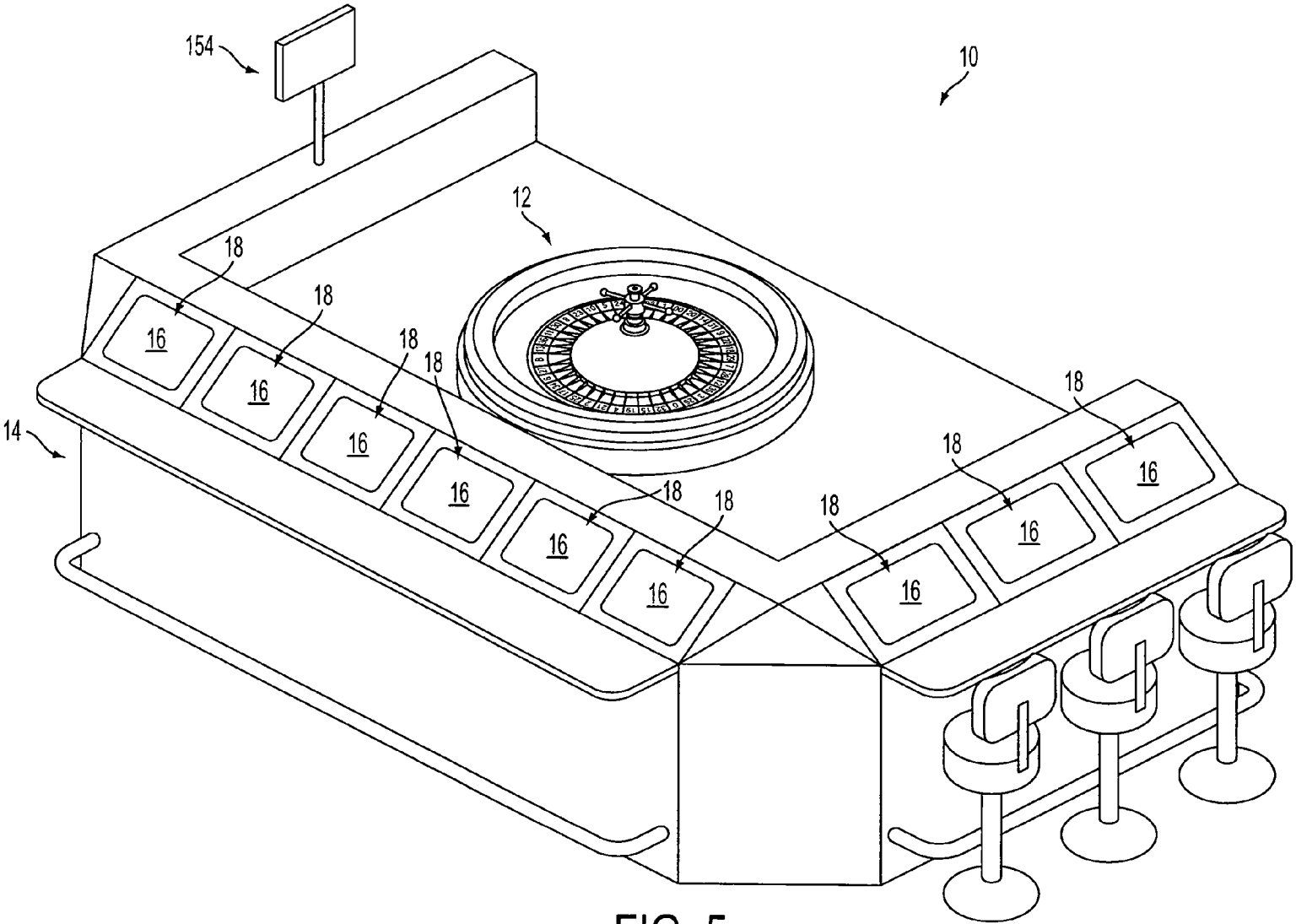
FIG. 5 is a perspective view of another embodiment of the gaming device.
Figure 6:
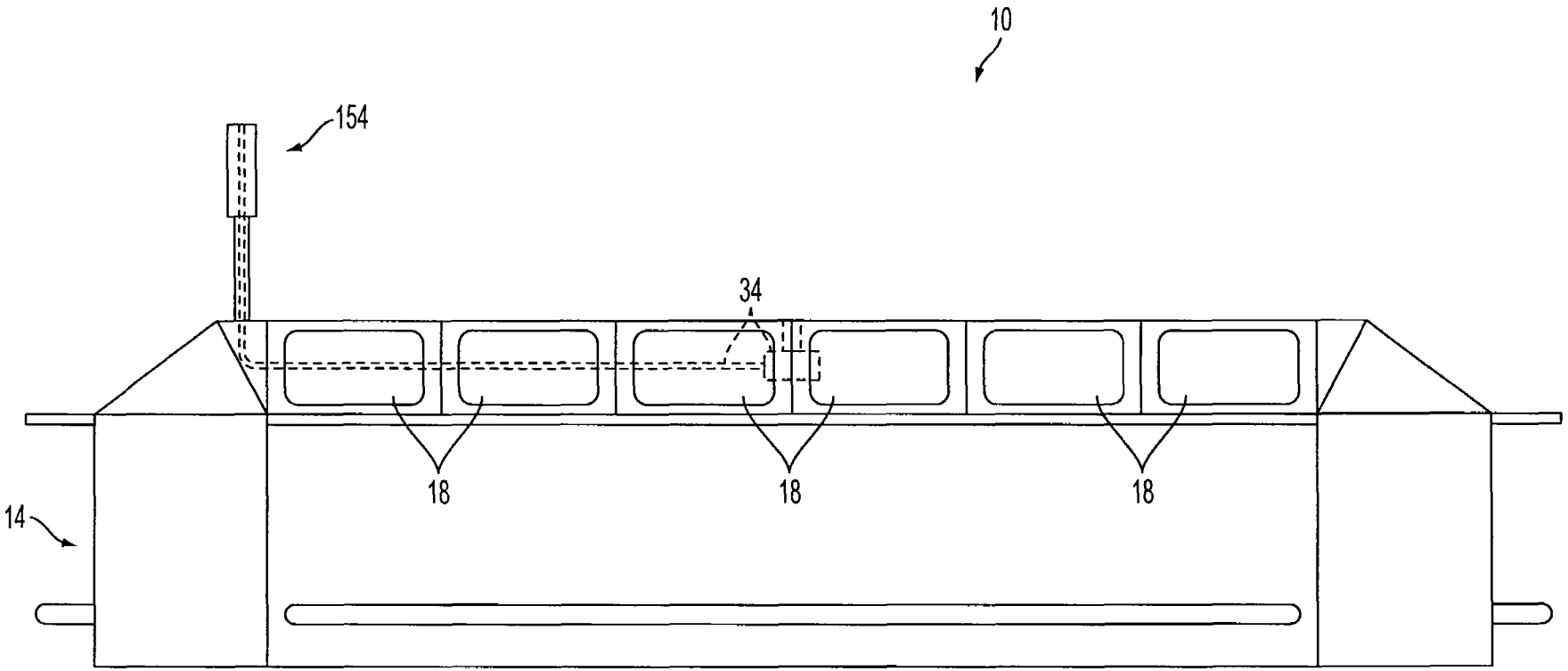
FIG. 6 is a side elevation and diagrammatic view of the gaming device of FIG. 5.

In another embodiment illustrated in FIGS. 5 and 6, the gaming device 10 includes a plurality of display devices 18. Each display device 18, when activated, displays a computer-generated wagering station 16. Each graphical wagering station or layout enables a player to select desired numbers and betting combinations for their wagers. In one embodiment, both a standard table layout and computer-generated wagering stations can share the same roulette wheel. In each such embodiment, after the players have placed their bets, a croupier or dealer operates the wheel assembly 12 resulting in an outcome for the primary game, as described further below. It should be appreciated that the dealer can be a human operator or a computer which automatically controls the operation of the wheel assembly 12.

2. Wheel Assembly

Referring to FIGS. 7 through 20, one embodiment of the wheel assembly 12 includes: (a) a frame; (b) a sloped wall 22, sometimes referred to as a bowl, supported by the frame 20; (c) a rod or spindle 24 extending vertically upward from the frame 20; (d) a bushing, set of bearings or other friction reducer 26 connected to the spindle 24; (e) a ring, disc or substantially circular rotor 28 coupled the friction reducer 26 and positioned concentrically within the substantially circular sloped wall 22; (f) a conical shaped plate or cone 30 connected to the spindle 24 which covers the inner portion 22 of the rotor 28; (g) a ball conveyor or ball router 34 located underneath the rotor 28 which directs balls 36 from the top of the rotor 28 to a designated location, as described further below; and (h) a housing 40 which covers the frame 20 and many of the components supported by the frame 20.

In one embodiment, the rotor 28 includes: (a) an inner circular section 42 which carries a series of game landings 44 and one or more bonus landings 46; and (b) an outer circular section 48 which encircles the inner circular section 42 and which includes a plurality of game symbols 50 and one or more bonus symbols 52. In one embodiment, each game landing 44 is aligned with a game symbol 50, and the bonus landing 46 is aligned with the bonus symbol 52. Because, in such embodiment, the inner circular section 42 and outer circular section 48 are formed as part of the same rotor 28, these sections 42 and 48 do not move relative to one another.

Figure 3:
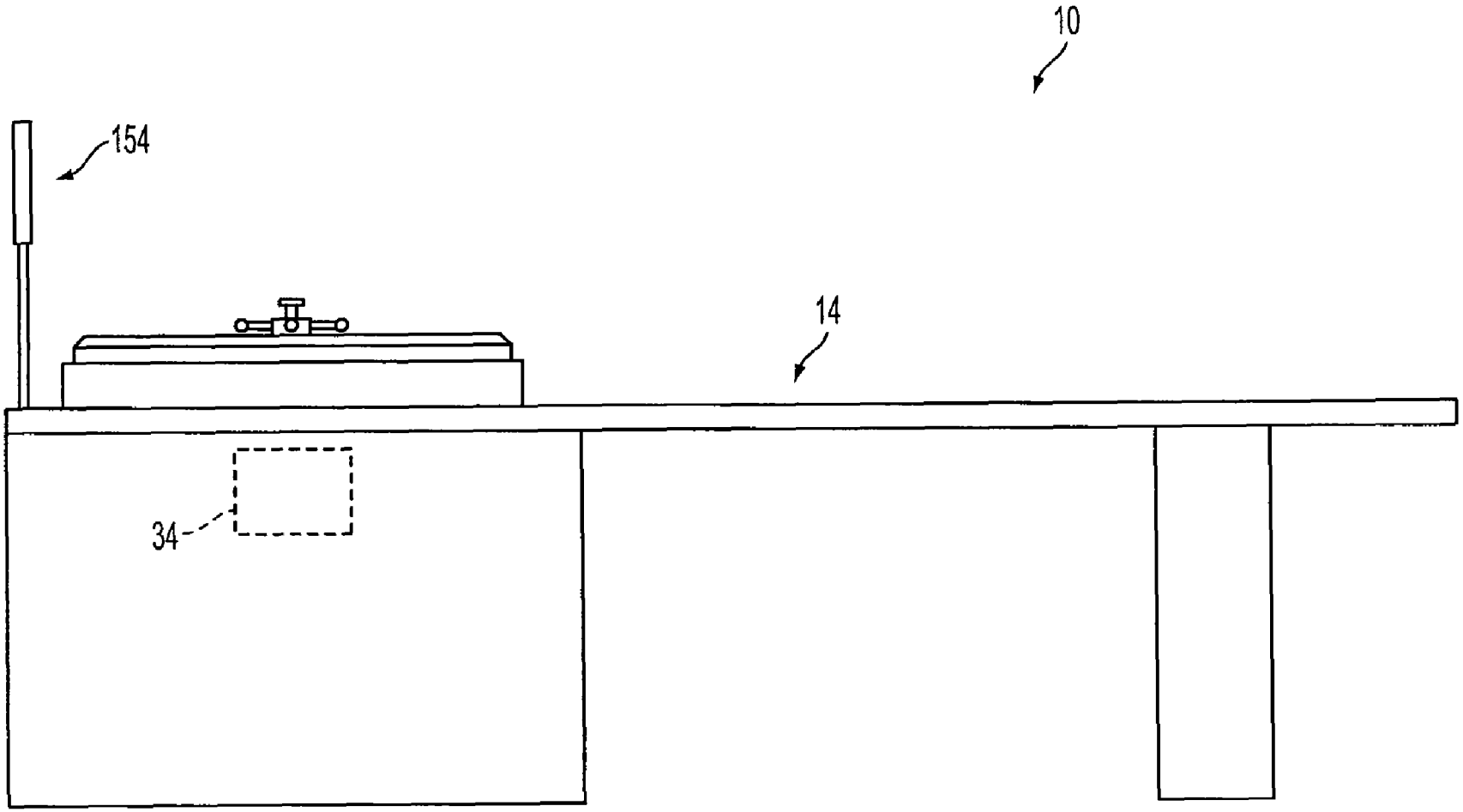
FIG. 3 is a side elevation view of the gaming device of FIG. 1.
Figure 4:
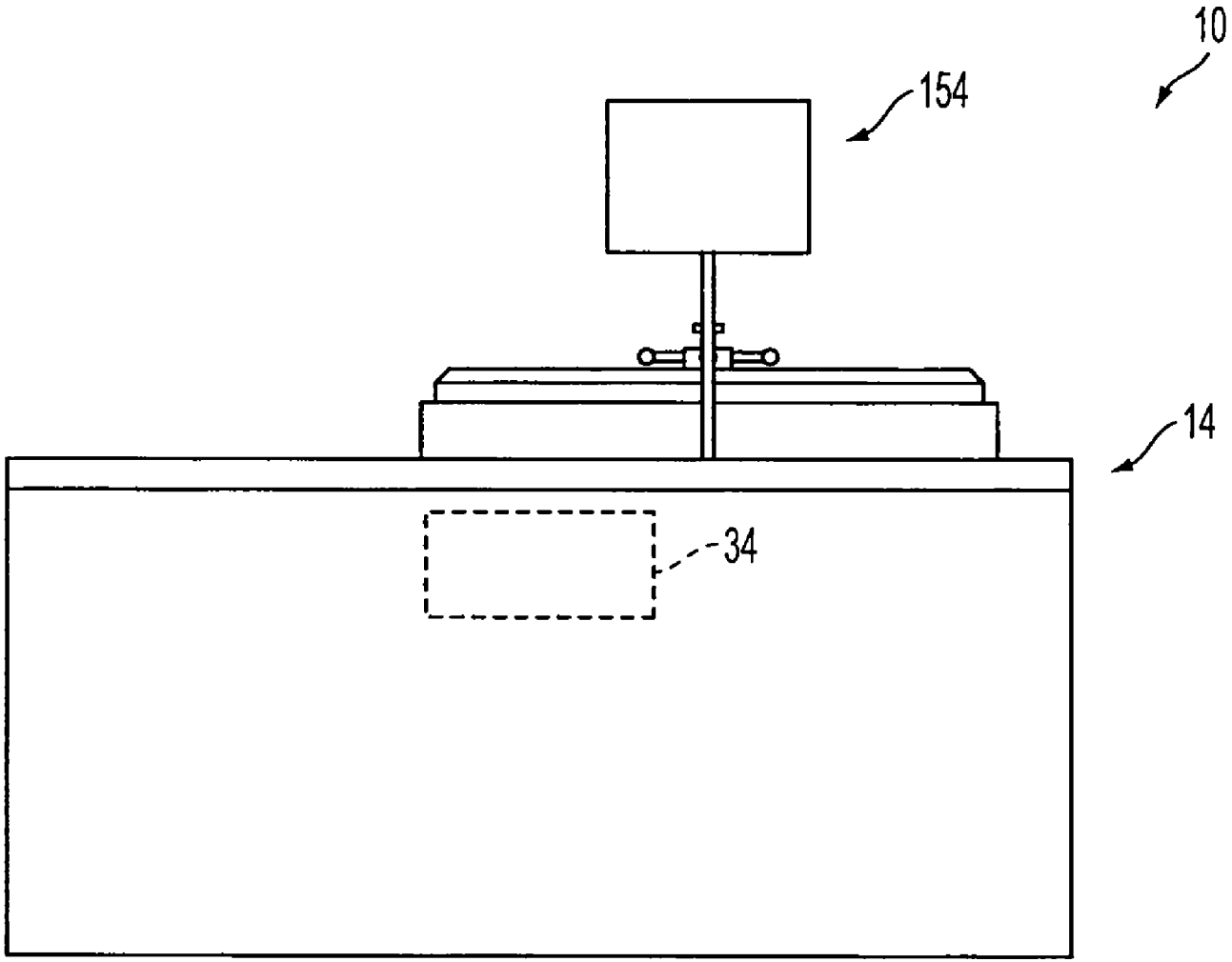
FIG. 4 is a rear view of the gaming device of FIG. 1.

In one embodiment, the wheel assembly 12 includes one or more detectors or landing sensors 38, illustrated in FIG. 3, which are operable to automatically sense whether the ball has landed in a game landing 44 or bonus landing 46. The landing sensors 38 can include any suitable sensing apparatus which generates a signal when the ball lands in a landing, including, but not limited to, a light sensor, a motion detector and a pressure sensor.

The landing of a ball on a game landing 44 results in a primary game outcome associated with the bets placed on the wagering station 16. The landing of a ball on a bonus landing 46 triggers a bonus sequence or secondary sequence. As described below, the secondary sequence results in a bonus outcome or secondary outcome for one player, a plurality of players or all of the players of the primary wheel game.

3. Bonus Landings

3.1 Variance of Geometry of Bonus Landings

Figure 7:
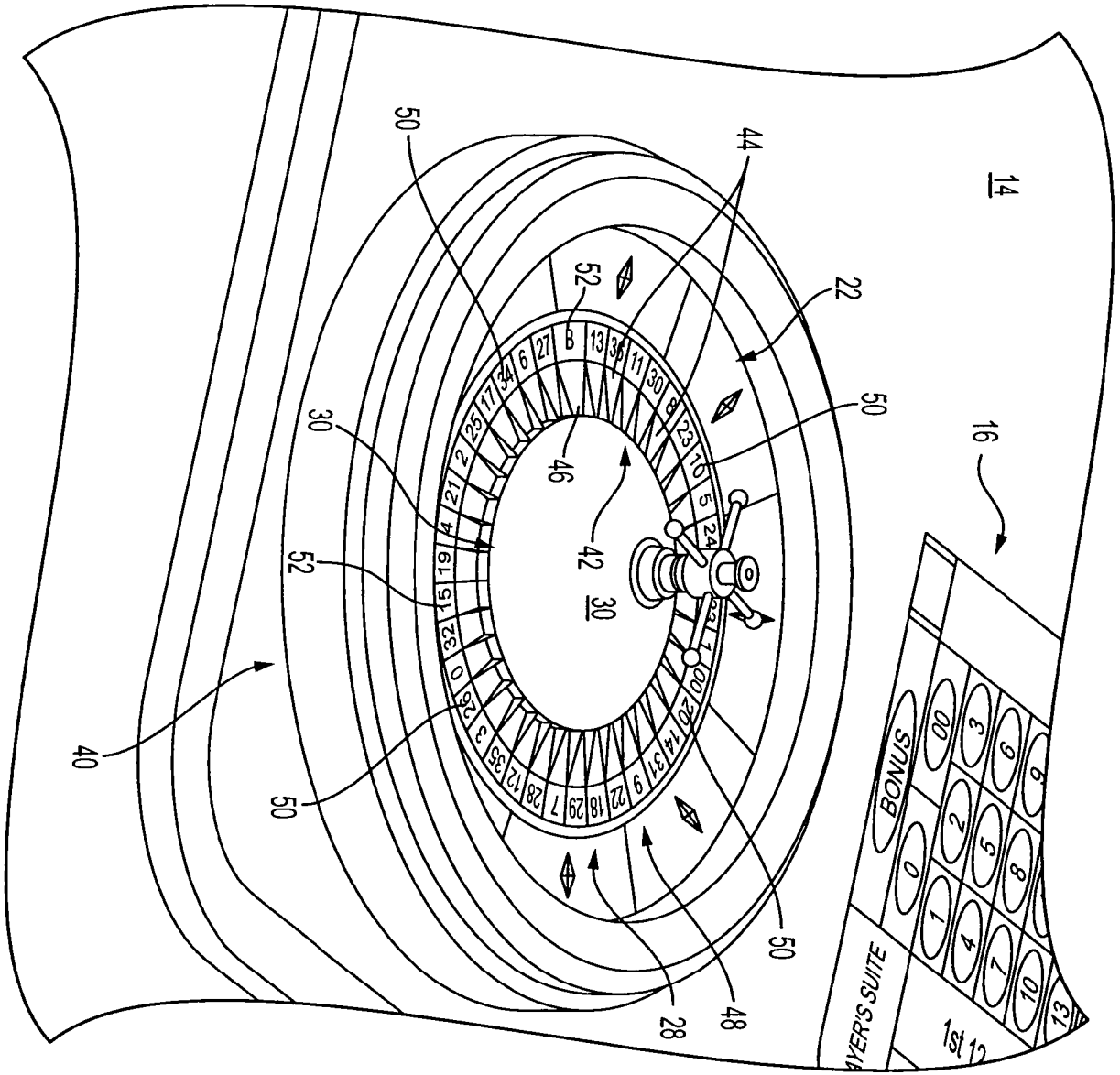
FIG. 7 is a top perspective view of the wheel assembly and wagering station of one embodiment of the gaming device.
Figure 8:
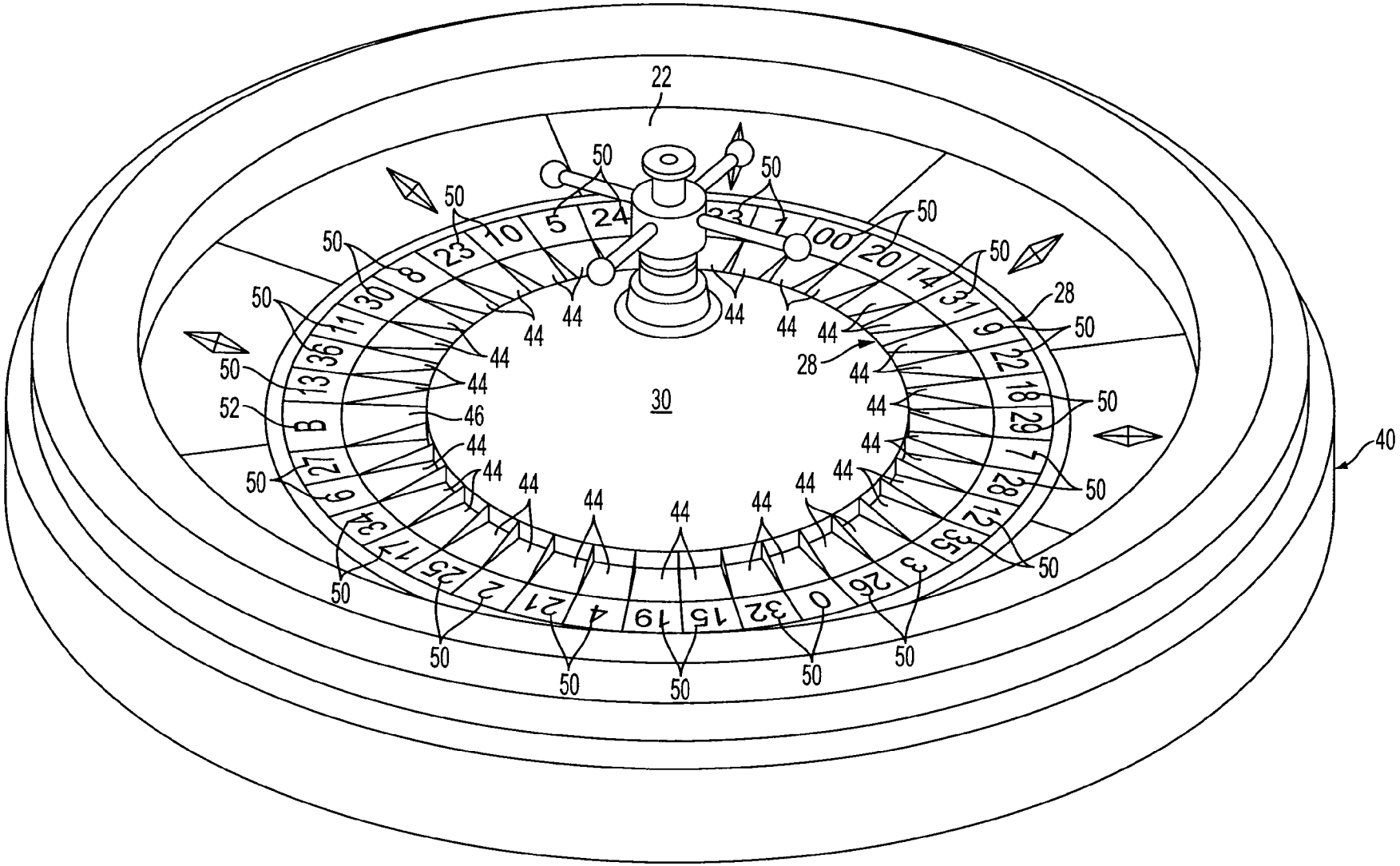
FIG. 8 is a top perspective view of the wheel assembly of FIG. 7.
Figure 10:
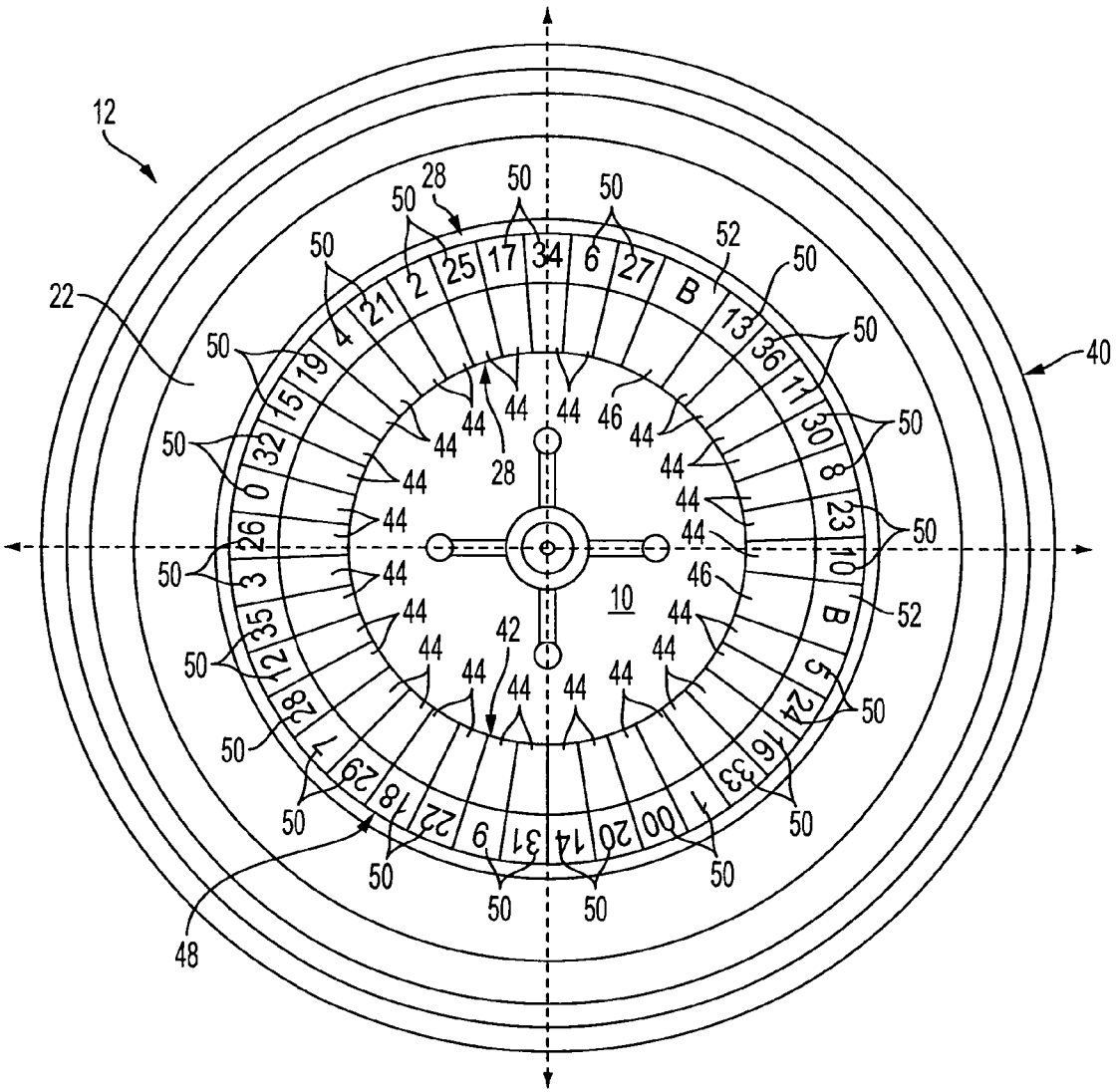
FIG. 10 is a top view of the wheel assembly of another embodiment of the gaming device.
Figure 13:
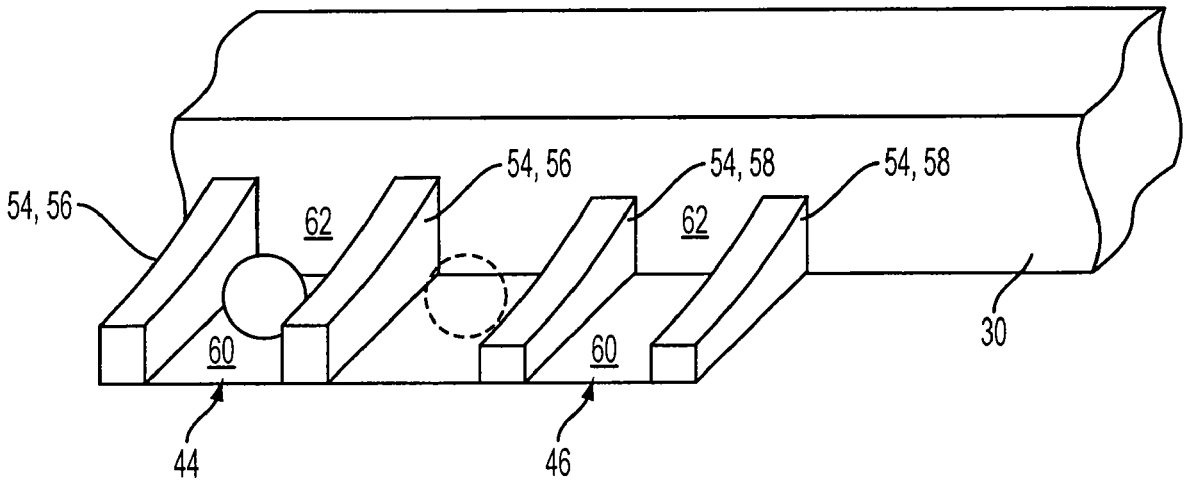
FIG. 13 is an enlarged perspective view of a portion of the inner circular section of the wheel assembly illustrating landings of one embodiment of the gaming device.

As illustrated FIGS. 7, 8 and 10, in one embodiment the bonus landing 46 has at least one dimension which is different than the dimensions of the game landings 44. As best illustrated in FIG. 10, in one example the rotor 28 has two bonus landings 46 and thirty-eight game landings 44. In this example, each bonus landing 46 has an arc length which is greater than the arc length each of the game landings 44. The quantity of bonus landings 46 and the arc length of each bonus landing 46 relative to the arc lengths of the game landings 44 is, in one embodiment, determined according to the formula set forth in FIG. 11. With this formula, a desired multiplier X can be used to increase or decrease the widths of the bonus landings 46 relative to the widths of the game landings 44. In the example illustrated in FIG. 12, each bonus landing 46 has an arc length which is identical to the arc lengths of the game landings 44. In such example, each landing has an arc length of nine. As described above, if the ball lands on a bonus landing 46, a triggering event occurs providing the player with the opportunity to gain a bonus outcome or secondary outcome. The greater the quantity of bonus landings 46, the greater the likelihood the ball will land on a bonus landing 46. Similarly, the greater the arc lengths of the bonus landings 46, the greater the likelihood that the ball will land on a bonus landing 46.

In addition to the arc length of the bonus landings 46, any other suitable geometrical parameter of the bonus landings 46 can be varied to affect the likelihood of whether the ball will land on a bonus landing 46 versus a game landing 44. Referring to FIGS. 13 through 18, each game landing 44 and bonus landing 46 includes a plurality of dividers or sidewalls 54. In one embodiment, the heights of the sidewalls 54 are varied to increase or decrease the likelihood that the ball will fall or land within one of the game landings 44 or bonus landings 46. In one example illustrated in FIG. 13, the game landing 44 has sidewalls 56, and the bonus landing 46 has lower sidewalls 58. The lower sidewalls 58 increase the likelihood that the ball will enter the bonus landing 46.

As best illustrated in the comparison of FIGS. 14 through 18, each game landing 44 and bonus landing 46 also has a floor 60 and a back 62. The back 62, floor 60 and sidewalls 54 define a pocket or space 64 for each game landing 44 and bonus landing 46. In one embodiment illustrated in FIG. 15, at least one bonus landing 66 has a sidewall 64 which is taller than the sidewall 56 of game landing 44. Accordingly, the bonus landing 66 defines a space which is deeper than the space defined by game landing 68, as illustrated in comparison of FIGS. 14 and 15. The taller sidewall 54 increases the likelihood that a ball entering bonus landing 66 will remain in such bonus landing 66. This is due, in part, to the increased leverage and stopping force applied by the side walls 64 to the ball 36.

Figure 14:
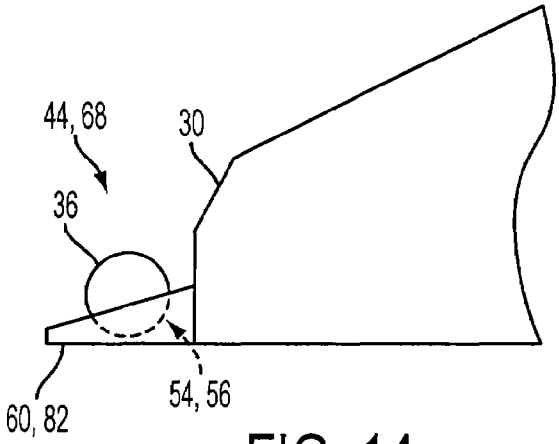
FIG. 14 is a side elevation view of a bonus landing in one example of one embodiment of wheel assembly of the gaming device.
Figure 15:
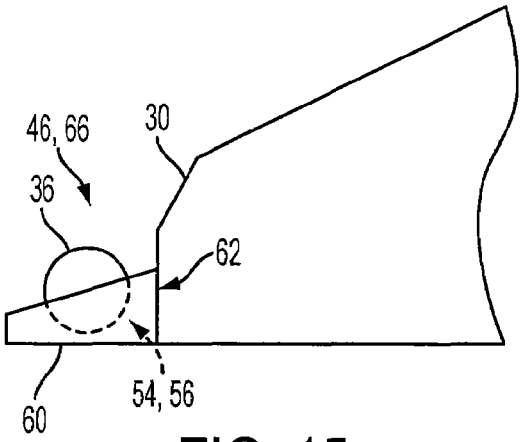
FIG. 15 is a side elevation view of a first exemplary bonus landing which is configured differently from the bonus landing of FIG. 14.
Figure 16:
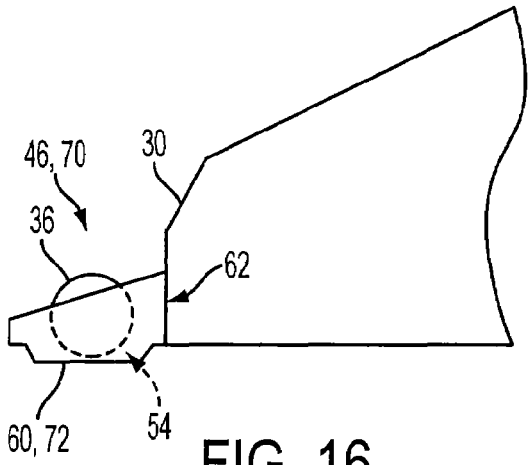
FIG. 16 is a side elevation view of a second exemplary bonus landing which is configured differently from the bonus landing of FIG. 14.

As illustrated in comparison of FIGS. 14 and 16, the bonus landing 70 also defines a space which is deeper than the space defined by game landing 68. In this case, the greater depth is due, in part, to the concave shape of the floor 72.

Figure 17:
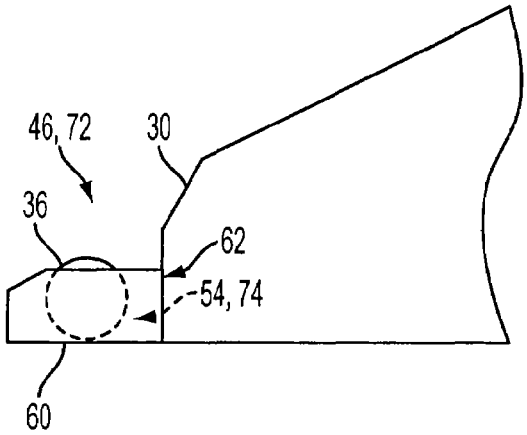
FIG. 17 is a side elevation view of a third exemplary bonus landing which is configured differently from the bonus landing of FIG. 14.

In another example illustrated in comparison of FIGS. 14 and 17, a bonus landing 72 defines a space with a greater volume or area than the volume or area defined by the space of game landing 68. In this example, the sidewall 74 has more of a rectangular shape than the triangular shaped sidewall 56 of game landing 68.

Figure 18:
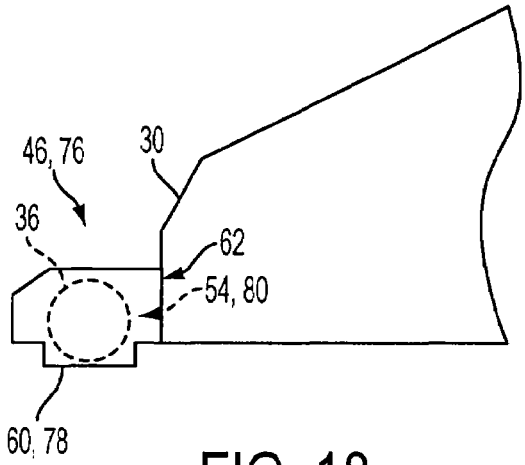
FIG. 18 is a side elevation view of a fourth exemplary bonus landing which is configured differently from the bonus landing of FIG. 14.

In another example illustrated in comparison of FIGS. 14 and 18, bonus landing 76 defines a space that has a greater volume and depth than the space defined by the game landing 68. Here, the bonus landing 76 has a recessed floor 78 and a rectangular shaped sidewall 80 in comparison to the flat floor 82 and triangular shaped sidewall 56 of game landing 68.

3.2 Other Characteristics of Bonus Landings

Figure 19:
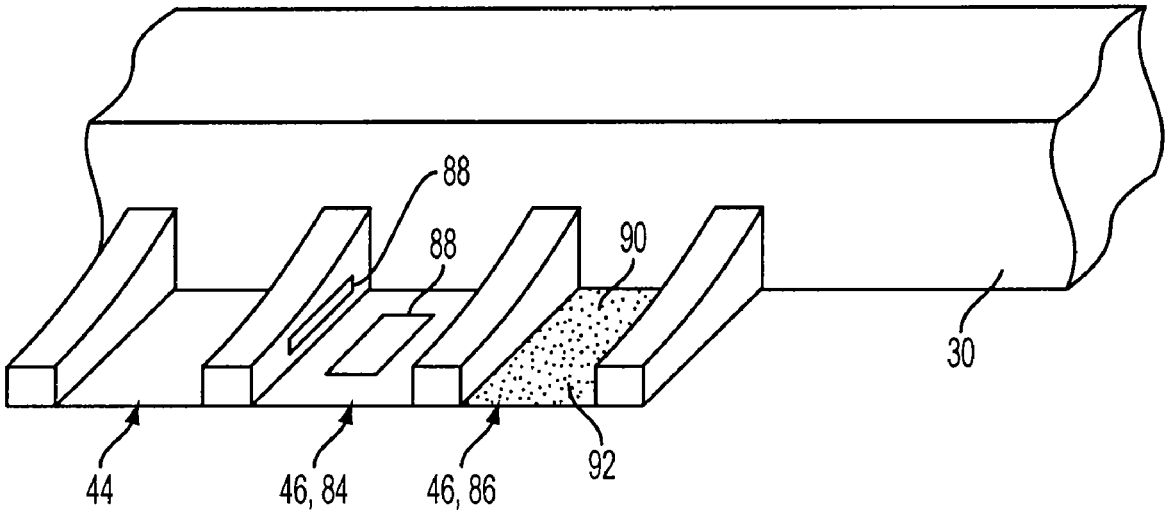
FIG. 19 is an enlarged perspective view of a portion of the inner circular section of the wheel assembly illustrating different characteristics of bonus landings of one embodiment of the gaming device.

In another embodiment illustrated in FIG. 19, the bonus landings 84 and 86 have physical characteristics which are distinguished from the physical characteristics of the game landings 44. These characteristics can include, but are not limited to, surface characteristics, structural characteristics and material characteristics. These physical characteristics of the bonus landings 84 and 86 affect the likelihood of a ball landing on such bonus landings 84 and 86 relative to the game landings 44. In one embodiment, at least one of the bonus landings 46 has a degree of rigidity which is less than the rigidity of the game landings 44. In one embodiment, the lower degree of rigidity of the bonus landings 46 is based on a physical characteristic including, but not limited to, hardness, strength, flexibility, plasticity, resiliency and shock absorption. By having a lower degree of rigidity, the bonus landing 46 absorbs more of the impact from the ball than the impact absorbed by the more rigid game landings 44. Also, a lower degree of rigidity increases the frictional force acting on the ball in the bonus landings 46. Due to these and other factors, the decreased rigidity of the bonus landings 46 results in greater odds that the ball will landing on one of the bonus landings 46 versus one of the game landings 44.

Figure 9:
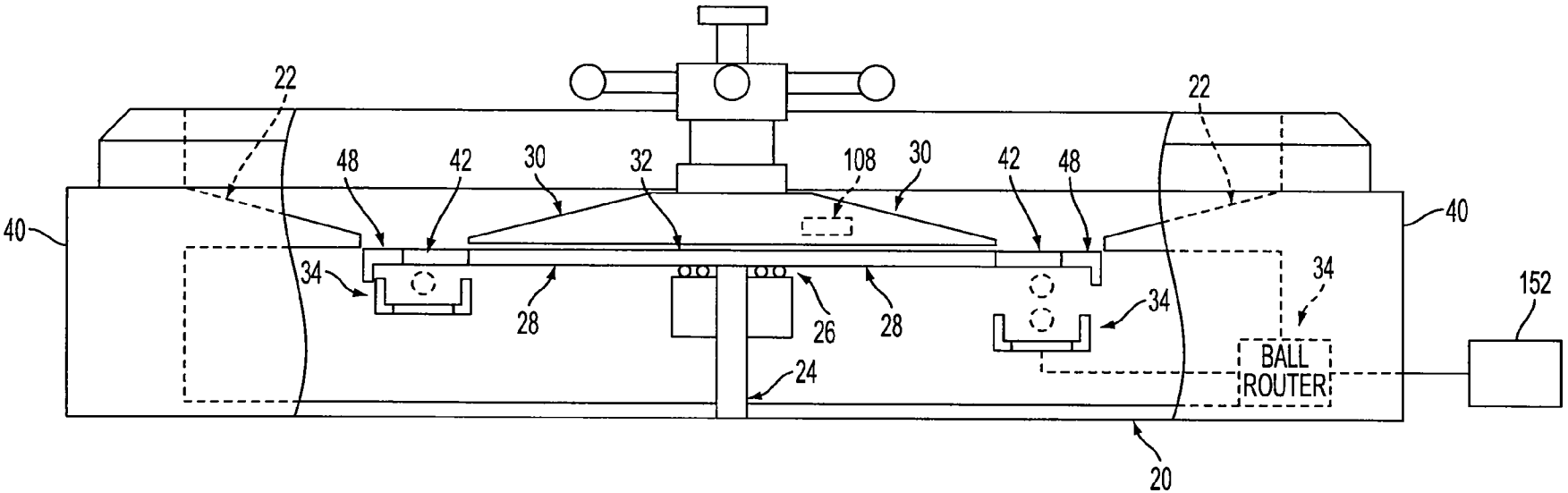
FIG. 9 is a break away diagrammatic view of a portion of the wheel assembly of FIG. 8.

In the example illustrated in FIG. 9, the bonus landing 84 has a shock absorption characteristic 88, and the bonus landing 86 has a resiliency characteristic 90 incorporated into the material of the floor 92. In operation, as the ball travels along the game landings 44 and bonus landings 46, the different physical characteristics of the bonus landings 46 affect the likelihood of whether the ball will land in such bonus landings 46. For example, a ball traveling at a designated velocity will be more likely to stop in a bonus landing 46 than the game landing 44 if the bonus landing 46 absorbs more of the ball's impact or kinetic energy or provides increased friction to slow or stop the ball.

In one embodiment, at least one bonus landing 46 has a selected magnetic characteristic or a degree of magnetism. In this embodiment, the ball 36 is constructed of steel or metal. The strength of the magnetism of such bonus landing 46 affects the likelihood that such ball 36 will land on such bonus landing 46.

In another embodiment, the wheel assembly 12 includes an air pressure device which directs variable air currents into one or more game landings 44 or bonus landings 46 when designated events occur. These air currents strike the ball, thereby affecting the likelihood that the ball will stop in one of the bonus landings 46 versus one of the game landings 44.

4. Landing Floor with Opening

4.1 Full Time Opening

Figure 20:
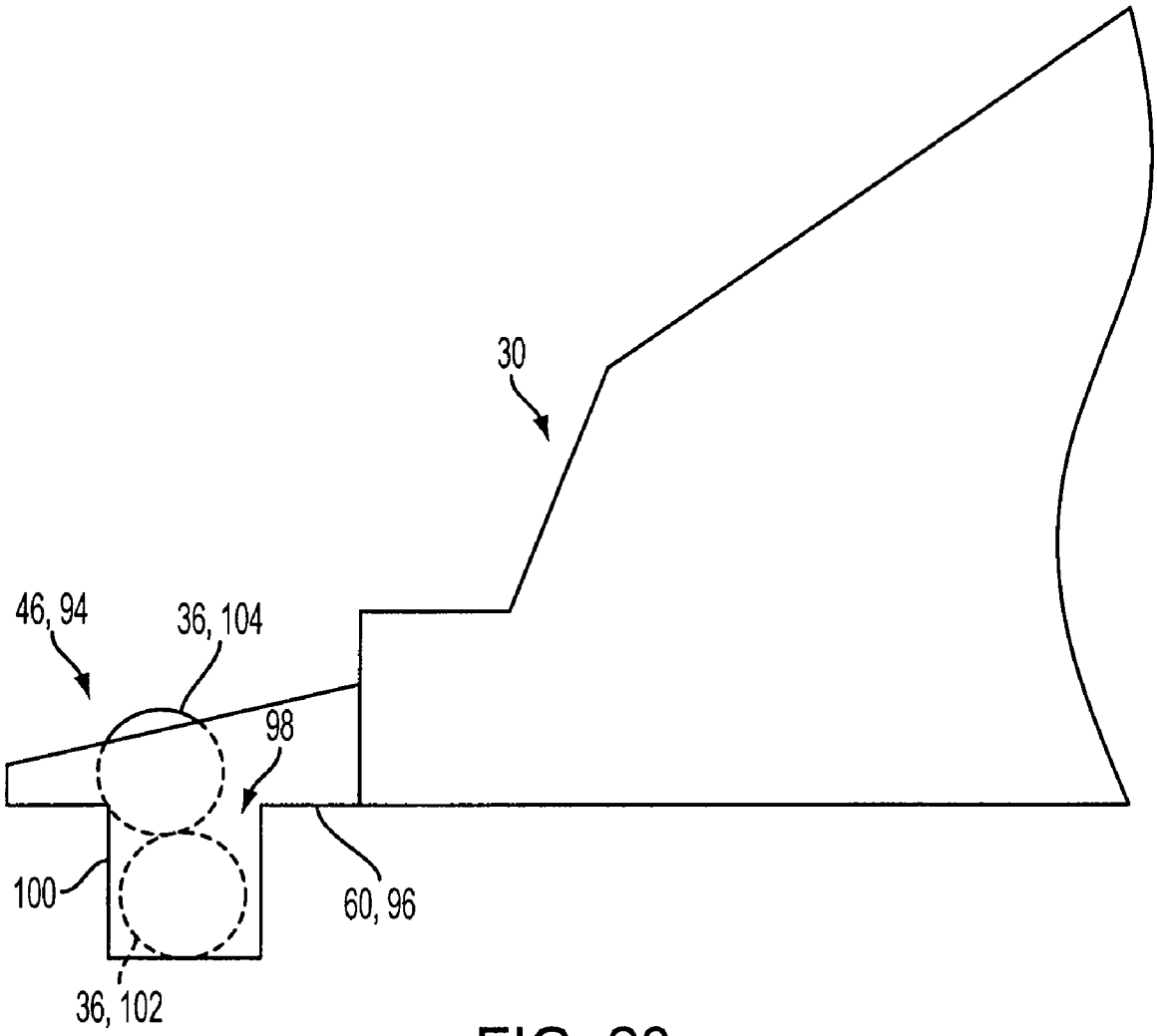
FIG. 20 is a side elevation view of a bonus landing having a ball holder in one embodiment of the gaming device.
Figure 21:
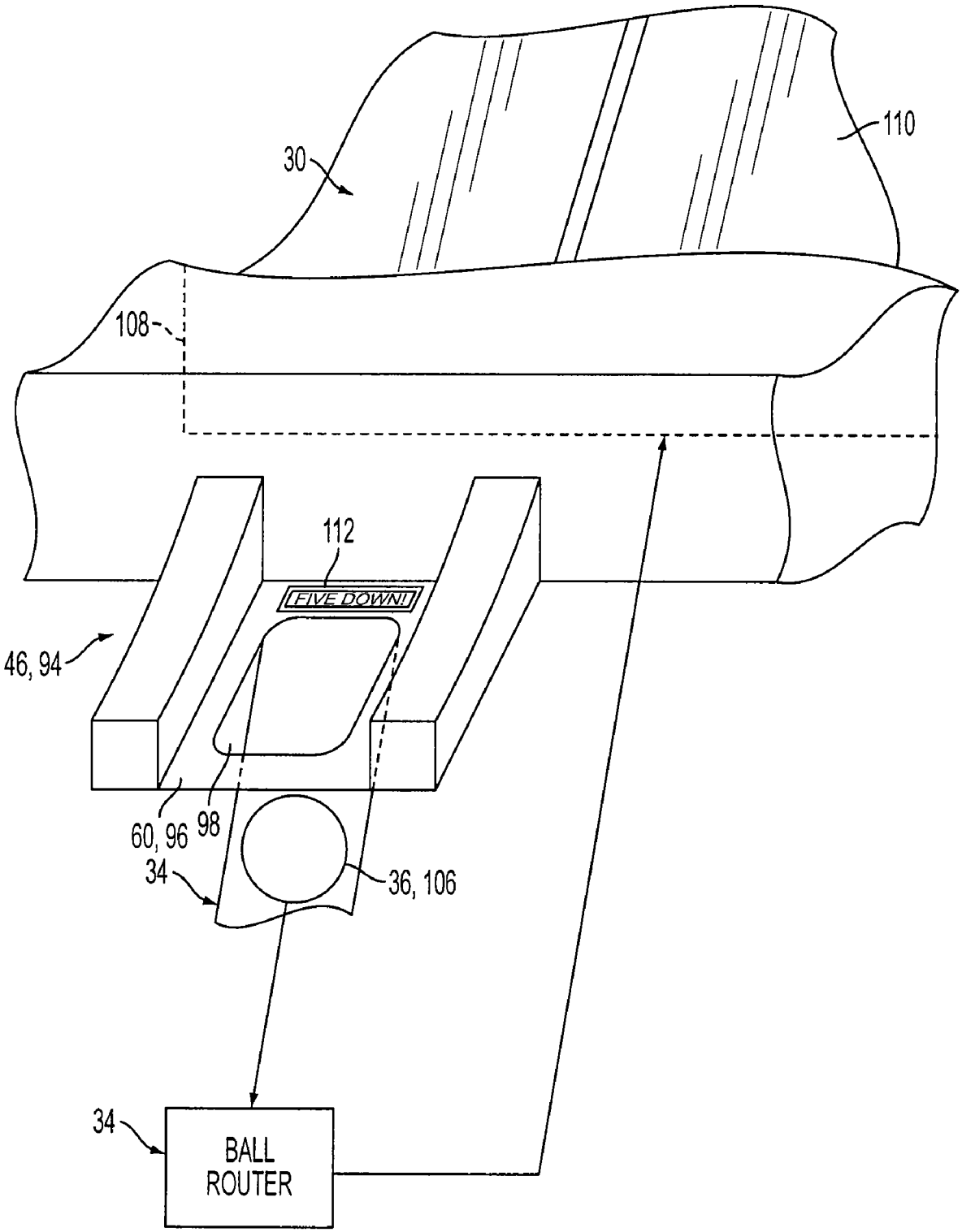
FIG. 21 is an enlarged perspective view of a bonus landing coupled to a ball router in one embodiment of the gaming device.

In one alternative embodiment illustrated in FIGS. 20 and 21, the bonus landing 94 has a floor 96 which defines an opening 98. In one embodiment, the opening 98 is exposed throughout the play of the primary game and any bonus or secondary sequence. The slot or opening 98 is greater in size than the ball 36. Accordingly, when the ball 36 stops in the bonus landing 94, the ball falls or drops through the opening 98. In the embodiment illustrated in FIG. 20, the wheel assembly 12 includes a ball holder 100 connected to the floor 96. In this embodiment, the ball holder 100 is sized to hold slightly more than the volume of a single ball 102. In operation, if the ball 102 lands in bonus landing 94, the ball will drop through the opening 98. The ball holder 100 holds the dropped ball 102 in place for retrieval by the dealer. If, before the dealer retrieves the ball 102, another ball 104 lands in the bonus landing 94, the ball 104 will drop partially through the opening 98. The presence of the ball 102 in the ball holder 100 keeps the ball 104 visible to the players while relatively significantly reducing the ability of the first ball to interfere with a second ball landing in the same landing. Accordingly, the visibility of ball 104 functions as an indicator that two balls have landed and stopped within the bonus landing 94. In another example illustrated in FIG. 21, when the ball 106 lands in the bonus landing 94, the ball router 34 routes that ball 106 from the opening 98 to a ball holder 108.

In one embodiment, the ball holder 108 is located within the cavity defined by the cone 30. The cone 30 has one or more removable panels 110. By removing the panel 110, the dealer can access the balls in the ball holder 108. In addition, the bonus landing 94 includes a display device or indicator 112 which indicates how many balls have fallen through the opening 98 in the course of a game or sequence of games. In this example, the indicator states "FIVE DOWN!" indicating that five balls have fallen through the opening 98.

4.2 Door

Figure 22:
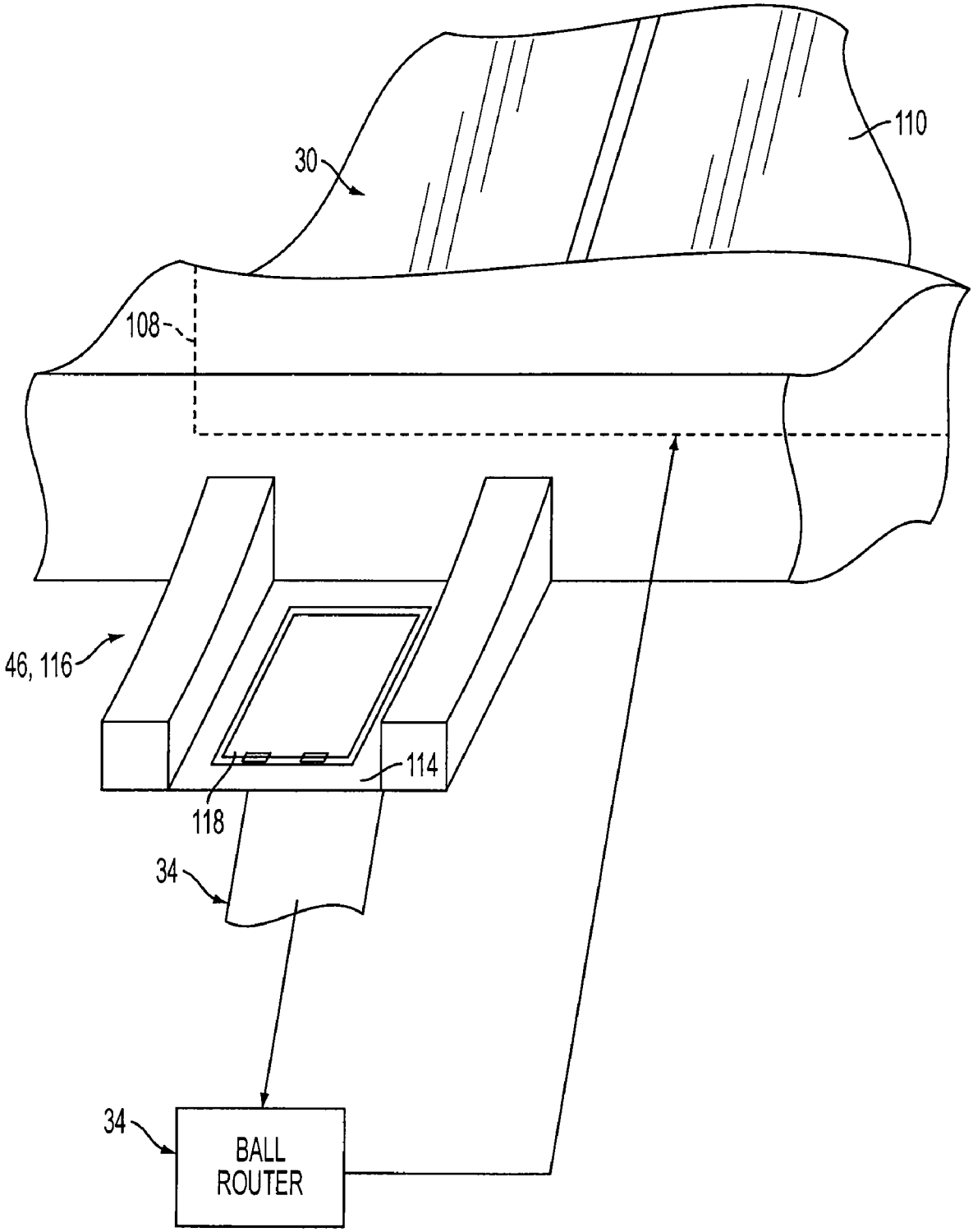
FIG. 22 is an enlarged perspective view of a bonus landing having a closed floor door in one embodiment of the gaming device.
Figure 23:
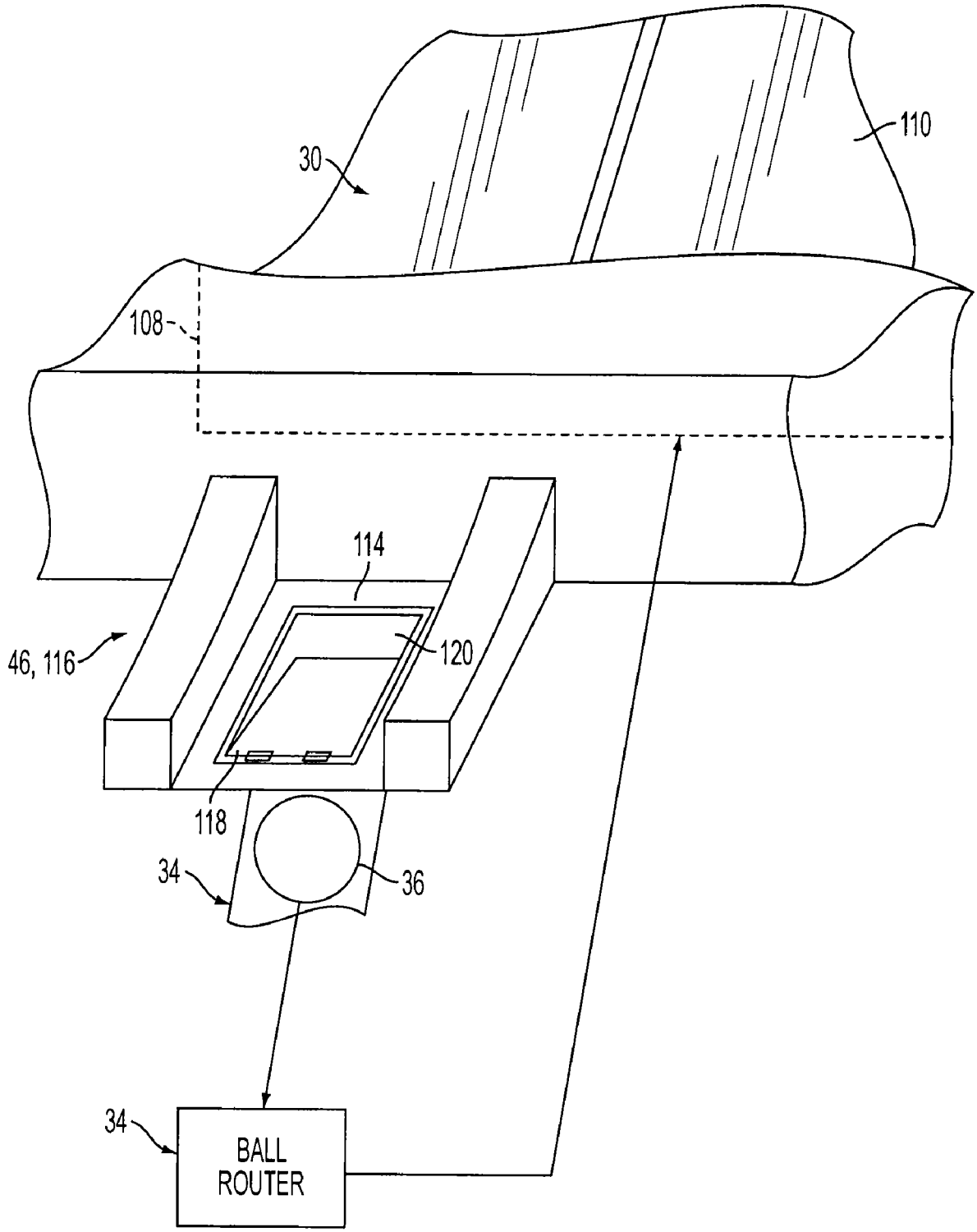
FIG. 23 is an enlarged perspective view of a bonus landing having an open floor door in one embodiment of the gaming device.

In one embodiment illustrated in FIGS. 22 and 23, the floor 114 of the bonus landing 116 has a door 118. In the closed position illustrated in FIG. 22, the door 118 provides a relatively flat surface for the bonus landing 116. In the open position illustrated in FIG. 23, the door 118 reveals an opening 120. If there is a ball in the bonus landing 116, the opening of the door 118 will cause such ball to drop through the opening 120. The ball router 34 directs the ball 36 from the bonus landing 116 to the ball holder 108.

Figure 24:
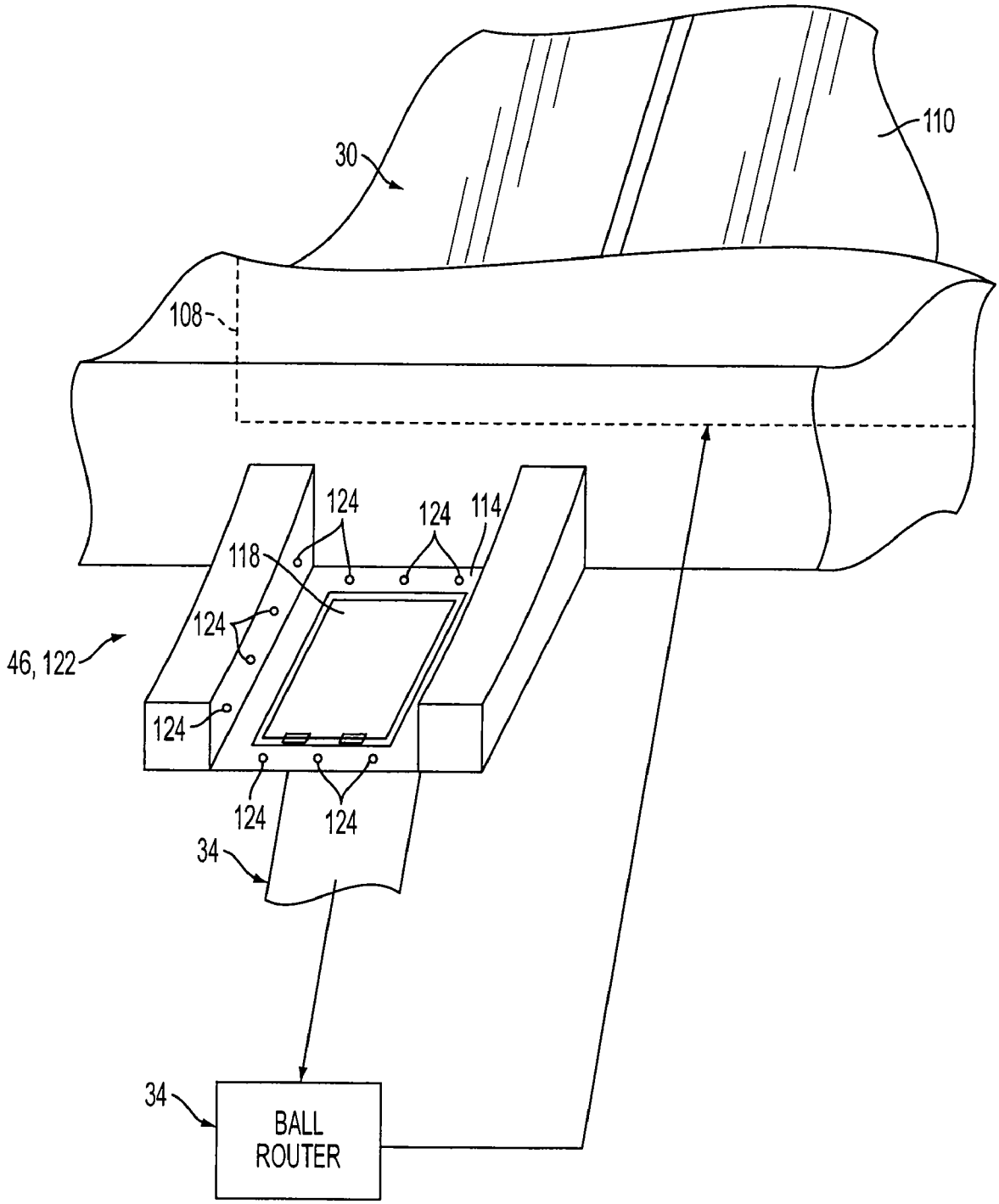
FIG. 24 is an enlarged perspective view of a bonus landing having a plurality of ball drop indicators in one embodiment of the gaming device.

In one embodiment illustrated in FIG. 24, the bonus landing 122 is the same as bonus landing 116 except it has a plurality of indicators 124. The indicators 124, which are operatively coupled to the landing sensors 38, visually indicate how many balls have fallen through the bonus landing 122 in the course of the primary game or bonus sequence. In one example, each indicator 124 includes a suitable light source such as a light emitting diode (LED), and the number of illuminated indicators 124 indicates how many balls have fallen through the bonus landing 122.

Figure 25:
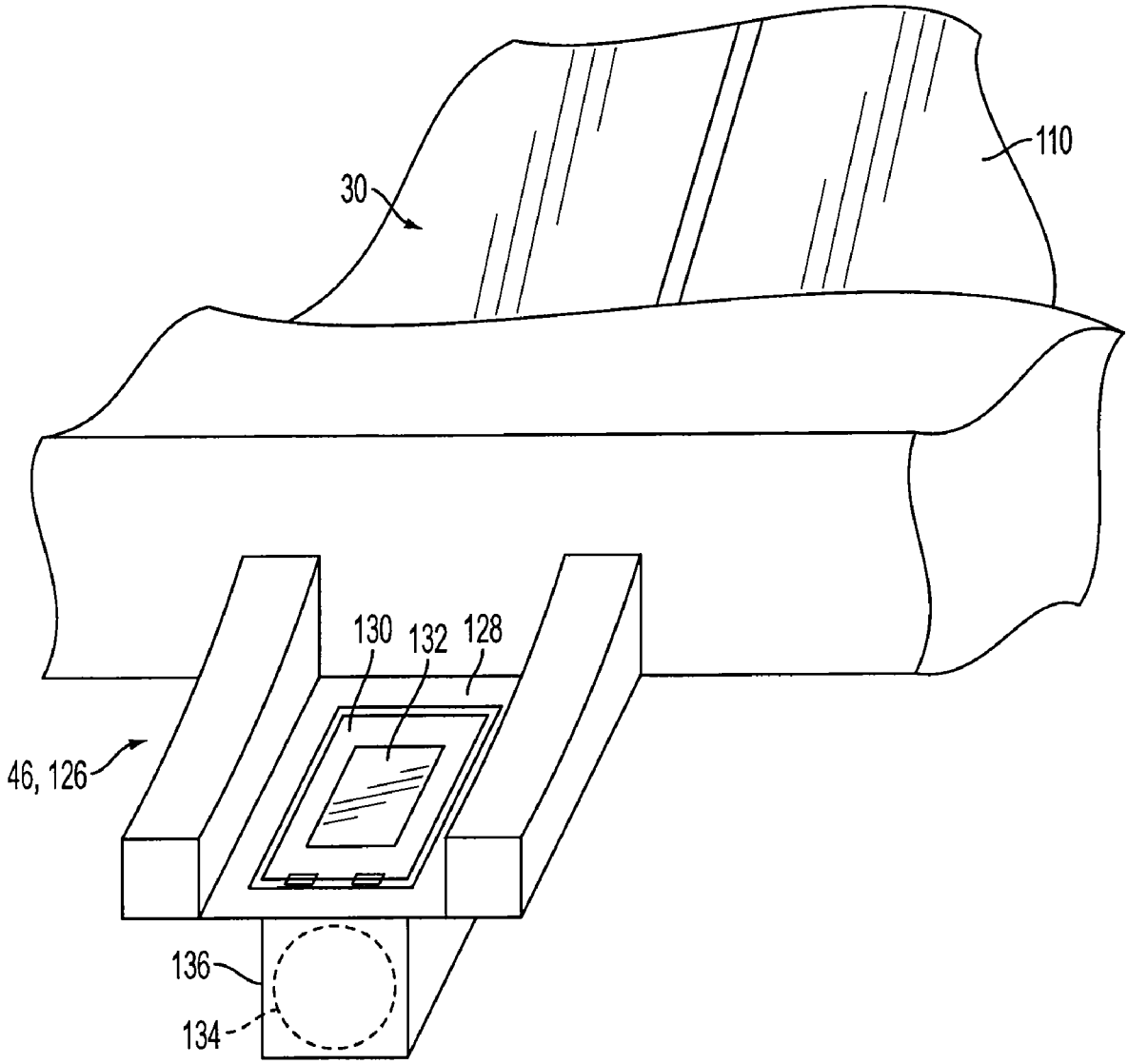
FIG. 25 is an enlarged perspective view of a bonus landing having a floor door with a window in one embodiment of the gaming device.

In another embodiment illustrated in FIG. 25, the bonus landing 126 has a floor 128 with a door 130. The door 130 includes a window 132. The window 132 includes a see-through portion. In one embodiment, the see-through portion is transparent, substantially transparent, translucent or substantially translucent. When the door 130 is closed, the window 132 enables the dealer and players to see into the ball holder 136. Accordingly, the window 132 enables the dealer and players to see whether any balls 134 have fallen through the bonus landing 126. This provides the dealer and the players with information about the bonus or secondary game outcomes. In an alternative embodiment, the wheel assembly 12 includes one or more sensors operable to detect how many balls are within the ball holder 136. These sensors are coupled to a audio, visual or audiovisual output device which is operable to indicate information pertaining to the held balls.

Figure 26:
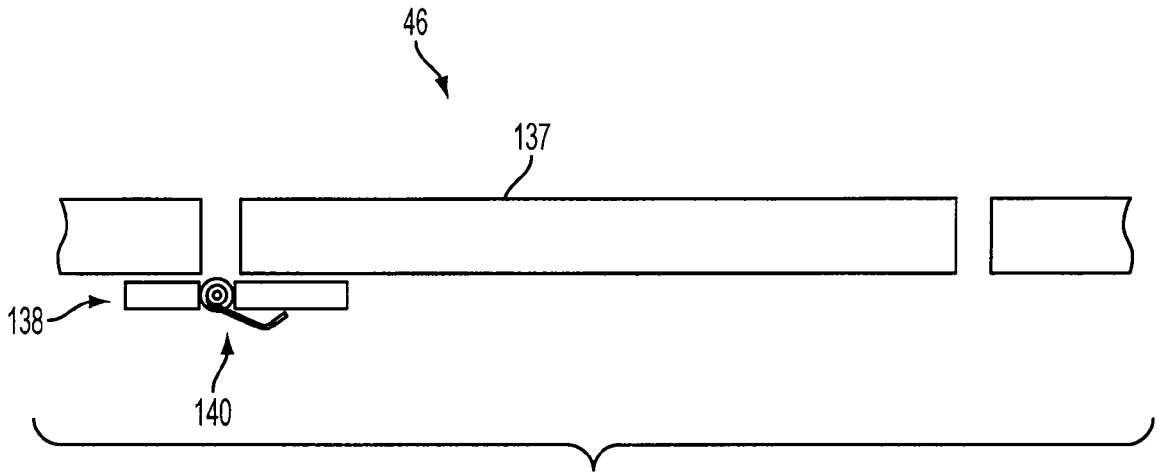
FIG. 26 is an enlarged side elevation view of a door and door controller of a bonus landing in one embodiment of the gaming device.
Figure 27:
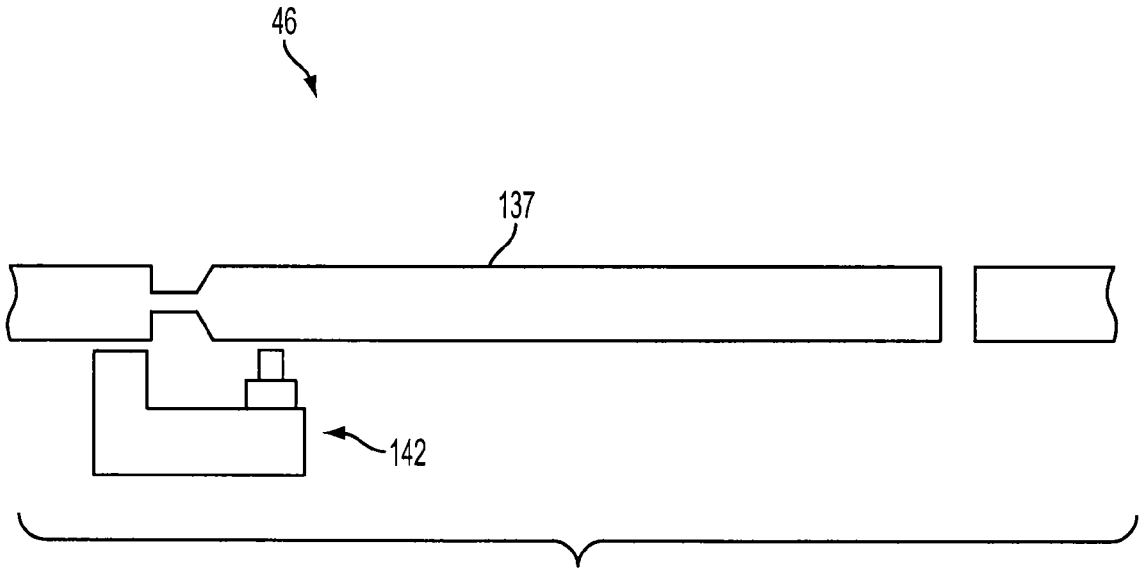
FIG. 27 is an enlarged side elevation view of a door and different door controller of a bonus landing in one embodiment of the gaming device.

For each of the doors 118 and 130, the wheel assembly 12 can include any suitable device or structure which enables such doors to open and close. Referring to FIGS. 26 and 27, each door 118 and 130 is illustrated as door 137. In the example illustrated in FIG. 26, the wheel assembly 12 includes a door control device 138 for door 137, and the door control device 138 includes a spring-activated hinge 140. The hinge 140 predisposes the door 137 to have a closed position. When a ball of a designated weight lands on the door 137, the hinge 140 enables the door 137 to open until the ball passes through the landing 46. Then, the hinge 140 returns the door 137 to its default closed position.

In the embodiment illustrated in FIG. 27, door 137 includes a door actuator or floor door controller 142. The door controller actuator 142 automatically opens and closes the door 118 when designated events occurs. In one embodiment, the door controller 142 includes one or more suitable solenoids, motor and gear assemblies, electromagnetic devices or pneumatic devices. It should be appreciated that the door controller 142 can include any suitable door engager.

4.3 Size of Opening

Figure 28:
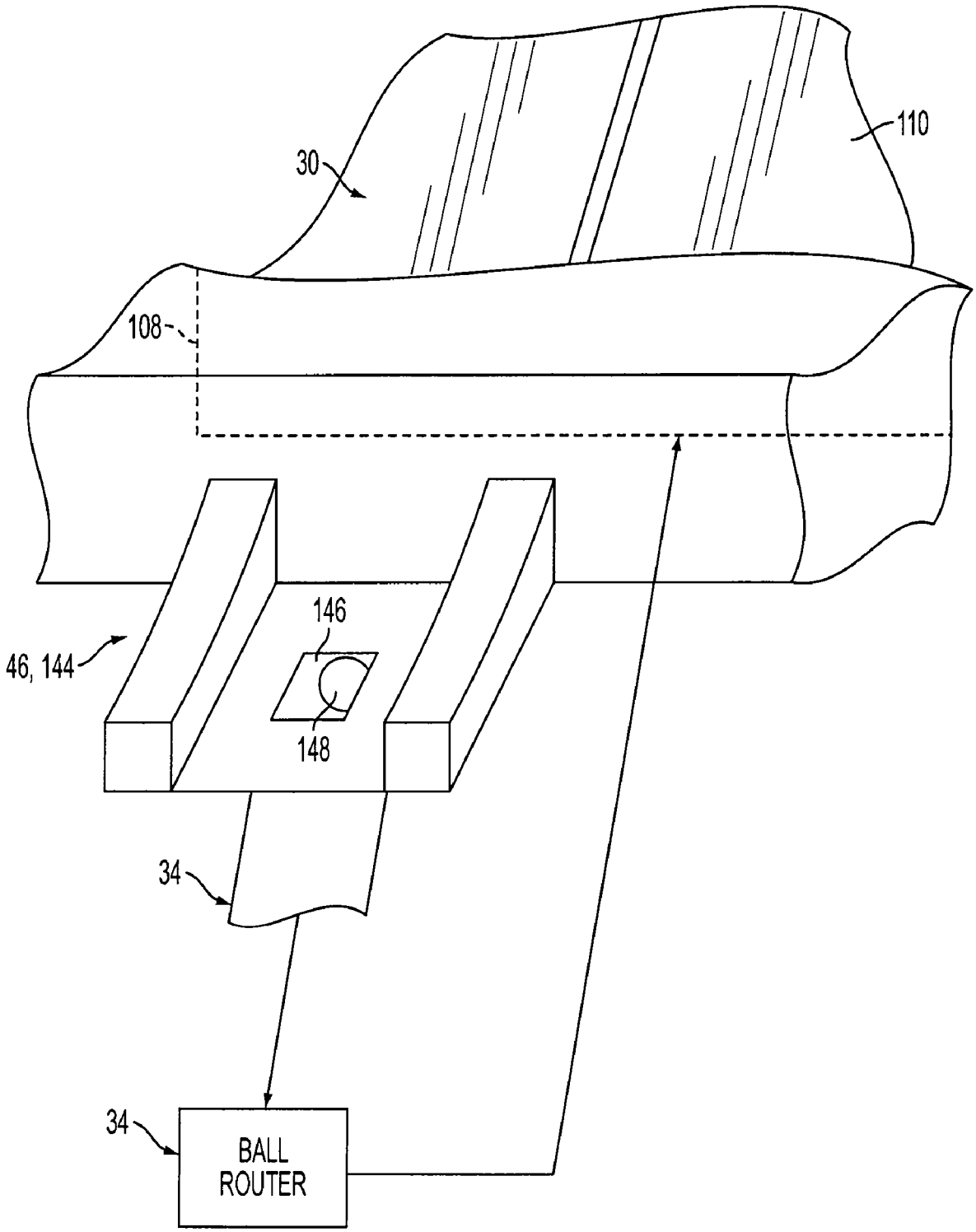
FIG. 28 is an enlarged perspective view of a bonus landing defining a floor opening of one size relative to one ball in one embodiment of the gaming device.
Figure 29:
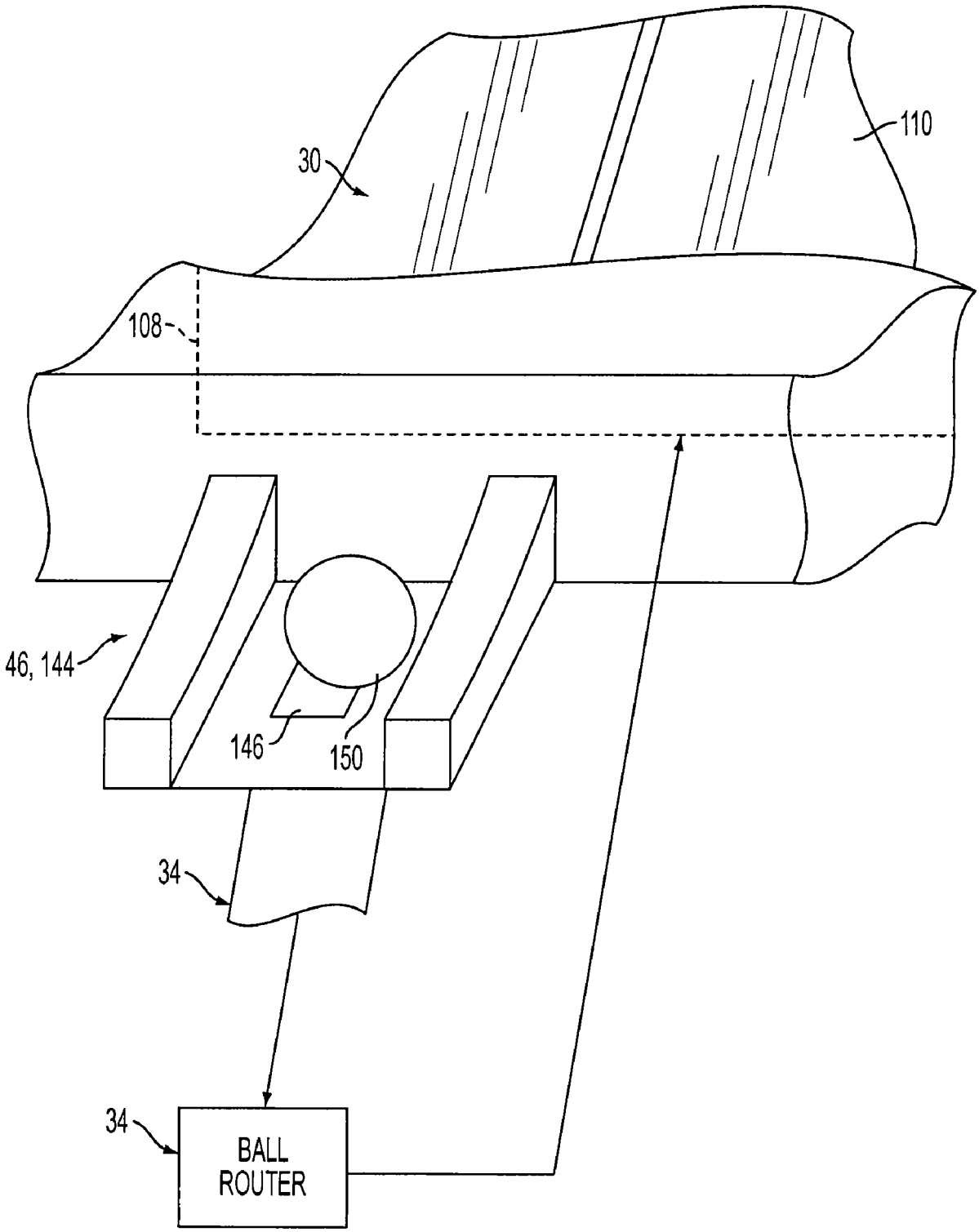
FIG. 29 is an enlarged perspective view of a bonus landing defining a floor opening of the same size relative to a larger ball in one embodiment of the gaming device.

In one embodiment illustrated in FIGS. 28 and 29, the bonus landing 144 defines an opening 146 of a designated size. The size of the opening 146 corresponds to the size of a designated ball 148, such as a designated bonus ball. The bonus ball 148 is sized to fall through the opening 146. In contrast, as illustrated in FIG. 29, the opening 146 is smaller than the size of a designated ball 150, such as a designated game ball. Accordingly, when the ball 150 lands in landing 144, the ball 150 does not pass through the opening 146. In one embodiment, the game landings 144 and bonus landings 46 define an array of differently sized openings which correspond to an array of differently sized balls. As such, a variety of balls may or may not pass through the openings of the landings depending upon their sizes.

In one embodiment, the gaming device 10 includes a color schedule which associates a plurality of different colored balls with a plurality of different outcomes. For example, a blue ball may be a primary game ball, and a red ball may be a bonus ball.

It should be appreciated that the openings in the bonus landings facilitate the simultaneous use of multiple balls in play of the primary game. In one embodiment, the dealer launches multiple balls onto the rotor at the same time. In such embodiment, it is possible that a plurality of balls may stop on the same landing. Because of the openings in the bonus landings, the first ball to land on a bonus landing drops below the floor. The dropping of the first ball makes room for any other ball which may happen to land on that same bonus landing. Accordingly, each player has the opportunity to receive outcomes associated with several balls which may land on the same bonus landing.

In one embodiment, the landing of a ball on a bonus landing 46 triggers a bonus sequence or secondary sequence involving the rotor 28. In this embodiment, the players receive one or more free spins of the rotor 28 while all bets placed remain standing. The winnings are then resolved based on the original bets placed in the primary game. In this embodiment, the free spins do not require an additional wager, and the secondary sequence is integrated into the primary game.

In another embodiment, the wagering station 16 enables the players to place a bonus wager on the bonus symbol 52 corresponding to the bonus landing 46. If a player does so and the ball lands on the bonus landing 46, the player receives a winning or payout associated with that bonus symbol 52, and the player also receives one or more of the free spins described above.

5. Bonus Device

In one embodiment, the wheel assembly 12 is coupled to a bonus device 200. In one embodiment, the landing of a ball on a bonus landing 46 triggers the operation of the bonus device 152. Once activated, the bonus device 152 produces or determines one or more bonus outcomes or secondary outcomes. The bonus device 152 also includes at least one visual aid or output device, such as the visual output device 154 illustrated in FIGS. 1 through 6. The visual output device 154 visually indicates or displays the secondary outcome determined by the bonus device 152.

Figure 30:
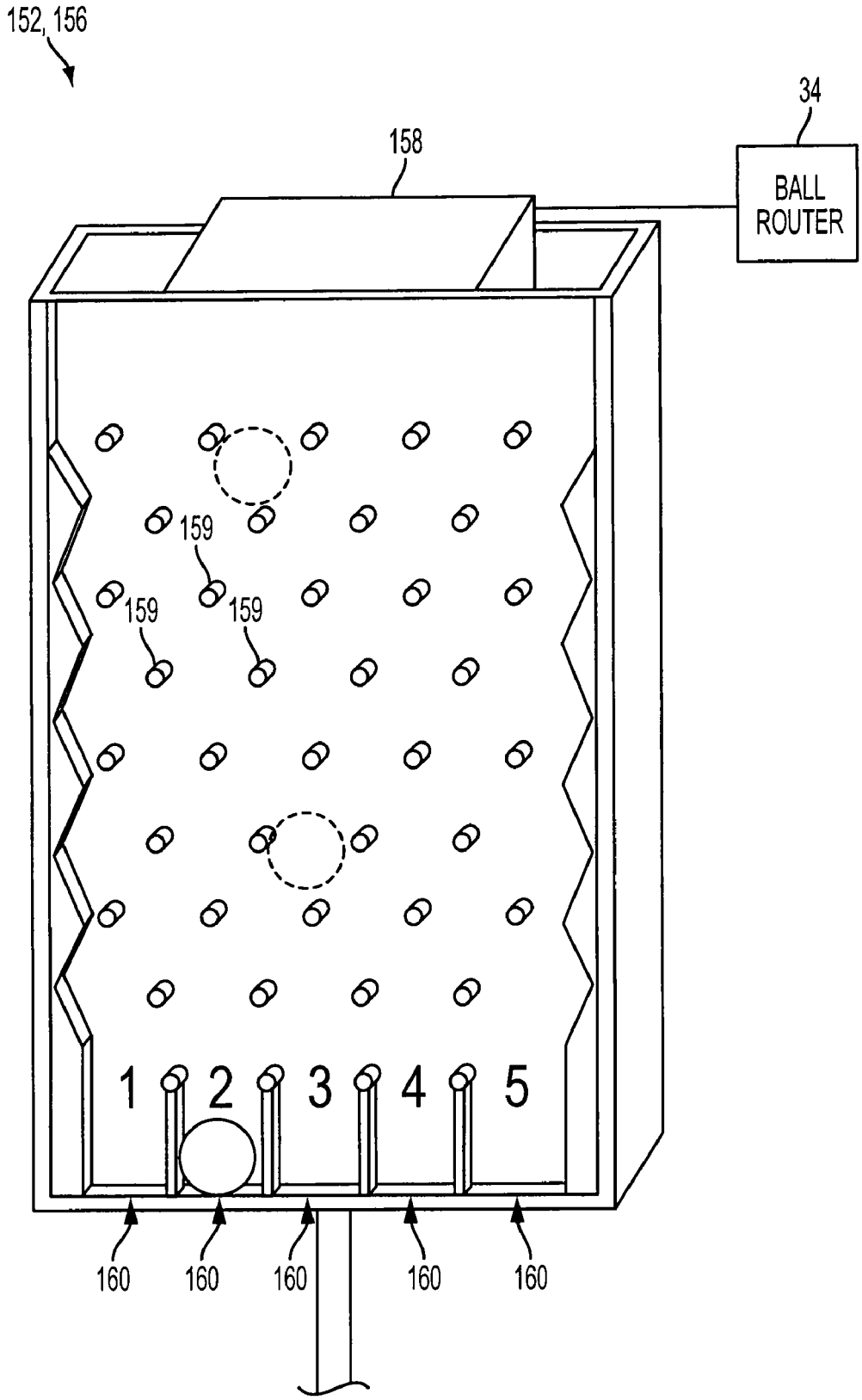
FIG. 30 is a front elevation view of a mechanical bonus device of one embodiment of the gaming device.

It should be appreciated that the bonus device 152 can include any suitable apparatus which is operable to determine a secondary outcome, including, but not limited to, a mechanical outcome generating device, an electro-mechanical outcome generating device, a pseudo-random outcome generating device and a computer. In one embodiment illustrated in FIG. 30, the wheel assembly 12 is coupled to a mechanical bonus device 156. In this example, the bonus device 156 includes a ball support, such as a ball receiver 158. The ball receiver 158 is coupled to the ball router 34. When a ball falls through a bonus landing 46, the ball router 34 routes that ball to the ball receiver 158. The ball then travels through the bonus device 156 which, in this example, includes the structure of a quincunx board or pachinko apparatus. The pegs 159 in the bonus device 156 randomize the placement of the ball into one of the outcome slots 160. The bonus device 156 includes a designated outcome or award associated with each one of the outcome slots 160.

Figure 31:
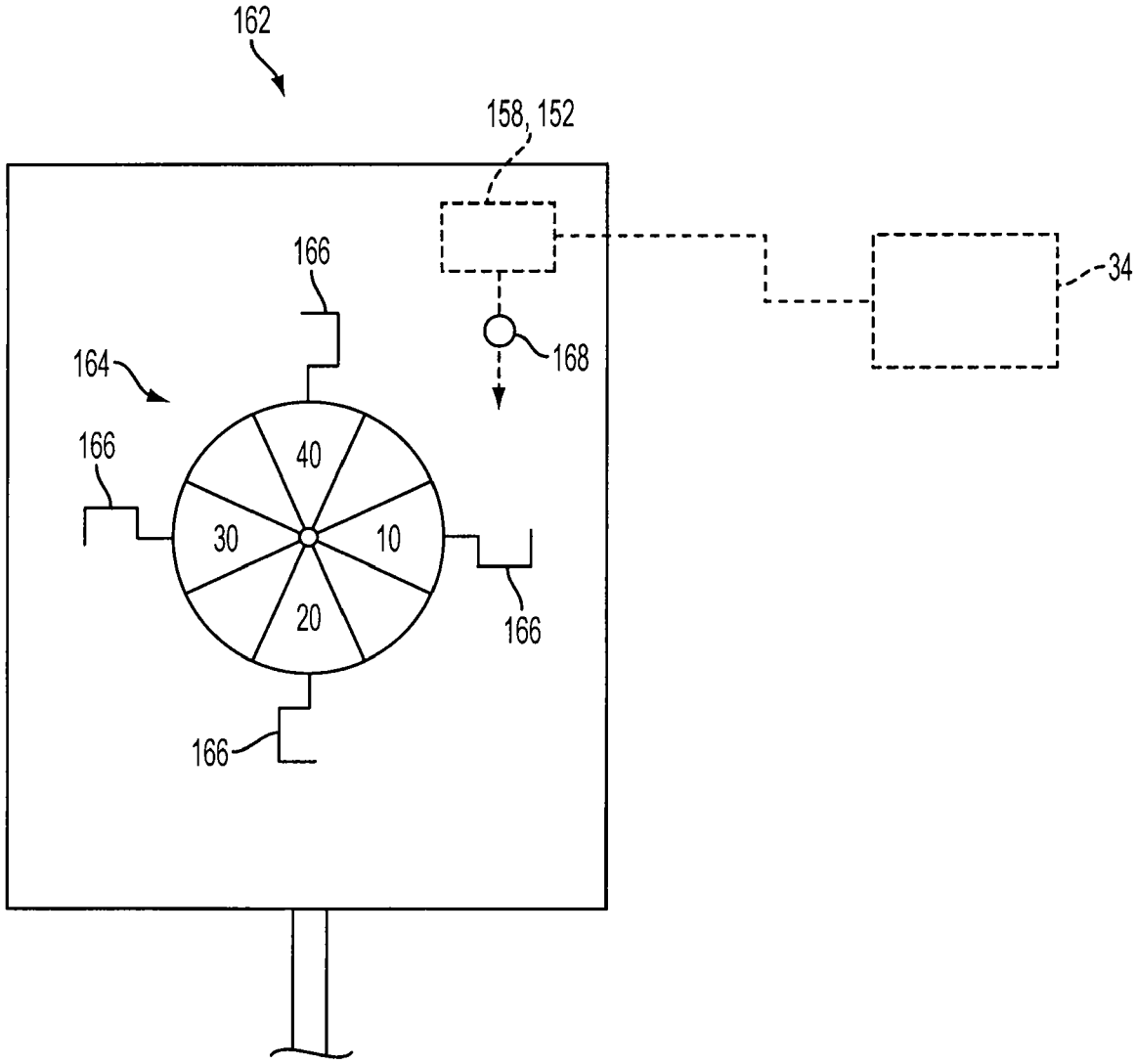
FIG. 31 is a front elevation view of a different mechanical bonus device of one embodiment of the gaming device.

The bonus device 162 illustrated in FIG. 31 is the same as the bonus device 156 except the bonus device 162 includes a wheel apparatus 164 instead of a quincunx structure. In this example, the wheel apparatus 164 includes four ball catchers 166, and each ball catcher 166 is associated with a different award. As the wheel apparatus 164 rotates, the ball 168 drops into one of the catchers 166. The players each receive the award associated with the catcher which receives the ball 168. In one embodiment described below, the gaming device 10 can modify such award depending upon the amount of the player's wager in the primary wheel game.

Figure 32:
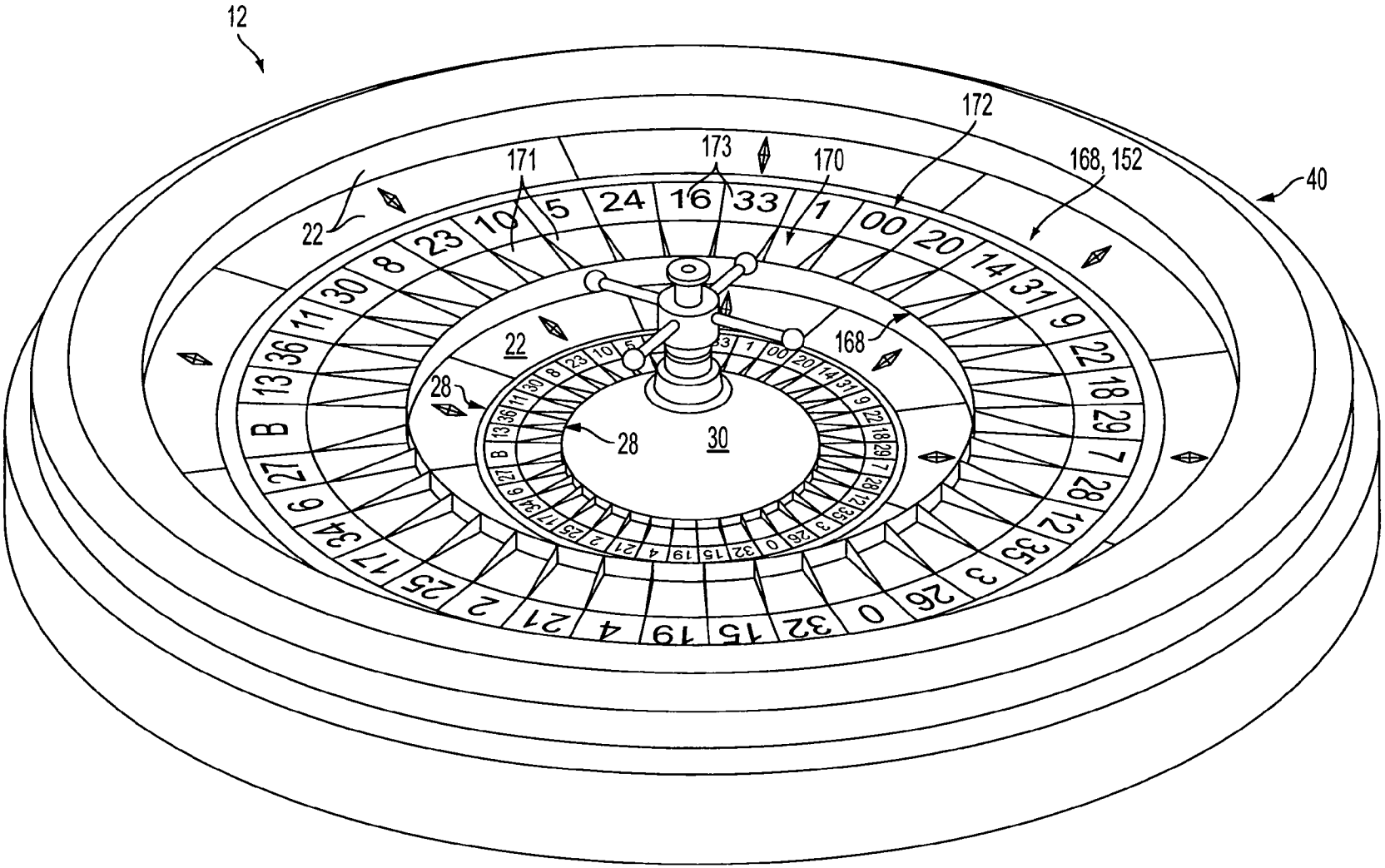
FIG. 32 is a top perspective view of a wheel assembly having a secondary rotor in one embodiment of the gaming device.

In one embodiment illustrated in FIG. 32, the wheel assembly 12 includes a bonus rotor or secondary rotor 168 as the bonus device 152. The secondary rotor 168 includes a circular landing section 170 adjacent to a circular symbol section 172. The landing section 170 includes a series of landings 171 for the ball in play, and the symbol section 172 includes a series of symbols 173 that correspond to the landings 171. In one example, when a ball falls through a bonus landing 46 of the rotor 28, the dealer spins the secondary rotor 168, and the ball router 34 routes that ball to the landing section 170 of the secondary rotor 168. The landing of the ball on one of the landings 171 on the secondary rotor 168 determines the secondary outcome for the players.

In another embodiment, the wheel assembly 12 has a secondary landing section (not shown) which: (a) is permanently fixed to the wall or bowl 22; (b) encircles the rotor 28; and (c) has a ring or circle of landings concentrically positioned adjacent to or about the rotor 28. In this embodiment, the bowl 22 has a path or passageway leading from one or more of the landings 44 and 46 of the rotor 28 to such non-moving secondary landing section. A ball landing in one of these landings 44 or 46 will travel to one of the landings in the secondary non-moving landing section. The rotational position of the rotor 28 relative to such non-moving landing section determines which of the landings in the non-moving landing section will receive such ball. For example, a landing X of the rotor 28 may stop adjacent to a landing Y or Z of the secondary non-moving landing section, depending upon when the rotor stops spinning. If such landing X stops adjacent to landing Y, any ball landing in landing X will travel into landing Y, not landing Z.

Figure 33:
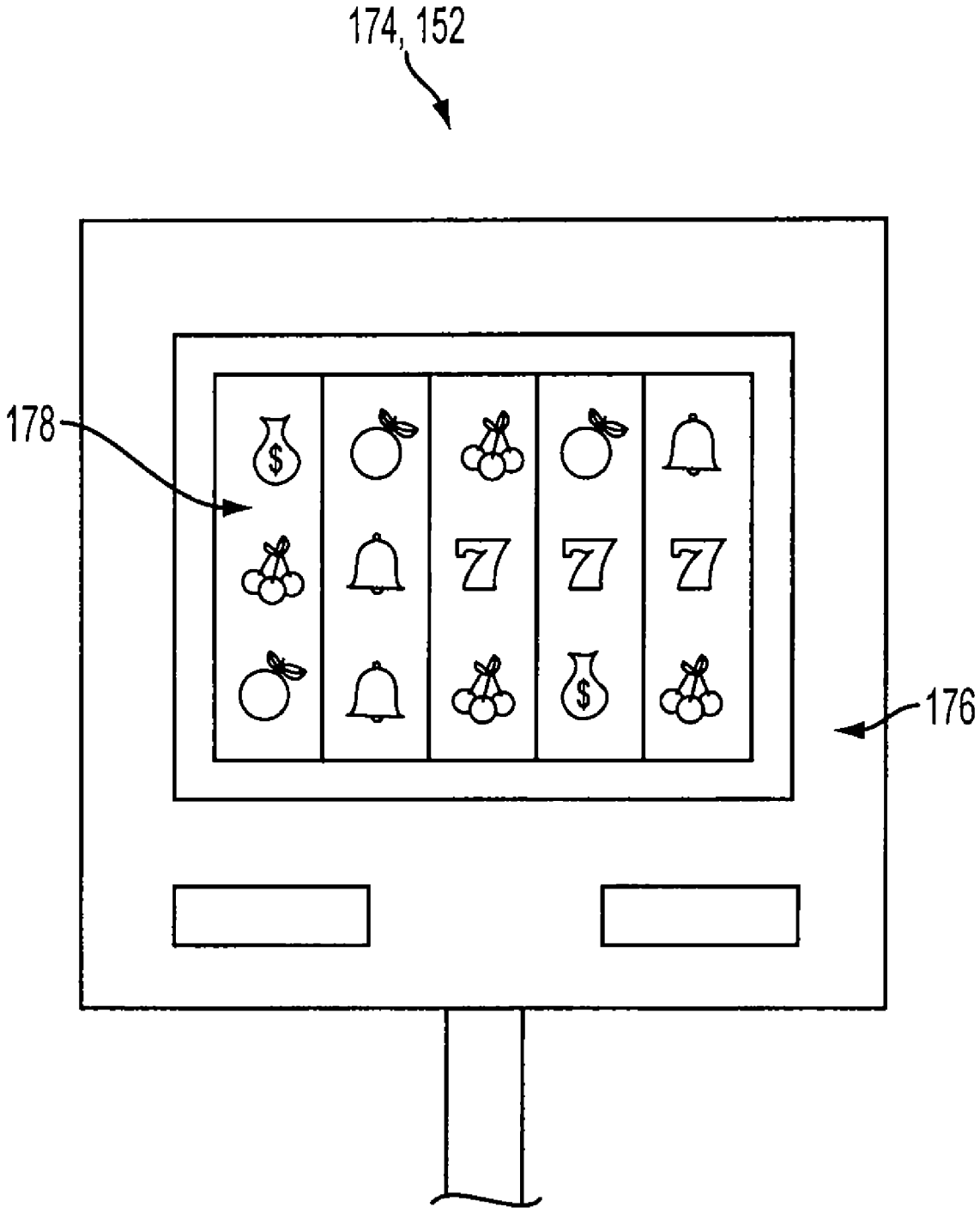
FIG. 33 is a front elevation view of an electronic bonus device in one embodiment of the gaming device.

In another embodiment illustrated in FIG. 33, the wheel assembly 12 is coupled to a bonus device 174. Here, the bonus device 174 includes a display device 176 controlled by the processor 218 illustrated in FIG. 39. The processor 218 determines the secondary outcome based on a computer program, and the display device 174 displays images 178 which correspond to the determined outcome. In the illustrated example, the images include five simulated or virtual reels of a slot game. In operation, when a designated triggering event occurs in the primary wheel-based game, the processor 218 of the bonus device 174 determines the secondary outcome. Next, the display device 176 displays a combination of symbols on the reels which represents that outcome.

Figure 34:
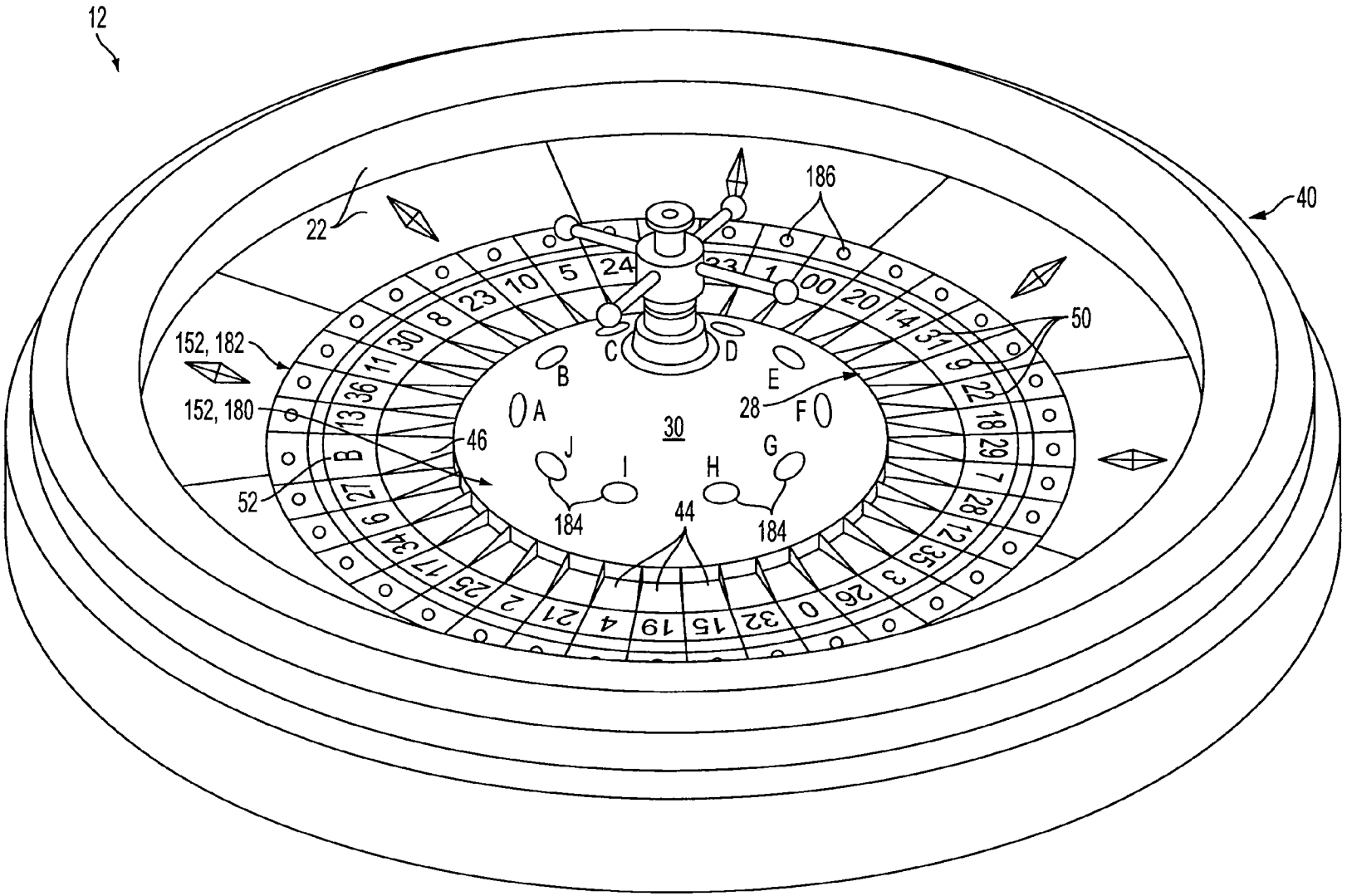
FIG. 34 is a top perspective view of a wheel assembly incorporating two bonus device in one embodiment of the gaming device.

In one embodiment illustrated in FIG. 34, the gaming device 10 includes bonus devices 180 and 182 incorporated into the wheel assembly 12. Bonus device 180 includes a plurality of light sources 184 controlled by a processor. Each light source 184 is associated with a letter, as illustrated in FIG. 34. When a ball lands in a bonus landing 46 or when any other bonus triggering event occurs, the light sources 184 are sequentially illuminated. A processor 218 causes only one of the light sources 184 to be illuminated after the period of time elapses. The final illuminated light source 184 corresponds to the letter associated with that light source which, in turn, corresponds to a designated secondary outcome. This secondary outcome can be the same as or different than the primary game outcome.

With continued reference to FIG. 34, the bonus device 182 includes a ring of light sources 186 controlled by a processor 218. The light sources 186 encircle the outer circular section 48. Each light source 186 is adjacent to and aligned with a game symbol 50 or a bonus symbol 52. In this embodiment, the wheel assembly 12 includes an alignment assembly (not shown) coupled to the rotor 28. The alignment assembly includes a gear assembly or stopper which keeps the game symbols 50 and bonus symbol 52 in alignment with the light sources 186. Accordingly, when the rotor 28 stops spinning, each game symbol 50 and bonus symbol 52 corresponds to one of the light sources 186. When a bonus triggering event occurs in the primary game, the processor 218 causes the light sources 186 to sequentially illuminate on and off so as to simulate a chase pattern. Eventually, the chase simulation terminates and one of the light sources 186 remains illuminated. The illuminated light source 186 functions as an indicator for the game symbol 50 or bonus symbol 52 adjacent to such illuminated light source 186. The bonus device 182 generates the secondary outcome associated with the indicated symbol.

In another embodiment of FIG. 34, there may be no mechanical device present to assure the alignment of the game symbols 50 and the bonus symbol 52 with the light sources 186. Rather, an external device, which could include a human dealer's hand, could perform the alignment prior to the activation of the secondary outcome display.

Figure 35:
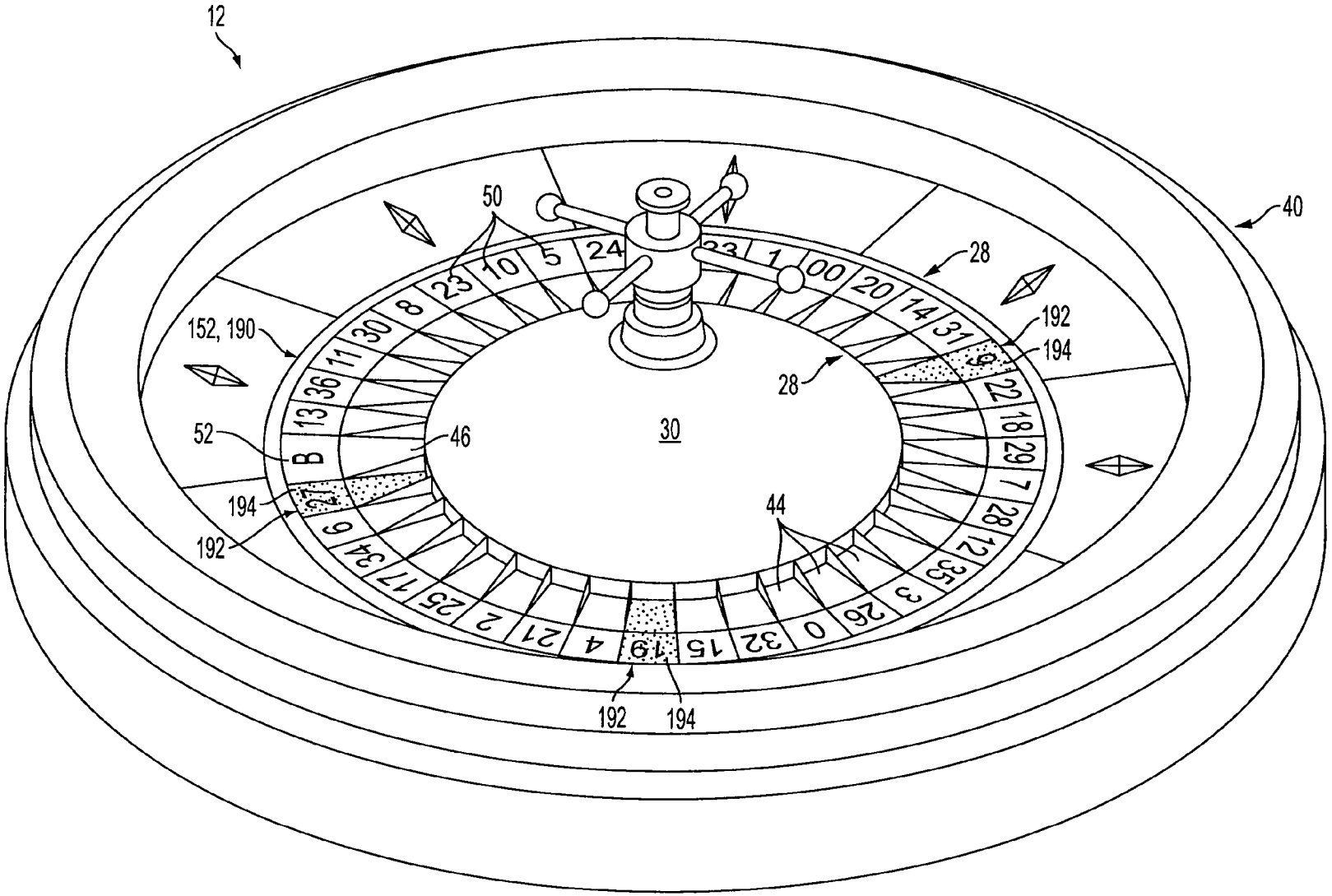
FIG. 35 is a top perspective view of a wheel assembly incorporating a plurality of light sources into the rotor of one embodiment of the gaming device.

In another embodiment in FIG. 35, the gaming device 10 includes a bonus device 188. The bonus device 188 includes a plurality of light sources under control of the processor 218. There is a light source mounted within or underneath: (a) each game landing 44 and each bonus landing 46; (b) each game symbol 50 and each bonus symbol 52; or (c) each landing-symbol set. Accordingly, the processor of the bonus device 190 is operable to selectively eliminate different game landings 44, bonus landings 46, game symbols 50 and bonus symbols 52. In one example illustrated in FIG. 35, the processor 218 causes landing-symbol sets 192 to be illuminated during operation of the primary game. This backlighting or illumination of sets 192 identifies sets 192 as specials sets associated with special outcomes, such as secondary outcomes. In one example, the landing of a ball on any landing of a set 192 may result in the doubling of the award associated with the illuminated numeral 194 in such set. It should be appreciated that the bonus or secondary functionality and outcomes in this embodiment can be implemented entirely through the illumination process of the bonus device 190. Furthermore, the bonus or secondary functionality can be modified by reprogramming the processor 218 to highlight different symbols or landings. An additional advantage of this arrangement is to facilitate the game operator in controlling or managing the expected long-term profitability of the game by the increase or reduction of the frequency and extent of such bonus lighting.

Figure 36:
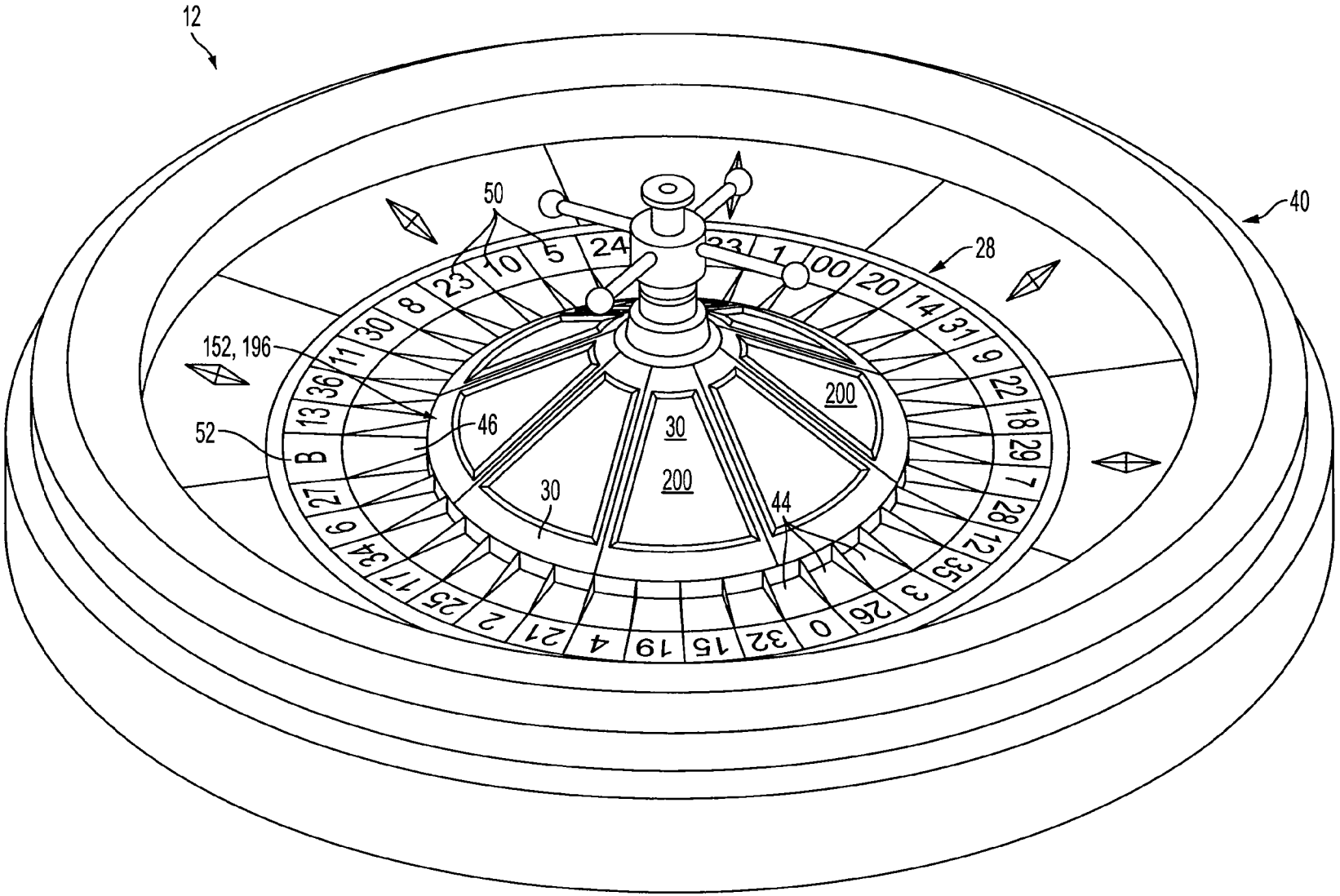
FIG. 36 is a top perspective view of a wheel assembly illustrating a plurality of display devices mounted on the cone in one embodiment of the gaming device.

In one embodiment illustrated in FIG. 36, the wheel assembly 12 includes a bonus device 196. Here, the bonus device 196 includes a plurality of display devices 200 controlled by the processor 218. Each display device 200, mounted on the cone 30, is operable to display a plurality of images under the control of the processor 218. The images can include representations of numerals, values, symbols or awards. When a designated triggering event occurs in the primary game, the processor 218 determines the secondary outcome and causes one or more of the display devices 200 to indicate the determined outcome to the player. In this embodiment, each display device 200 can include a liquid crystal display (LCD) device or any other suitable display apparatus.

Figure 37:
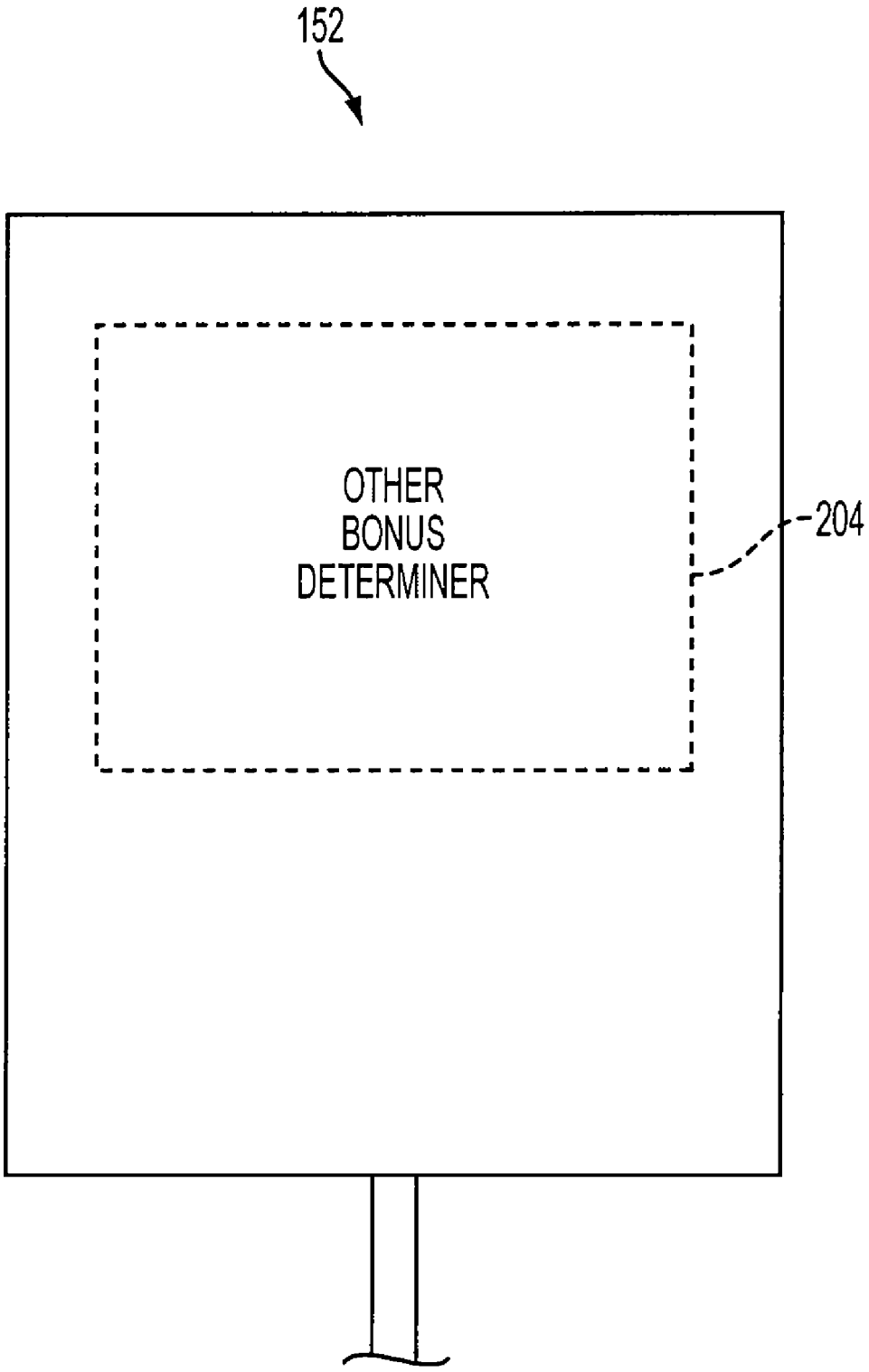
FIG. 37 is a diagrammatic front elevation view of a bonus device in one embodiment of the gaming device.

Referring to FIG. 37, it should be appreciated that bonus device 152 of the gaming device 10 can include any apparatus which includes a bonus determiner or secondary outcome determiner 204. As described above, the secondary outcome determiner 204 can include a mechanical outcome determination assembly, a program-based computerized outcome determiner or a combination of such outcome determiners. It should be appreciated that any suitable event in the primary wheel-based game can trigger the play of the bonus device 152, including, but not limited to, a designated number of balls falling through a bonus landing, a designated sized ball falling through a primary game landing or a bonus landing, the reaching of a threshold win level or the meeting of any other designated condition. It should also be appreciated that the secondary outcome produced by the bonus device 152 can be the same as one of the outcomes available in the primary game, a modification of one or more of the outcomes available in the primary game or an entirely different outcome.

Furthermore, it should be appreciated that the bonus or secondary outcome can vary with the amount of wager or bet placed by each player. In one embodiment, for example, the gaming device 10 includes a pay table or pay schedule which associates an increasing magnitude of bet values with an increasing magnitude of bonus outcomes. In one example, the gaming device 10 provides a player with double the determined bonus outcome if the player placed a bet of twenty or higher in the primary wheel game. Also, the gaming device 10 provides a player with triple the determined bonus outcome if the player placed a bet of thirty or higher in the primary wheel game. In another embodiment, the game rules require the players to place a threshold bet level before qualifying to receive any bonus or secondary outcome that may be generated by the gaming device 10.

Figure 38:
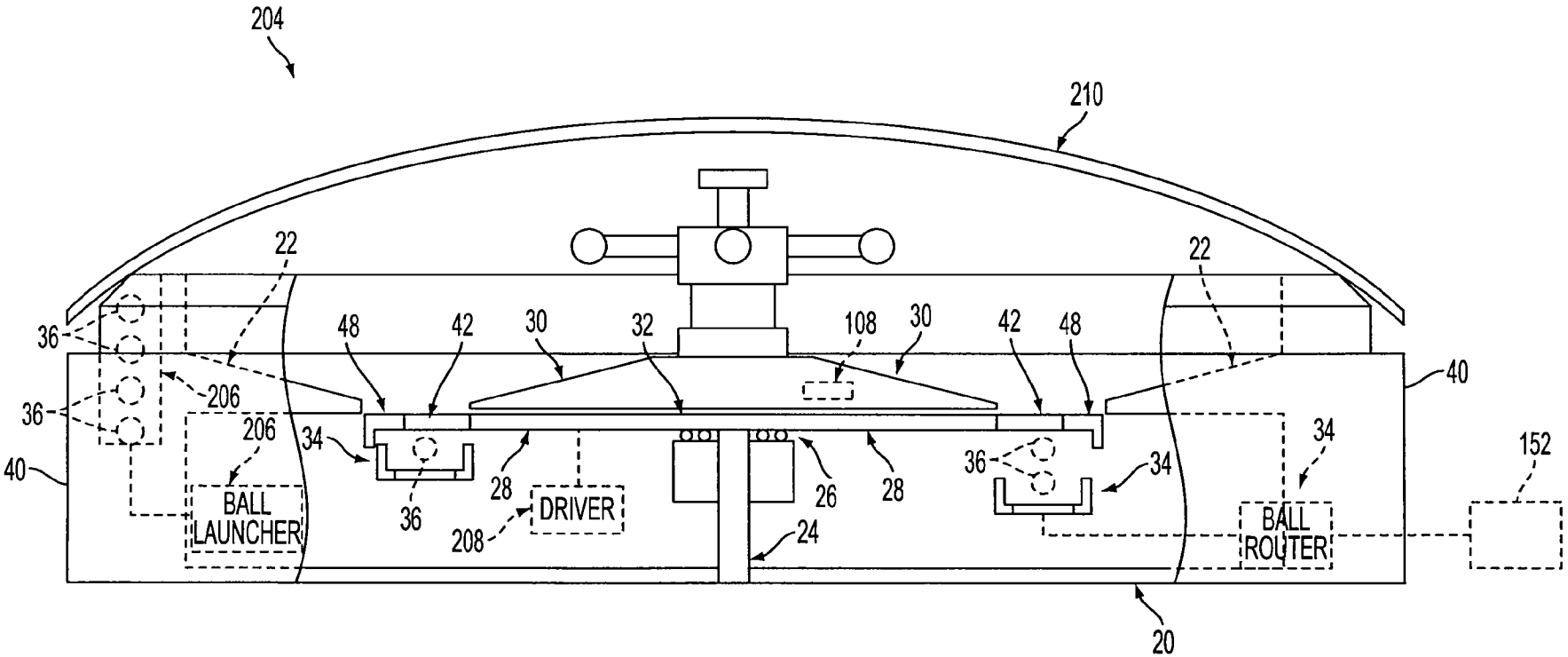
FIG. 38 is a break away diagrammatic view of a portion of the wheel assembly of one embodiment of the gaming device illustrating the rotor driver and ball launcher.

In one embodiment illustrated in FIG. 38, the gaming device 10 includes a wheel assembly 204. Here, the wheel assembly 204 includes all of the components, structure and functionality of the wheel assembly 12 in addition to a ball launcher 206, a rotor driver 208 and a removable cover 210. The ball launcher 206, which holds a plurality of balls 36, includes a ball firing or ball launch apparatus. In one embodiment, the ball launcher 206 includes a spring-activated rod, plunger or ball engager (not shown). Operation of the ball engager by a human dealer launches the balls, one-by-one, onto the sloped wall 22. The ball launcher 206, in another embodiment, is operable to automatically launch balls 36 onto the sloped wall 22 when designated events occur in the primary game or bonus sequence.

In another embodiment of this invention, the gaming device 10 includes a device which holds a plurality of balls, including at least one primary ball and one secondary ball. Such device randomly selects one of these balls to be used in an upcoming game following a preceding game. The game rules for the upcoming game or the corresponding payouts are affected by whether the ball is a primary ball or a secondary ball. In one example, such device includes a ball collector with nine silver balls and one orange ball. The random selection of a silver ball in a game play would lead to a primary type of roulette game. The random selection of an orange ball in a game play would lead to a secondary type of roulette game. In such secondary type of roulette game, all payouts are, for example, double their normal schedule.

The rotor driver 208 includes a motor coupled to a drive assembly which, in turn, is coupled to the rotor 28. The rotor driver 208 also includes one or more input devices which are accessible to the dealer or players. When the rotor driver 208 receives a designated input signal, the driver 208 automatically causes the rotor 28 to rotate. After the rotor 28 begins to rotate in one direction, one or more balls 36 are launched onto the sloped wall 22 in the opposite direction. This embodiment is suitable for automated play of the gaming device 10. Though the wheel assembly 204 can be monitored or operated by a human dealer, the wheel assembly 204 can also operate itself independent of a human dealer.

Though the wheel assembly 12 is at times described herein as having a moving rotor 28, it should be appreciated that the wheel assembly can have a non-moving member instead.

Such non-moving member, in one embodiment, has the same shape as the rotor 28. Like rotor 28, such non-moving member carries the inner circular section 42 and the outer circular section 48. In this embodiment, one or more balls are launched to travel along such non-moving member.

Figure 39:
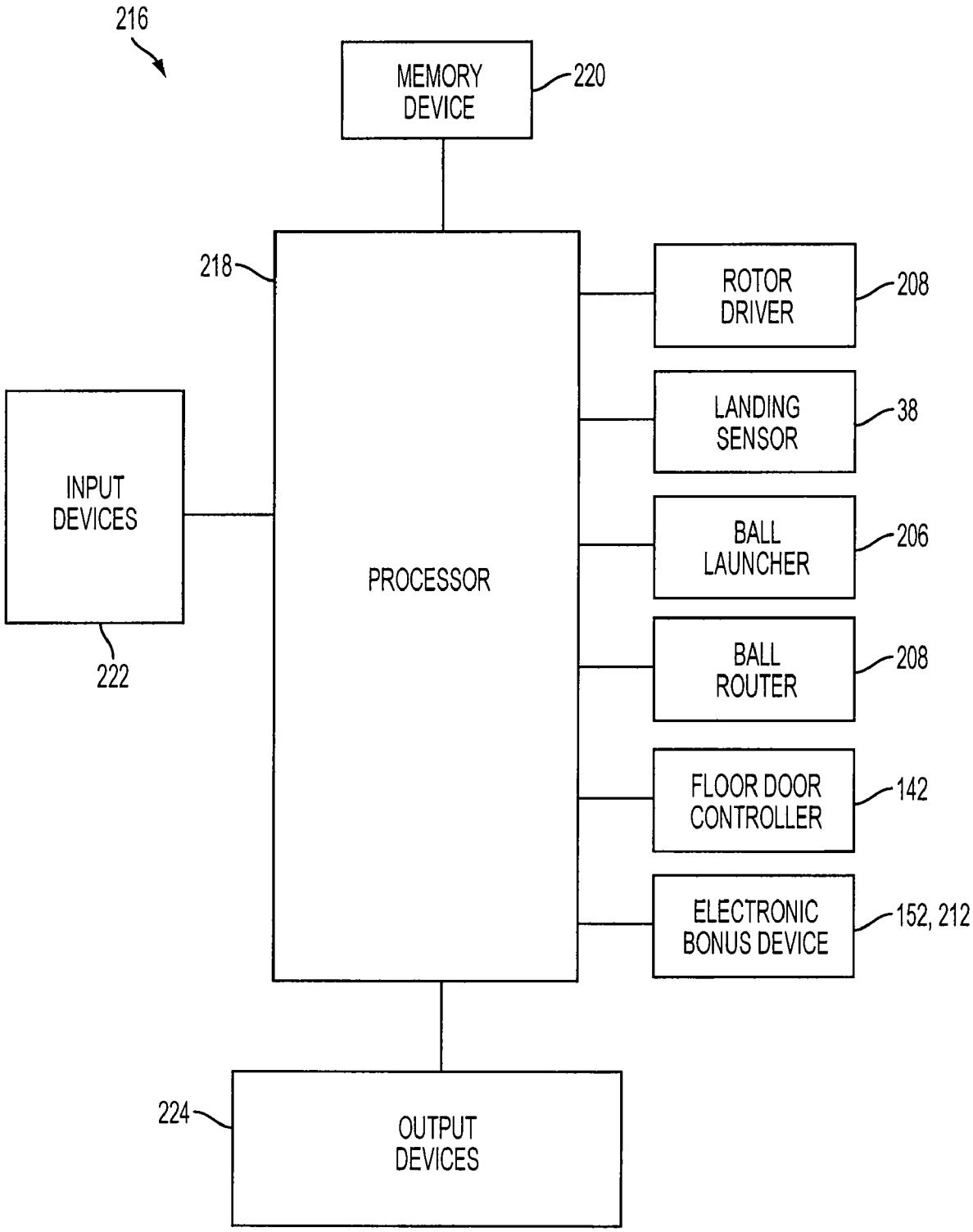
FIG. 39 is a schematic view of the electronic configuration of one embodiment of the gaming device.

In one embodiment illustrated in FIG. 39 where the bonus device 212 is electronic, the gaming device 10 includes electronic configuration 216. In configuration 216, the gaming device 10 includes: (a) one or more processors 218 coupled to a memory device 220; (b) at least one input device 222; and (c) at least one output device 224. The processor 218 is also operatively coupled to the rotor driver 208, the landing sensor 38, an electronic embodiment of the ball launcher 206, the ball router 208, the floor door controller 210 and the electronic bonus device 212.

6. Game System

6.1 In General

In one embodiment, the operation of the primary game of the gaming device is based on a system of game play corresponding to the roulette game. In one embodiment, the object of the game system is for each player to anticipate where the ball will land on the wheel by placing desired bets. The game system is a multi-player, multi-bet system which enables a plurality of players to simultaneously place bets.

In operation, each player places one or more bets using the wager station 16 adjacent to the wheel assembly 12. After all bets a placed, the dealer spins the wheel and launches the ball to start the primary game. The ball eventually comes to a stop adjacent to one of the numbers or symbols on the wheel. If any player has a bet covering that number or symbol, that player wins an award in the primary game. The dealer then clears any losing bets from the table. Any winning bets are paid according to a designated paytable.

6.2 Betting Process

To play the primary game, each player places one or more chips of desired values on desired spots on the betting layout 16. The players can control their risk and potential award levels by selecting one or more of the bet types set forth below.

(a) Inside Bets

Each player can place a single bet to cover between one and six numbers as follows:

Straight Bet: Place a chip on one number on the betting layout.

Split Bet: Place a chip between two adjacent numbers on the betting layout.

Trio Bet: Place a chip at the edge of a row to bet on the three numbers along a row on the betting layout.

Corner Bet: Place a chip on the corner of four adjacent numbers on the betting layout.

Five Number Bet: Place a chip on the edge of the betting layout between the two adjacent rows of numbers containing 0, 00 and 1-3.

Six Number Bet: Place a chip on the edge of the betting layout between two adjacent rows of numbers.

(b) Outside Bets

Each player can place a bet to cover an entire category of results as follows:

(i) Even Money Bets

Even: Any even valued number (2, 4, 6, etc.) excluding 0 and 00.

Odd: Any odd valued number (1, 3, 5, etc.).

Red: Any red number.

Black: Any black number.

Low (1-18): Any number 18 or lower, excluding 0 and 00.

High (19-36): Any number 19 or greater.

(ii) Two to One Pay Bets:

Dozens Bet—a dozen bet offers three different sets of table rows to bet on as follows:

1st 12: Any number 1 through 12.

2nd 12: Any number 13 through 24.

3rd 12: Any number 25 through 36.

Column Bet—a column bet is a bet on a column of numbers in the betting layout.

6.3 Double Bonus Spin

As described above, in one embodiment the wheel includes one or more bonus landings associated with secondary outcomes. In one embodiment, if the ball lands on a bonus landing, all of each players' wagers stand, and each player qualifies for a free double bonus spin. Put another way, each player gains the benefit of another spin of the wheel without having to make an additional wager. This provides the players with an additional opportunity to win their original bets in the primary game.

During the double bonus spin, the wheel spins and the ball rolls on the spinning wheel. Eventually, the ball lands on one of the wheel landings. If the ball stops on a landing corresponding to a standing wager, the players who made such wager win such wager. This provides an additional win opportunity within the primary game.

In the primary game, each player has the option of placing a wager on a bonus symbol of the wheel. If the ball stops on a landing adjacent to such bonus symbol, such player wins the bet and receives a payout associated with such bonus landing. In addition, such player receives the free double bonus spin described above.

If, during such double bonus spin, the ball lands on a bonus-indicated landing, each player earns a relatively high payout. If two balls land on a bonus-indicated landing during such bonus spin, each player receives an even higher payout.

In one embodiment, the gaming device launches two balls during the double spin. The openings in the landings described above enable the two balls to move along the wheel and drop through landing openings without blocking access to any landing. Accordingly, the landing of one ball on a landing does not affect or block the landing of the other ball in the same landing.

In one embodiment, a bonus-indicated landing has one and one-half the width of the other landings. Accordingly, the ball is one and one-half times more likely to land on such bonus-indicated landing than the other landings. This provides different landing probabilities associated with different landings of the wheel, and these landing probabilities affect the odds of a ball landing in a game landing versus a bonus landing.

7. Additional Embodiments of Gaming Device

In one embodiment, some or all of the components, structure, functionality and other elements of the wheel assembly 12, wager station 16, balls 36, bonus device 152 and game system described above (collectively referred to as "wheel-related elements") have a video, simulated, animated or virtual form, where such elements are formed by computerized graphical representations of actual physical objects. In such embodiment, the wheel-related elements may be implemented in various configurations for gaming machines or gaming devices, including, but not limited to: (1) a dedicated gaming machine or gaming device, wherein the computerized instructions for controlling any games (which are provided by the gaming machine or gaming device) are provided with the gaming machine or gaming device prior to delivery to a gaming establishment; and (2) a changeable gaming machine or gaming device, where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by a central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 40:
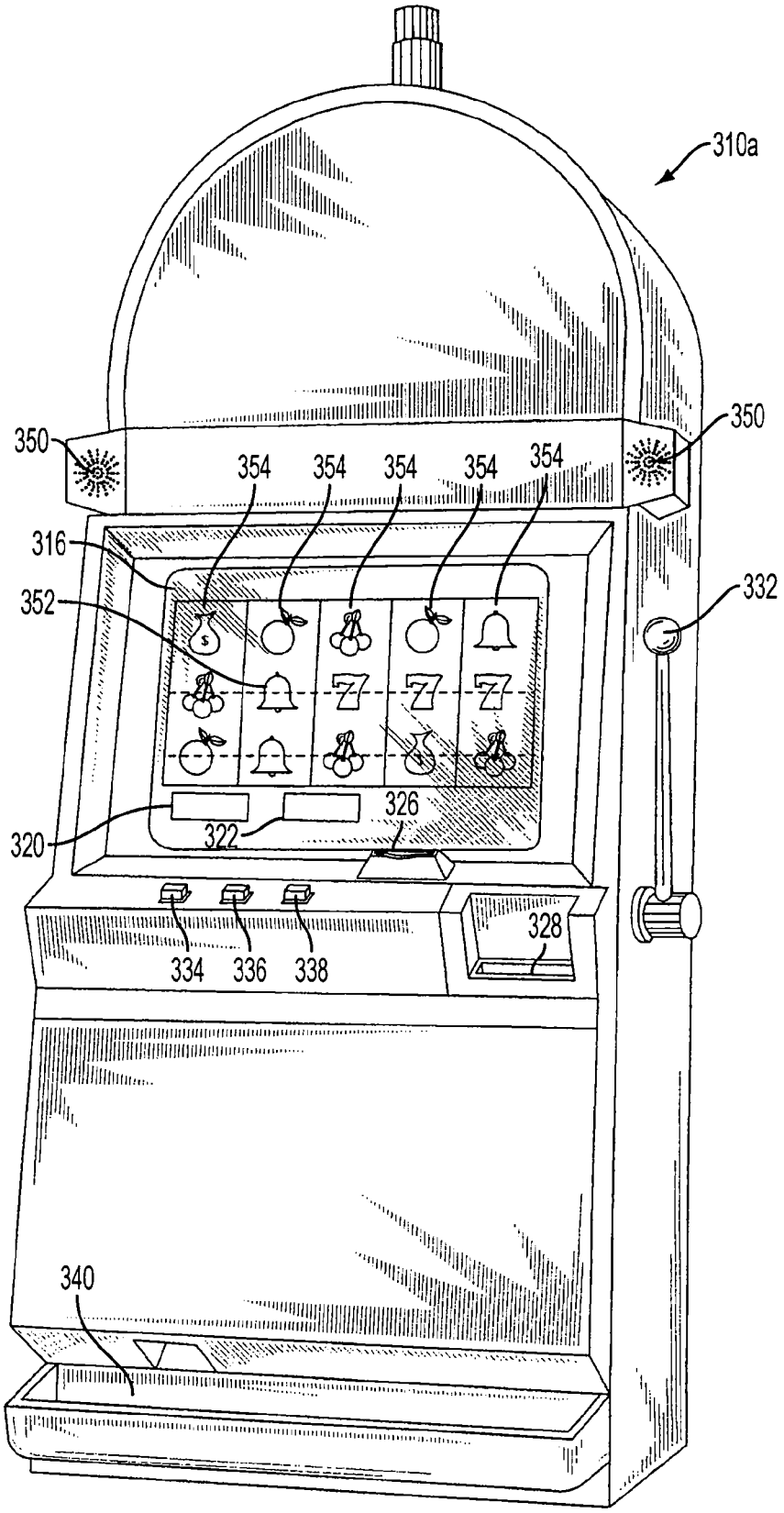
FIG. 40 is a front perspective view of one embodiment of the gaming device.
Figure 41:
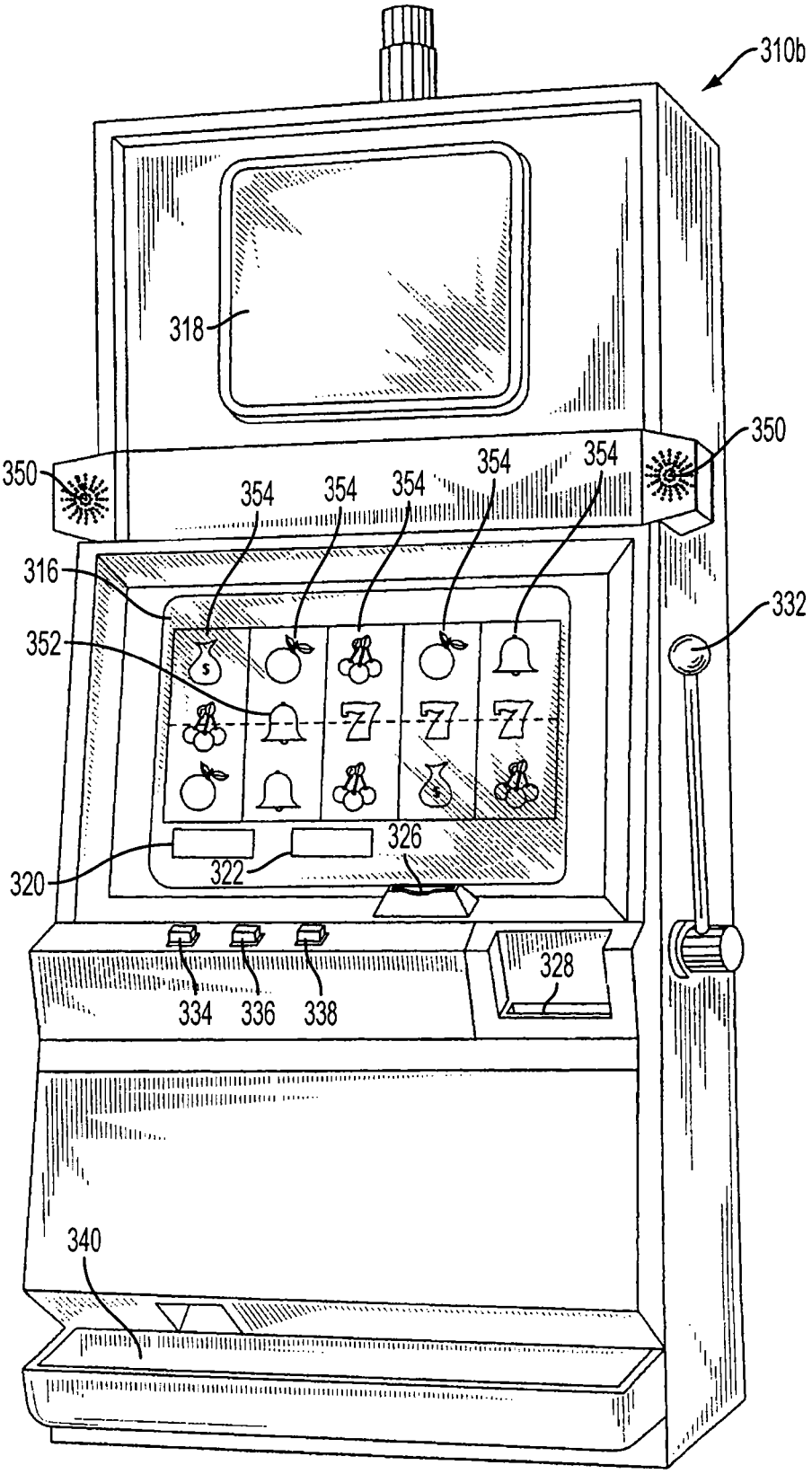
FIG. 41 is a front perspective view of another embodiment of the gaming device.

Two example alternative embodiments of a gaming device which implements the wheel-related elements are illustrated in FIGS. 40 and 41 as gaming device 310*a* and gaming device 310*b*, respectively. Gaming device 310*a* and/or gaming device 310*b* are generally referred to herein as gaming device 310.

7.1 Cabinet/Housing

In the embodiments illustrated in FIGS. 40 and 41, gaming device 310 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 40 and 41, the gaming device may have varying cabinet and display configurations.

7.2 Electronic Configuration

Figure 42:
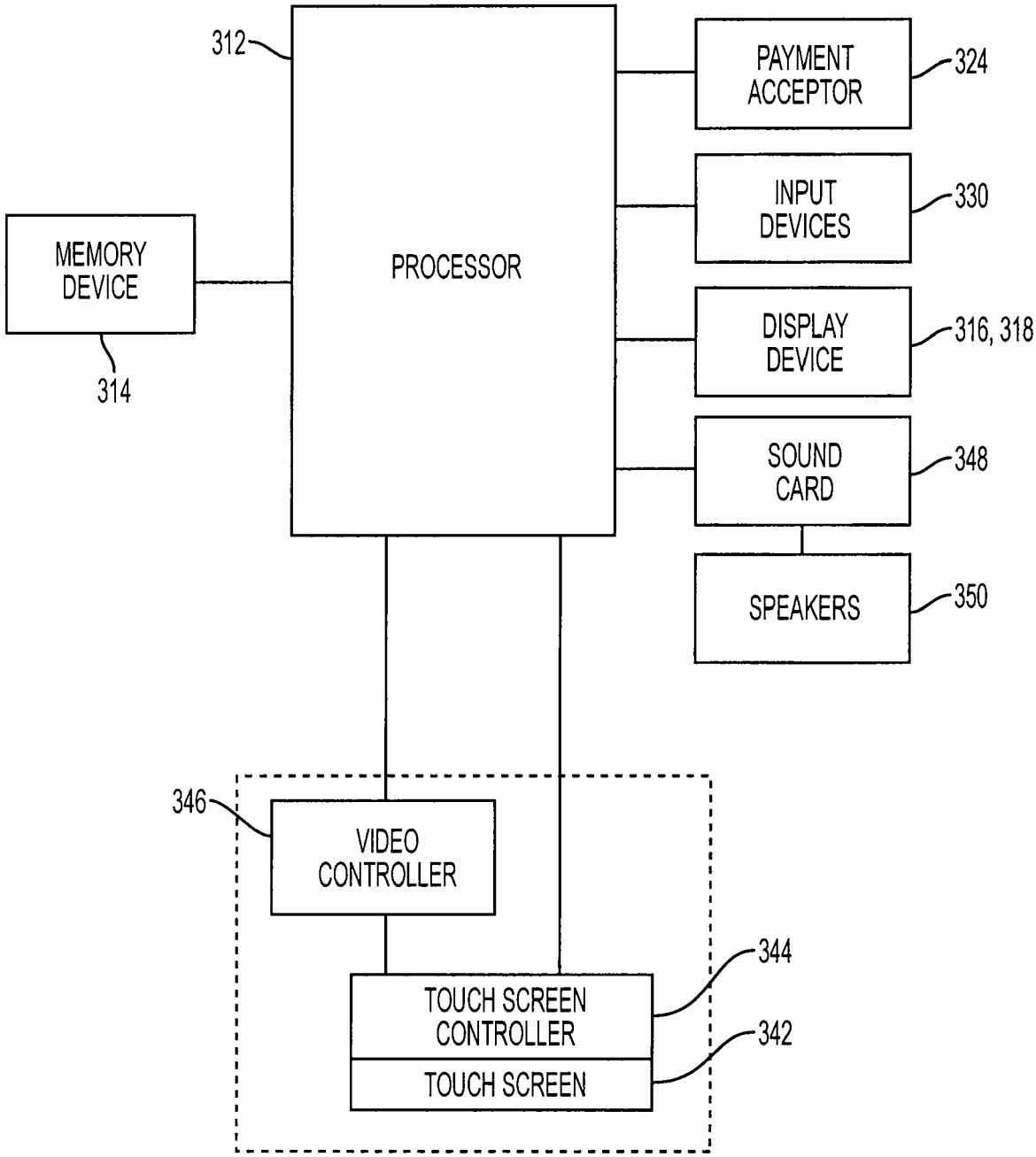
FIG. 42 is a schematic view of another electronic configuration of one embodiment of the gaming device.

In one embodiment, as illustrated in FIG. 42, the gaming device preferably includes at least one processor 312, such as a microprocessor, a microcontroller-based platform, a suitable integrated circuit or one or more application-specific integrated circuits (ASIC's). The processor is in communication with or operable to access or to exchange signals with at least one data storage or memory device 314. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

7.3 Award/Outcome Determination

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

7.4 Display Device

In one embodiment, as illustrated in FIG. 42, the gaming device includes one or more display devices controlled by the processor. The display devices are preferably connected to or mounted to the cabinet of the gaming device. The embodiment shown in FIG. 40 includes a central display device 316 which displays a primary game. This display device may also display any suitable secondary game associated with the primary game as well as information relating to the primary or secondary game. The alternative embodiment shown in FIG. 41 includes a central display device 316 and an upper display device 318. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 40 and 41, in one embodiment, the gaming device includes a credit display 320 which displays a player's current number of credits, cash, account balance or the equivalent. In one embodiment, gaming device includes a bet display 322 which displays a player's amount wagered.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

7.5 Payment Acceptor

As illustrated in FIG. 42, in one embodiment, the gaming device includes at least one payment acceptor 324 in communication with the processor. As seen in FIGS. 40 and 41, the payment acceptor may include a coin slot 326 and a payment, note or bill acceptor 328, where the player inserts money, coins or tokens. The player can place coins in the coin slot or paper money, a ticket or voucher into the payment, note or bill acceptor. In other embodiments, devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

7.6 Input Devices

As seen in FIGS. 40, 41 and 42, in one embodiment the gaming device includes at least one and preferably a plurality of input devices 330 in communication with the processor. The input devices can include any suitable device which enables the player to produce an input signal which is received by the processor. In one embodiment, after appropriate funding of the gaming device, the input device is a game activation device, such as a pull arm 332 or a play button 334 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 40 and 41, one input device is a bet one button 336. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 338. The player may push the cash out button and cash out to receive a cash payment or other suitable form of payment corresponding to the number of remaining credits. In one embodiment, when the player cashes out, the player receives the coins or tokens in a coin payout tray 340. In one embodiment, when the player cashes out, the player may receive other payout mechanisms such as tickets or credit slips redeemable by a cashier (or other suitable redemption system) or funding to the player's electronically recordable identification card.

In one embodiment, as mentioned above and seen in FIG. 42, one input device is a touch-screen 342 coupled with a touch-screen controller 344, or some other touch-sensitive display overlay to allow for player interaction with the images on the display. The touch-screen and the touch-screen controller are connected to a video controller 346. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

7.7 Sound

In one embodiment, as seen in FIG. 42, the gaming device includes a sound generating device controlled by one or more sounds cards 348 which function in conjunction with the processor. In one embodiment, the sound generating device includes at least one and preferably a plurality of speakers 350 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

7.8 Camera

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

7.9 Ancillary Wagering Games

In addition to incorporating the wheel-related elements for the primary wheel game and the related bonus sequence, gaming device 310 can incorporate any ancillary wagering game. The ancillary wagering game can be incorporated into the primary wheel game described above, the bonus sequence described above or a combination thereof. The gaming machine or device may include some or all of the features of conventional gaming machines or devices. The ancillary game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different wagering games, such as video poker games, video blackjack games, video keno, video bingo or any other suitable game may be implemented.

7.9.1 Ancillary Slot Game

In one embodiment, as illustrated in FIGS. 40 and 41, an ancillary wagering game may be a slot game with one or more paylines 352. The paylines may be horizontal, vertical, circular, diagonal, angled or any combination thereof. In this embodiment, the gaming device includes at least one and preferably a plurality of reels 354, such as three to five reels 354, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 354 are in video form, one or more of the display devices, as described above, display the plurality of simulated video reels 354. Each reel 354 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the ancillary wagering game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

7.9.2 Ancillary Poker Game

In one embodiment, the ancillary wagering game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the ancillary wagering game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

7.9.3 Ancillary Keno

In one embodiment, the ancillary wagering game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

7.10 Ancillary Bonus Game

In one embodiment, the bonus sequence of the wheel-related elements may give players the opportunity to win credits in an ancillary bonus or secondary game or ancillary bonus or secondary round. The ancillary bonus or secondary game enables the player to obtain a prize or payout in addition to the prize or payout, if any, obtained from the base or primary game. In general, the ancillary bonus or secondary game produces a significantly higher level of player excitement than the base or primary game because it provides a greater expectation of winning than the base or primary game and is accompanied with more attractive or unusual features than the base or primary game. In one embodiment, the ancillary bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game. In other embodiments, the triggering event or qualifying condition may be by exceeding a certain amount of game play (such as number of games, number of credits, amount of time), or reaching a specified number of points earned during game play.

In another embodiment, the gaming device processor 312 or central server 356 randomly provides the player one or more plays of one or more ancillary secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play an ancillary secondary game without any explanation or alternatively with simple explanations. In another embodiment, the gaming device (or central server) qualifies a player for an ancillary secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the ancillary bonus game to extend play of the ancillary bonus game.

In one embodiment, no separate entry fee or buy in for an ancillary bonus game need be employed. That is, a player may not purchase an entry into an ancillary bonus game, rather they must win or earn entry through play of the primary game thus, encouraging play of the primary game. In another embodiment, qualification of the ancillary bonus or secondary game is accomplished through a simple "buy in" by the player, for example, if the player has been unsuccessful at qualifying through other specified activities. In another embodiment, the player must make a separate side-wager on the ancillary bonus game or wager a designated amount in the primary game to qualify for the ancillary secondary game. In this embodiment, the ancillary secondary game triggering event must occur and the side-wager (or designated primary game wager amount) must have been placed to trigger the ancillary secondary game.

7.11 Data Network Play

Figure 43:
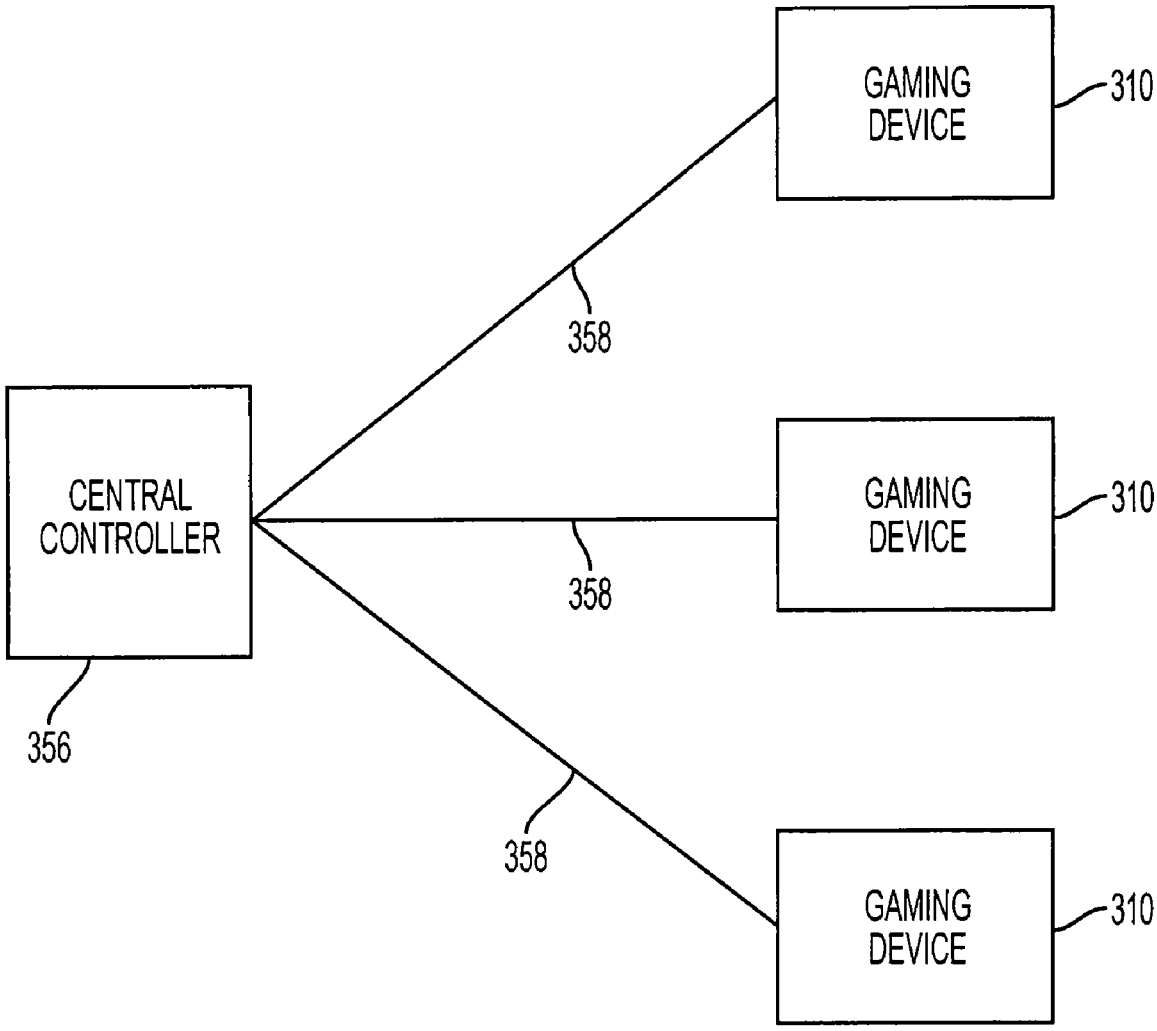
FIG. 43 is a schematic view of a central controller coupled to a plurality of embodiments of the gaming device.

In one embodiment, as illustrated in FIG. 43, one or more of the gaming devices 310 are in communication with each other and/or at least one central server, central controller or remote host 356 through a data network or remote communication link 358. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

7.12 Central Determination

In one embodiment, the game outcome for the wheel-related elements of any of the ancillary games described above is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates an ancillary game outcome for the ancillary primary game based on probability data. In another embodiment, the central server or controller randomly generates a game outcome for the secondary game based on probability data. In another embodiment, the central server or controller randomly generates an ancillary game outcome for the primary game, the ancillary secondary game and any ancillary games based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined ancillary game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, an ancillary secondary game outcome, primary, secondary and ancillary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a ball landing on a designated space in a wheel, a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined ancillary game outcome value is determined for each of a plurality of linked or networked gaming devices based on the results of a bingo, keno or lottery game. In this embodiment, each individual gaming device utilizes one or more bingo, keno or lottery games to determine the predetermined ancillary game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary, secondary game or ancillary secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, an ancillary game outcome is determined for each of the enrolled gaming devices based, at least in part, on the selected elements on the provided bingo cards. As described above, the ancillary game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first ancillary game and a second gaming device to have selected elements marked in a different predetermined pattern is provided a second outcome of win $2 which will be provided to a second player regardless of how the second player plays a second ancillary game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined ancillary game outcome may be based on an ancillary award in addition to any award provided for winning the bingo game as described above. In this embodiment, if one or more elements are marked in ancillary patterns within a designated number of drawn elements, an ancillary or intermittent award or value associated with the marked ancillary pattern is provided to the player as part of the predetermined ancillary game outcome. For example, if the four corners of a bingo card are marked within the first twenty selected elements, an ancillary award of $10 is provided to the player as part of the predetermined ancillary game outcome. It should be appreciated that in this embodiment, the player of a gaming device may be provided an ancillary or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the ancillary game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

7.13 Player Tracking

In one embodiment, the gaming device disclosed herein is associated with or otherwise integrated with one or more player tracking systems. In this embodiment, the gaming device and/or player tracking system tracks any players gaming activity at the gaming device. In one such embodiment, the gaming device and/or associated player tracking system timely tracks when a player inserts their playing tracking card to begin a gaming session and also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data.

7.14 Types of Data Networks

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer, or other internet facilitator is available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications, particularly if such communications are encrypted. Higher data transmission speeds may be useful for enhancing the sophistication and response of the display and interaction with the player.

7.15 Server Based Gaming

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game, an ancillary game or a combination of such games. In another embodiment, the game program may be executable as an ancillary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

7.16 Progressive Game

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be by exceeding a certain amount of game play (such as number of ancillary games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

7.17 Group Gaming

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

In one embodiment, the gaming device 10 includes any one of the embodiments described above. In another embodiment, the gaming device 10 includes any suitable combination of such embodiments. In a further embodiment, the gaming device 10 includes any suitable combination of one or more portions of such embodiments.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming device comprising:

a support structure;

at least one wagering station visible on the support structure, the wagering station being formatted to specify one or more placed wagers; and a wheel assembly supported by the support structure, the wheel assembly including:

(a) a frame, (b) a wall coupled to the frame, the wall including a sloped surface which surrounds a center, and (c) a rotor rotatably coupled to the frame, the rotor supporting:

(i) a series of symbols arranged about the center in a first single circular arrangement, the series of symbols including:

(x) a plurality of game symbols, each one of the game symbols being associated with a game outcome, and (y) at least one bonus symbol, the at least one bonus symbol being associated with an opportunity to reach a bonus outcome, and (ii) a series of landings arranged about the center in a second single circular arrangement, the series of landings including:

(x) a plurality of game landings positioned adjacent to the game symbols, each one of the game landings defining an area, and (y) a bonus landing positioned adjacent to the at least one bonus symbol, the bonus landing defining an area which is larger than the area of each one of the game landings, and when the bonus landing receives a ball, the bonus outcome is reached.

2. The gaming device of claim 1, wherein the bonus outcome is identical to or different from any one of the game outcomes.

3. The gaming device of claim 1, wherein the area of the bonus landing is wider than the area of each one of the game landings.

4. The gaming device of claim 3, wherein the area of the bonus landing includes a greater arc length than the area of each one of the game landings.

5. The gaming device of claim 1, wherein each one of the game landings and the bonus landing defines a space, the space of the bonus landing including a geometry which is different from the space of each one of the game landings.

6. The gaming device of claim 1, wherein the wagering station and the wheel assembly collectively specify a variation of roulette.

7. A gaming device comprising:

a support structure;

at least one wagering station visible on the support structure, the wagering station being formatted to specify one or more placed wagers;

a wheel assembly supported by the support structure, the wheel assembly including:

(a) a frame, (b) a wall coupled to the frame, the wall including a sloped surface which surrounds a center, and (c) a rotor rotatably coupled to the frame, the rotor supporting:

(i) a series of symbols arranged about the center, the series of symbols including:

(x) a plurality of game symbols, each one of the game symbols being associated with a game outcome, and (y) at least one bonus symbol, and (ii) a series of landings arranged about the center, the series of landings including:

(x) a plurality of game landings positioned adjacent to the game symbols, and (y) a bonus landing positioned adjacent to the at least one bonus symbol, the bonus landing defining an opening for a ball to drop through the opening;

a ball routing assembly supported by the support structure, the ball routing assembly including:

(a) a receiver positioned below to the bonus landing, the receiver being configured to receive the ball from the opening as the ball drops through the opening of the bonus landing;

(b) an outlet configured to output the ball, and (c) a passageway between the receiver and the outlet, the passageway sized to receive the ball; and a bonus device positioned adjacent to the support structure, the bonus device being supported by the support structure or a different structure, the bonus device including:

(a) a ball engager positioned adjacent to the outlet, the ball engager configured to engage or receive the ball, and (b) a bonus outcome determiner operable to determine a bonus outcome based, at least in part, on the ball.

8. The gaming device of claim 7, wherein the bonus device includes a randomizer operable with the bonus outcome determiner to determine the bonus outcome.

9. The gaming device of claim 7, wherein the bonus outcome is identical to or different from any one of the game outcomes.

10. The gaming device of claim 7, wherein the bonus landing includes a floor, the floor being movable between an closed position and an open position, the floor defining the opening when in the open position.

11. The gaming device of claim 7, wherein the bonus outcome is determined by a computing device and displayed on a display device.

12. The gaming device of claim 7, which includes a signal generator supported by the ball engager of the bonus device, the signal generator being operable to produce a signal after the ball contacts the ball engager, the signal being associated with the bonus outcome.

13. The gaming device of claim 7, wherein the ball engager includes an additional ball receiver, the additional ball receiver configured to receive the ball from the outlet of the ball routing assembly.

14. The gaming device of claim 13, wherein the bonus device includes at least one additional passageway connected to the additional ball receiver, the additional passageway configured to receive the ball.

15. The gaming device of claim 14, wherein the bonus device includes: (a) a plurality of ball stations; and (b) at least one ball sensor operable to sense which one of the ball stations is reached by the ball.

16. The gaming device of claim 15, wherein the ball sensor includes a signal generator, the signal generator being operable to produce a signal based on a presence of the ball in any one of the ball stations.

17. The gaming device of claim 7, wherein the bonus device includes:

(a) a second wall supported by the frame, the second wall including a sloped surface which surrounds the second wall, and (b) a second rotor rotably coupled to the frame, the second rotor supporting:

(i) a second series of symbols including a plurality of second bonus symbols, and (ii) a second series of landings including a plurality of second bonus landings positioned adjacent to the second bonus symbols.

18. The gaming device of claim 7, wherein the bonus device includes:

(a) a plurality of light sources, (b) a plurality of second bonus symbols positioned adjacent to the light sources, and (c) a processor operable to control illumination of the light sources.

19. The gaming device of claim 18, which includes a cone coupled to the rotor, the cone being surrounded by the series of landings, the light sources of the bonus device being connected to the cone.

20. The gaming device of claim 18, wherein the light sources of the bonus device are connected to the wall.

21. The gaming device of claim 7, wherein the wagering station, the wheel assembly and the bonus device collectively specify a variation of roulette.

22. A gaming device comprising:

a support structure;

at least one wagering station visible on the support structure, the wagering station being formatted to specify one or more placed wagers;

a wheel assembly supported by the support structure, the wheel assembly including:

(a) a frame, (b) a wall coupled to the frame, the wall including a sloped surface which surrounds a center, and (c) a rotor rotatably coupled to the frame, the rotor supporting:

(i) a series of symbols arranged about the center, the series of symbols including:

(x) a plurality of game symbols, each one of the game symbols being associated with a game outcome, and (y) at least one bonus symbol, and (ii) a series of landings arranged about the center, the series of landings including:

(x) a plurality of game landings positioned adjacent to the game symbols, and (y) a bonus landing positioned adjacent to the at least one bonus symbol, and (iii) at least one landing sensor operatively coupled to the bonus landing, the at least one landing sensor configured to produce a signal when a ball lands in the bonus landing; and a bonus device positioned adjacent to the support structure, the bonus device being supported by the support structure or a different structure, the bonus device including:

(a) a processor, (b) a display device controlled by the processor, and (c) a plurality of computer readable instructions, the instructions being executable by the processor to:

(i) determine a bonus outcome when the processor receives the signal from the landing sensor, and (ii) cause the display device to indicate the determined bonus outcome.

23. The gaming device of claim 22, wherein the bonus outcome is identical to or different from any one of the game outcomes.

24. The gaming device of claim 22, wherein the bonus outcome is based upon at least one of the game outcomes.

25. The gaming device of claim 24, wherein the bonus outcome is determined by a computing device and displayed on a display device.

26. The gaming device of claim 22, wherein the bonus device includes at least one input device, the input device being configured to produce an input signal, the input signal being readable by the processor to affect the determination of the bonus outcome.

27. The gaming device of claim 22, wherein the wagering station, the wheel assembly and the bonus device collectively specify a variation of roulette.

28. A gaming device comprising:

a support structure;

at least one wagering station visible on the support structure, the wagering station being formatted to specify one or more placed wagers; and a wheel assembly supported by the support structure, the wheel assembly including:

(a) a frame;

(b) a wall coupled to the frame, the wall including a sloped surface which surrounds a center, and (c) a rotor rotatably coupled to the frame, the rotor supporting:

(i) a series of symbols arranged about the center, the series of symbols including:

(x) a plurality of game symbols, each one of the game symbols being associated with a game outcome, and (y) a bonus symbol, and (ii) a series of landings arranged about the center, the series of landings including:

(x) a plurality of game landings positioned adjacent to the game symbols, and (y) a bonus landing positioned adjacent to the bonus symbol, the bonus landing defining an opening, the opening sized to receive a first ball and allow the first ball to drop through the opening, the opening sized not to receive a second ball, the first ball and the second ball having different sizes, wherein a bonus outcome is reached when the opening receives the first ball.

29. The gaming device of claim 28, wherein the bonus landing includes a floor, the floor being movable between a closed position and an open position, the floor defining the opening when in the open position.

30. The gaming device of claim 28, wherein the first ball is a bonus ball, wherein the second ball is a name ball, wherein the game ball is larger than the bonus ball, the opening being smaller than the game ball.

31. The gaming device of claim 28, wherein the first ball is a game ball, wherein the second ball is a bonus ball, wherein the game ball is smaller than the bonus ball, the opening being smaller than the bonus ball.

32. The gaming device of claim 28, wherein the wagering station and the wheel assembly collectively specify a variation of roulette.

33. A gaming device comprising:

a support structure;

at least one wagering station visible on the support structure, the wagering station being formatted to specify one or more placed wagers;

a wheel assembly supported by the support structure, the wheel assembly including:

(a) a frame, (b) a wall coupled to the frame, the wall including a sloped surface which surrounds a center, and (c) a rotor rotatably coupled to the frame, the rotor supporting:

(i) a plurality of symbols arranged about the center, and (ii) a plurality of landings positioned adjacent to the symbols, at least one of the landings defining an opening sized to receive at least one ball;

a ball holder positioned adjacent to the support structure, the ball holder being supported by the support structure or a different structure, the ball holder being configured to hold the at least one ball, the ball holder being configured to receive the at least one ball when the at least one ball passes through the opening, a bonus outcome being determined when the ball holder receives a predetermined number of balls, the predetermined number of balls being at least one and the at least one landing having a see-through portion, at least part of the held ball being visible through the see-through portion; the see-through portion allowing a player to obtain information associated with the bonus outcome.

34. The gaming device of claim 33, wherein a portion of the ball holder is positioned adjacent to the opening.

35. The gaming device of claim 33, wherein the see-through portion has a transparent characteristic or a translucent characteristic.

36. The gaming device of claim 33, wherein the at least one landing includes a floor which is movable between a closed position and an open position, the floor defining the opening when in the open position.

37. The gaming device of claim 33, which includes a drop indicator supported by the support structure, the drop indicator operable to indicate information relating to the ball dropping fully or partially through the opening.

38. The gaming device of claim 37, wherein the drop indicator includes an output device selected from the group consisting of a visual output device, an audio output device and an audiovisual output device.

39. The gaming device of claim 33, wherein the wagering station and the wheel assembly collectively specify a variation of roulette.

40. A gaming device comprising:

a support structure;

at least one wagering station visible on the support structure, the wagering station being formatted to specify one or more placed wagers;

a wheel assembly supported by the support structure, the wheel assembly including:

(a) a frame;

(b) a wall coupled to the frame, the wall including a sloped surface which surrounds a center; and (c) a rotor rotatably coupled to the frame, the rotor supporting:

(i) a plurality of symbols arranged about the center, and (ii) a plurality of landings positioned adjacent to the symbols;

a plurality of primary outcomes, each one of the primary outcomes being associated with a landing of a ball in one of the landings;

at least one visual output device supported by the frame and connected to the rotor, and at least one of the landings; and a processor operatively coupled to the visual output device, the processor programmed to:

(a) determine at least one award based on predetermined probability data, wherein the at least one award is provided to at least one player, and (b) cause the visual output device to indicate the determined award.

41. The gaming device of claim 40, which includes a cone coupled to the rotor, the cone being surrounded by the series of landings, the visual output device being connected to the cone.

42. The gaming device of claim 40, wherein the wagering station and the wheel assembly collectively specify a variation of roulette.

43. A gaming device comprising:

an input device;

a display device;

a processor; and a memory device storing a plurality of instructions executable by the processor, the instructions, when executed by the processor, causing the processor to operate with the input device and the display device for a play of a game to:

(a) display a wagering station, (b) accept one or more wagers, and (c) display a rotor, the rotor including:

(i) a series of symbols arranged about the center in a first circular pattern, the series of symbols including:

(x) a plurality of game symbols, each one of the game symbols being associated with a game outcome, and (y) at least one bonus symbol, the at least one bonus symbol being associated with an opportunity to reach a bonus outcome, and (ii) a series of landings arranged about the center in a second single circular pattern, the series of landings including:

(x) a plurality of game landings positioned adjacent to the game symbols, each one of the game landings defining an area, and (y) a bonus landing positioned adjacent to the at least one bonus symbol, the bonus landing defining an area which is larger than the area of each one of the game landings, and when the bonus landing receives a ball, the bonus outcome is reached.

* * * * *

UNITED STATES PATENT AND TRADEMARK OFFICE

CERTIFICATE OF CORRECTION

PATENT NO. : 7,674,172 B2
APPLICATION NO. : 11/558777
DATED : March 9, 2010
INVENTOR(S) : Paul D. Miltenberger et al.

It is certified that error appears in the above-identified patent and that said Letters Patent is hereby corrected as shown below:

IN THE CLAIMS:

In Claim 22, Column 33, Line 35, delete "and".

In Claim 30, Column 34, Line 43, replace "name" with --game--.

In Claim 43, Column 36, Line 33, replace "the" with --a--.

Signed and Sealed this

Twenty-seventh Day of July, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,674,172 B2
APPLICATION NO. : 11/558777
DATED : March 9, 2010
INVENTOR(S) : Paul D. Miltenberger et al.

It is certified that error appears in the above-identified patent and that said Letters Patent is hereby corrected as shown below:

IN THE CLAIMS:

In Claim 22, Column 33, Line 35, delete “and”.

In Claim 30, Column 34, Line 43, replace “name” with --game--.

In Claim 33, Column 35, Line 3, after “ball” insert --and--.

In Claim 43, Column 36, Line 33, replace “the” with --a--.

This certificate supersedes the Certificate of Correction issued July 27, 2010.

Signed and Sealed this
Seventeenth Day of April, 2012

David J. Kappos

David J. Kappos
*Director of the United States Patent and Trademark Office*